US009271554B2

(12) United States Patent
Nakashima

(10) Patent No.: US 9,271,554 B2
(45) Date of Patent: Mar. 1, 2016

(54) APPLICATOR

(75) Inventor: Atsushi Nakashima, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 13/814,840

(22) PCT Filed: Aug. 12, 2011

(86) PCT No.: PCT/JP2011/068440

§ 371 (c)(1),
(2), (4) Date: Feb. 7, 2013

(87) PCT Pub. No.: WO2012/020841

PCT Pub. Date: Feb. 16, 2012

(65) Prior Publication Data

US 2013/0133678 A1 May 30, 2013

(30) Foreign Application Priority Data

| | | |
|---|---|---|
| Aug. 12, 2010 | (JP) | 2010-180910 |
| Aug. 12, 2010 | (JP) | 2010-180911 |
| Aug. 12, 2010 | (JP) | 2010-180912 |
| Aug. 12, 2010 | (JP) | 2010-180913 |
| Dec. 1, 2010 | (JP) | 2010-268368 |
| Dec. 1, 2010 | (JP) | 2010-268369 |
| Dec. 1, 2010 | (JP) | 2010-268370 |
| Dec. 1, 2010 | (JP) | 2010-268371 |

(51) Int. Cl.
*A45D 19/00* (2006.01)
*A45D 20/24* (2006.01)
(Continued)

(52) U.S. Cl.
CPC ..... *A45D 24/22* (2013.01); *A45D 19/0008* (2013.01); *A45D 19/02* (2013.01); *A45D 24/24* (2013.01)

(58) Field of Classification Search
CPC ..... A45D 24/24; A45D 24/28; A46B 11/00; B43K 1/12; B43K 5/06; B43K 5/12
USPC ..... 132/108, 116, 74.5; 222/321.5, 464.7; 401/143, 171, 176, 178–180, 192, 194; 206/229
See application file for complete search history.

(56) References Cited

U.S. PATENT DOCUMENTS 2,162,223 A * 6/1939 Larsen ..... 401/192
3,358,699 A * 12/1967 Bau ..... 401/70
(Continued)

FOREIGN PATENT DOCUMENTS

EP 1803368 * 4/2007
JP 03-162272 A 7/1991
(Continued)

OTHER PUBLICATIONS

International Search Report (PCT/ISA/210) issued on Nov. 22, 2011, by the Japanese Patent Office as the International Searching Authority for International Application No. PCT/JP2011/068440.

*Primary Examiner* — Rachel Steitz
*Assistant Examiner* — Jennifer Gill
(74) *Attorney, Agent, or Firm* — Buchanan Ingersoll & Rooney PC

(57) ABSTRACT

An applicator including an applying part of a liquid absorber impregnated with an application liquid. An indicator portion having a jagged configuration that varies in reflectance of light depending on the quantity of the application liquid in the liquid absorber is formed adjacent to the liquid absorber, and the formed area of the indicator portion of an application liquid feeder can be visually observed from the outside so that the quantity of the application liquid can be displayed by the reflected light of indicator portion. The applicator allows a visual check on whether the application liquid is full or less when the applicator is unused or when the application liquid is decreased after use, from the change of the reflectance of light in indicator. The applicator permits easy confirmation of the liquid quantity and can easily avoid liquid blobbing.

3 Claims, 71 Drawing Sheets

(51) Int. Cl.

| | |
|---|---|
| ***A45D 24/22*** | (2006.01) |
| ***A45D 19/02*** | (2006.01) |
| ***A45D 24/24*** | (2006.01) |

(56) References Cited

U.S. PATENT DOCUMENTS

| | | | | | |
|---|---|---|---|---|---|
| 4,968,870 | A | * | 11/1990 | Moon | H05B 1/0225 219/222 |
| 4,993,437 | A | * | 2/1991 | Kimura et al. | 132/112 |
| 5,062,435 | A | * | 11/1991 | Ohtsuka | 132/108 |
| 5,325,878 | A | * | 7/1994 | McKay | 132/116 |
| 5,984,556 | A | * | 11/1999 | Gray et al. | 401/192 |
| 6,688,314 | B1 | * | 2/2004 | Hoeffkes et al. | 132/114 |
| 2005/0066996 | A1 | * | 3/2005 | France et al. | 134/6 |
| 2007/0119844 | A1 | * | 5/2007 | Lo | A45D 1/04 219/225 |
| 2008/0014010 | A1 | * | 1/2008 | Bartschi et al. | 401/146 |
| 2008/0060665 | A1 | | 3/2008 | Umeno et al. | |
| 2008/0083415 | A1 | * | 4/2008 | Umeno et al. | 132/116 |
| 2010/0147323 | A1 | * | 6/2010 | Hafemann | A45D 1/04 132/223 |

FOREIGN PATENT DOCUMENTS

| | | | |
|---|---|---|---|
| JP | 06-031604 | U | 4/1994 |
| JP | 7-144168 | A | 6/1995 |
| JP | 8-242931 | A | 9/1996 |
| JP | 2511817 | | 9/1996 |
| JP | 2511817 | Y2 | 9/1996 |
| JP | 2514905 | Y | 10/1996 |
| JP | 2514905 | Y2 | 10/1996 |
| JP | 2514906 | Y | 10/1996 |
| JP | 2514906 | Y2 | 10/1996 |
| JP | 9-010037 | A | 1/1997 |
| JP | 9-066246 | A | 3/1997 |
| JP | 11-105953 | A | 4/1999 |
| JP | 11-206456 | A | 8/1999 |
| JP | 2000-070828 | A | 3/2000 |
| JP | 2004-065295 | A | 3/2004 |
| JP | 2005-342312 | A | 12/2005 |
| JP | 2006-006754 | A | 1/2006 |
| JP | 2009-050354 | A | 3/2009 |
| WO | WO 2007/066764 | A1 | 6/2007 |

* cited by examiner

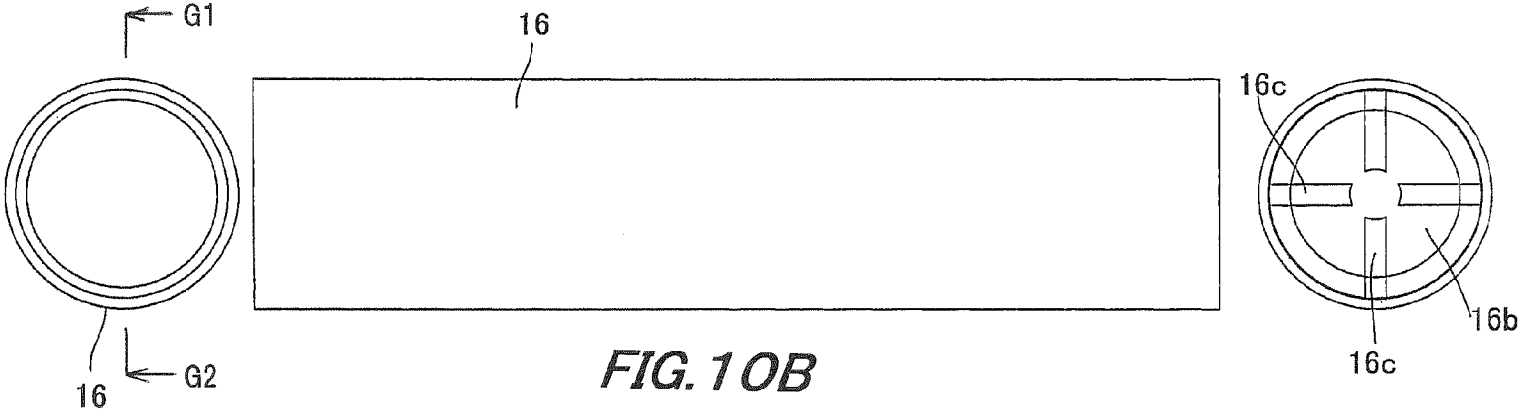
FIG. 10D
FIG. 10B
FIG. 10A
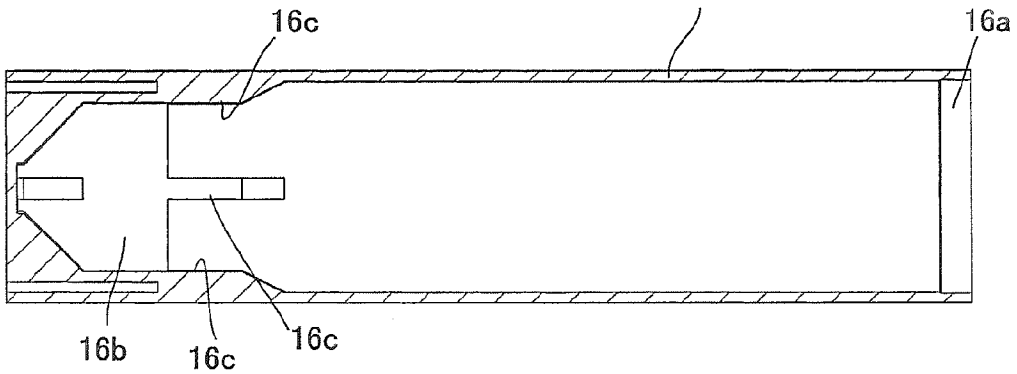
FIG. 10C

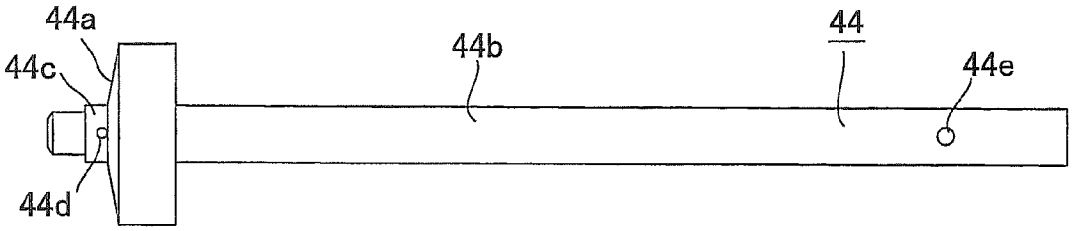
FIG. 11C
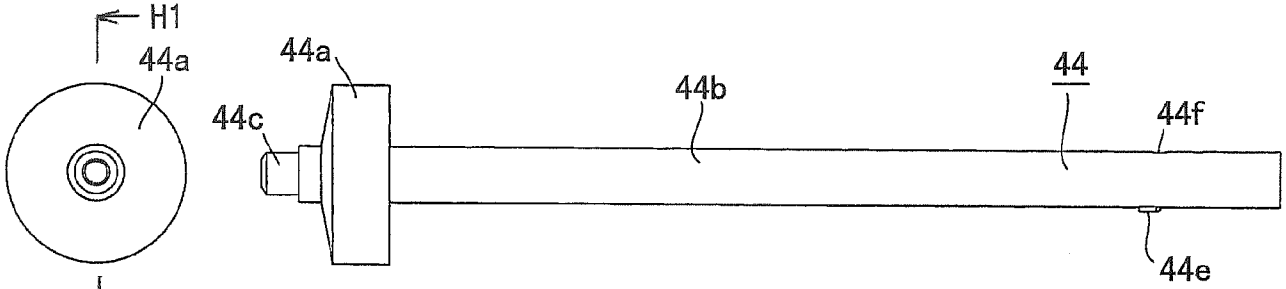
FIG. 11D
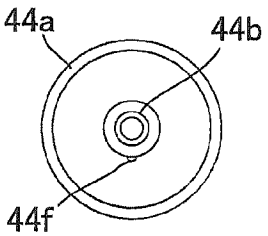
FIG. 11G
FIG. 11A

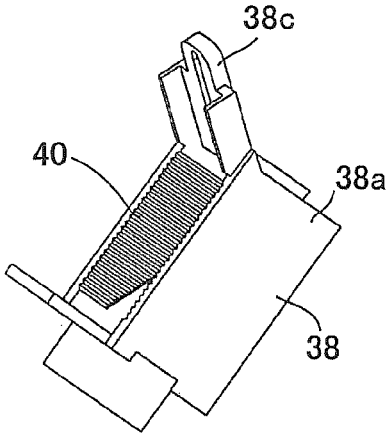
FIG.34B
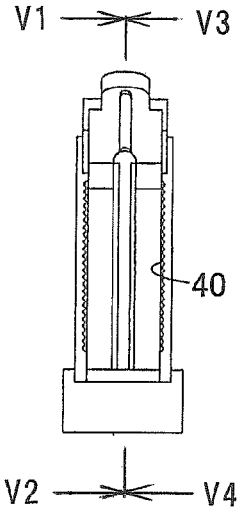
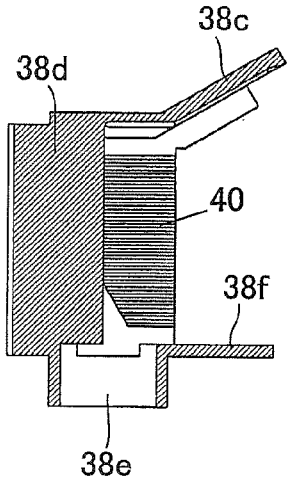
FIG.34A FIG.34C

APPLICATOR

TECHNICAL FIELD

The present invention relates to a hair-care applicator, and relates to a hair-care applicator that is attached to a container body to apply an application liquid (hair dye, hair liquid, hair tonic etc.) stored in the container while combing hair (including hairs of humans and others such as pet animals, etc.).

BACKGROUND ART

Conventionally there have been known applicators for dyeing hair, which deliver an application liquid such as a hair dye or the like stored in a container, into the spaces between comb teeth of a comber attached to the container to dye hair by combing hair with the comber. The hair-care applicators involve various problems as the following (1) to (4).

(1) When the above-described conventional hair-care applicator is used, in order to avoid blobbing of the application liquid or avoid the applicator becoming unusable due to lack of the application liquid in the container, there have been proposals of various methods that enable the user to grasp the life time or to check the quantity of the application liquid.

For example, Japanese Utility Model Registration No. 2511817 (: Patent Document 1) discloses a liquid applicator which includes: an inner barrel having a liquid stored therein, accommodated in an outer barrel in a movable manner in the axial direction; an applying part such as a brush or the like attached to the front end of the outer barrel; and a valve member between the applying part and the inner barrel to supply the liquid from the inner barrel to the applying part via the valve being opened by advancing the inner barrel relative to the output barrel, wherein the inner barrel is formed to be transparent and arranged so that the rear end of the inner barrel is projected rearwards from the rear end of the outer barrel and is covered with a clicking part having a window hole, whereby the residual quantity of the applying part in the inner barrel can be checked through the window hole.

Japanese Patent Application Laid-open 2006-6754 (: Patent Document 2) discloses an application container which has an impregnated member removably attached to comb teeth at the front end of a cylinder so as to apply a liquid agent to the hair of the head from the impregnated member, wherein a depressed portion is formed on the inner surface of the cylinder along a window provided on the side surface of the cylinder while a projected portion is formed on a transparent portion formed on the side wall of a storing container for showing the liquid agent therein so that the projected portion will mesh with the depressed portion when the storing container is inserted into the cylinder, whereby the liquid agent inside the storing container can be observed at the window through the depressed portion, projected portion and the transparent portion.

However, with the specifications of the conventional applicators, other than the free-liquid type, using a porous material such as a sliver or applying part impregnated with an application liquid, there has been the problem that the porous material dyed with the liquid color is always seen even when no liquid remains, hence it is difficult to know presence or absence of the liquid. The above-mentioned patent document 1 and 2 and other technologies have no measures to solve this problem.

(2) In the field of the conventional hair-care applicators, for example there has been a disclosure of a cartridge type liquid ejector including a container that holds and reduces or restores a liquid and ejects the liquid by releasing a valve connected to the container by pressing the rear part of the container to change the volume of the container (Japanese Patent Application Laid-open 2000-70828: Patent Document 3).

This cartridge type liquid ejector is a clicking type applicator which readily ejects the liquid to the applying part by opening the valve as the rear end of the cartridge is clicked.

However, this applicator disclosed in patent document 3 is configured so as to hold the applicator with its applying part down when the liquid is delivered to the applying part by clicking and hold the applicator with the applying part directed upward when the applying part is applied on the hair. As a result, with the rear-end clicking type mechanism like this, it is necessary to change the applicator from one position to another every time when changing ejection and application.

Further, the interior of the container forms a closed space during storage, if the internal pressure of the container becomes higher than the ambient pressure due to the expansion in volume of air inside the container or any other reason, there is a possibility that the application liquid will excessively eject out at a next usage due to different in air pressure.

(3) Further, in the field of the above conventional hair-care applicators, for example a comb-equipped container is disclosed, which includes: a squeezable container body; a screw cap part having a threaded sleeve screw-assembled with the container body and having a fitting sleeve formed upright on the top of the threaded sleeve; and a comb-equipped cap part that has an assembled sleeve that is externally assembled on the fitting sleeve and closely screw-assembled on an opening sleeve of the container body (Japanese Patent Application Laid-open 2004-65295: Patent Document 4). The comb-equipped cap part has a plurality of comb teeth planted in the horizontal direction on the upper surface of the top plate that encloses the upper end of the upright sleeve at the top end of assembled sleeve. Each comb tooth is formed with an ejection hole that opens in the horizontal direction and is penetrated to an ejection passage to the underside of the top plate. As the container body is pressed with the comb teeth down, the content liquid passes through the ejection passage and ejects out from the ejection holes to the outer peripheral surface of the comb teeth.

Also, a hair-care applicator has been disclosed, which, while combing hair by a comber made up of a comb member and a plurality of porous applying parts arrayed comb-like and arranged parallel to the comb member, can apply the application liquid to the hair by means of the applying parts (Japanese Patent Application Laid-open 2005-342312: Patent Document 5).

Another disclosure is an application container in which an applying functional part of a base cylinder with comb teeth arrayed on a hinge is assembled in a slidable manner with an attachment functional part having a supporting cylinder at the top of an upright sleeve formed with an ejection passage so as to release an ejection chamber formed between the two functional parts by mutual sliding movement (Japanese Patent Application Laid-open 2009-50354: Patent Document 6).

There is another disclosure of an agent applicator comprising: a joint member that is formed of a dual structured cylinder having a top-open annular depressed portion defined by inner and outer annular parts and a bottom joining these and is removably attached to a filled container having a spray valve; and a spout member, which is formed of a dual structured, bottom-open cylinder defined by inner and outer annular parts and a top plate having a feed passage to a comber assembly, and to which the joint member is removably and axially slidably attached (Japanese Patent Application Laid-open H09-66246: Patent Document 7).

Further, there is a disclosure of an application container having comb teeth and an impregnated material attached at the front end of a sleeve in a removable manner for applying a liquid agent on the hair of the head (the above Japanese Patent Application Laid-open 2006-6754: Patent Document 2).

However, all of the applicators of the above patent documents 2 and 4 to 7 entail inconvenience in handling.

Specifically, in the above Patent Document 4, since the cap part needs to be rotated to attach or detach the comber, it is troublesome because the user needs to handle the applicator while taking care that the hair dye etc. will not adhere to the fingers and for other reasons.

Further, in Patent Document 5, the applying part is difficult to hold, and if the applying part is tried to be taken out by dropping or turning the applicator upside down, there is a fear of the liquid running over.

In Patent Document 6, since the mechanism is such that the attachment functional part is inclined to deliver, no clicking stroke can be used. Therefore, this configuration is suited for aerosol type containers in which a compressed gas is charged like the aforementioned Patent Document 3 but is not suited for push-type or valve type containers in which no compressed gas is filled.

Further, in Patent Document 7, since it is necessary to release a snap fixed part and pull out the comber from the base in order to take the comber off the base, the operator needs to handle the applicator with both hands (while taking care of the front end of the comber that is fully oozed with the liquid, which the operator does not want to touch with fingers), thus this configuration results in inconvenience.

Moreover, in the aforementioned Patent Document 2, similarly to Patent Document 7, it is necessary to handle the applicator with both hands to separate the comber from the main body, this configuration hence entails inconvenience and the fear of soling the hands with the application liquid.

(4) In the field of the above conventional hair-care applicators, for example, as a hair-care applicator for cosmetic container with a built-in applicator, a hair-care applicator has been disclosed, which, while combing hair by a comber made up of a comb member and a plate-like porous applying part arrayed comb-like and arranged with the comb member, can apply the application liquid to the hair by means of the applying part (Japanese Patent Application Laid-open 2005-342312: Patent Document 5).

Disclosed is an applicator for a hair-care cosmetic liquid having multiple capillary cores with their front ends projected in front of the barrel and a comb arranged along the side of the cores, in which each core is aligned approximately parallel to the comb while each tooth of the comb and each core are positioned so as to lean over to each other with respect to the approximate perpendicular direction to the comb and the rows of cores. (Japanese Utility Model Registration No. 2514906: Patent Document 8).

Also disclosed is an applicator for a hair-care cosmetic liquid, in which multiple rows of cores (applying parts) are aligned so that the cores of the adjacent rows lean over to each other with respect to the approximately perpendicular direction of the rows while combs are arranged on the outer sides of the cores and parallel to the rows of the cores so that the combs and cores are arranged alternately. (Japanese Utility Model Registration No. 2514905: Patent Document 9).

Another disclosure is a hair dye container having a comber formed of two comb-toothed arrays and an impregnated material held therebetween so that the impregnated material with comb teeth is removably attached to a barrel body in an inclined position relative to the barrel body (the above Japanese Patent Application Laid-open 2006-6754: Patent Document 2).

The applicators disclosed in each of the above Patent Documents 2, 5, 8 and 9 is a hair-dye container in which the distal ends of the comb teeth (comber) are arranged at the position marginally projected forwards with respect to the applying part so that the applying part will not touch the scalp.

However, when these applicators are used with the comber inclined, only the distal ends of the comb teeth come into contact while the applying part is located away from the scalp, hence causing inconvenience in application performance. On the contrary, when the comb is arranged close to the applying part, the liquid drips from the applying part to the comb teeth, giving rise to a soiling problem of the comb teeth (comber).

PRIOR ART DOCUMENTS

Patent Documents

Patent Document 1

Japanese Utility Model Registration No. 2511817

Patent Document 2

Japanese Patent Application Laid-open 2006-6754

Patent Document 3

Japanese Patent Application Laid-open 2000-70828

Patent Document 4

Japanese Patent Application Laid-open 2004-65295

Patent Document 5

Japanese Patent Application Laid-open 2005-342312

Patent Document 6

Japanese Patent Application Laid-open 2009-50354

Patent Document 7

Japanese Patent Application Laid-open H09-66246

Patent Document 8

Japanese Utility Model Registration No. 2514906

Patent Document 9

Japanese Utility Model Registration No. 2514905

SUMMARY OF THE INVENTION

Problems to be Solved by the Invention

In view of the circumstances described above, it is therefore an object of the present invention to provide an applicator of even a direct-liquid type, which permits easy confirmation of the liquid quantity and can easily avoid liquid blobbing and allow easy grasp of the life.

In view of the circumstances described above, it is also an object of the present invention to provide an applicator which is free from trouble or does not need to change the posture of the applicator when the application liquid is delivered to the applying part and when the application liquid is applied to the object from the applying part.

It is another object to provide an applicator that is free from problems such as unexpected spouting of the application liquid and the like at the time of a next use due to pressure difference even if the internal pressure of the container has been increased during storage.

In view of the circumstances described above, it is a further object to provide an applicator that enables the application unit to be attached and detached by handling at a single place and hence realizes markedly easy replacement of the applying part.

In view of the circumstances described above, it is still another object to provide an applicator having a configuration that can keep the applying part close to the scalp even if the applicator is used in a tilted position, is unlikely to cause application failures and is unlikely to cause the application liquid to transfer from the applying part to the comb teeth hence will not stain the comb teeth.

Means for Solving the Problems

The first invention resides in an applicator for applying an application liquid to an object with an applying part by supplying the application liquid stored in a container body to the applying part, characterized in that a liquid absorber impregnated with the application liquid is provided, an indicator portion having a jagged configuration that varies in reflectance of light depending on the quantity of the application liquid in the liquid absorber is formed adjacent to the liquid absorber, and the formed area of the indicator portion can be visually observed from the outside so that the quantity of the application liquid can be displayed by the reflected light of the indicator portion.

In the present invention, it is preferable that the jagged configuration of the indicator portion is formed in an inclined zigzag pattern.

In the present invention, it is also preferable that the liquid absorber is used as the applying part and a pumping mechanism for appropriately supplying the application liquid freely stored in the container body to the applying part by user operation is provided.

In the present invention, it is also preferable that a liquid absorber impregnated with the application liquid is provided inside the container body, and the indicator portion is configured adjacent to the liquid absorber so as to be visible from the outside so that the quantity of the application liquid inside the container body can be displayed.

The invention resides in an applicator which stores the application liquid in the container body and has the applying part arranged in the front in the axial direction of the container body and a pumping mechanism for supplying the application liquid in the container body to the applying part, characterized in that the pumping mechanism includes: a piston part that moves forwards and backwards; a compression room that is a space located in the rear part of the container body and partitioned by the piston part to compress a fixed amount of the application liquid by rearward movement of the piston part; and a path that is a channel for delivering the application liquid in the compression room to the applying part and has an inner volume smaller than that of the compression room, and is provided with a handle for moving the piston part rearwards by user operation.

In the present embodiment, it is preferable that a hole for communicating the compression room partitioned by the piston part with the front side space of the piston part in the container body when the compression room is not compressed by the piston part, is formed in the path in the front part of the path inside the container body before reaching the applying part.

It is also preferable that a hole that communicates the front side space of the piston part in the container body with the outside air at the position directly under a valve serving as a shutoff from the outside air and immediately after release of the valve when the compression room is not compressed by the piston part, is provided in the path in the front part of the path inside the container body before reaching the applying part.

Further, in the present invention, it is also preferable that a valve structure that communicates the compression room partitioned by the piston part with the front side space of the piston part in the container body during a partial interval of the compressing stroke after start of compression inside the compression room by means of the piston part and shuts off from the interior of the container body during the remaining interval of the compression stroke is provided in the front part of the path inside the container body before reaching the applying part.

The invention resides in an applicator for supplying the application liquid stored in the container body to the hair while combing the hair with a comber having the applying part in-between, characterized in that a liquid supplying mechanism is arranged inside the container body, a pressing part for supplying the liquid from the liquid supplying mechanism to the applying part is formed with the comber, and the comber and the applying part can be taken off from the container body.

Further, in the present invention, it is preferable that the comber and the applying part can be taken off from the container body by operating the pressing part.

The invention resides in a hair-care applicator for supplying an application liquid stored in a container body from an applying part to the hair while combing the hair with a comber, including: the comber having multiple comb-formed projections projectively formed therein; and the applying part positioned between comb-toothed parts in which the multiple comb-formed projections of the comber are arrayed, characterized in that

- a front barrel for attaching the comber to the front end of the container body has a slit portion formed on the outer periphery thereof, opening toward the front side in the axial direction,
- the comber has the comb-toothed parts formed in the front part thereof with respect to the axial direction and also has a cantilevered pressing part having engaging structures formed at both sides with respect to the width direction, on the side surface in the rear part of the comber,
- the rear part of the comber is attached to the front barrel so as to be moveable back and forth with the pressing part fitted in the slit portion,
- the engaging structures of the pressing part when fitted in the slit portion abut projected pieces projected inwards with respect to the width direction in the slit portion so as to constrain the comber from moving forwards, and, when the pressing part is pressed toward the center of the front barrel, the abutment between the engaging structures and the projected pieces is released so that the comber can be taken out from the front barrel.

In the present invention, it is preferable that the rear part of the comber has a rear-open approximately cylindrical form, the pressing part has, in the rear part, an elastically deformable arm that is defined by forming cuts across part in the circumferential direction, from the rear end toward the front, forming a cantilevered configuration, and engaging structures projected radially outward at both sides with respect to the width direction in the rear end of the arm, the front barrel has a wall-like outer periphery and an inner peripheral wall portion formed thereinside and spaced a clearance therefrom so that the rear part of the comber is fitted in the clearance between the outer periphery and the inner peripheral wall portion so as to be movable back and forth, and the clearance inside the area between the projected pieces of the slit portion is formed with such spacing as to permit release of the engagement between the engaging structures and projected pieces when the pressing part is pressed and elastically deformed.

In the present invention, it is also preferable that the pressing part is formed with a pusher that extends radially outward from the rear end of the arm and is narrower than the distance between the projected pieces of the slit portion; and, the container body is equipped with a pumping mechanism that supplies the application liquid in the container body to the applying part in the comber when the comber is moved rearwards relative to the front barrel and the container body by moving the pusher of the pressing part rearward in the axial direction.

The invention resides in an applicator for supplying the application liquid stored in the container body from the applying part to the hair while combing the hair with the comber, including: the comber having multiple comb-formed projections projectively formed therein; one or multiple applying parts positioned between comb-toothed parts in which the multiple comb-formed projections of the comber are arrayed, characterized in that the comb-formed projections of the comb-toothed parts and the applying parts are arranged apart, and, the outer peripheral sides of part of one or multiple applying parts approximately abut virtual lines that are defined by joining the inner end faces of the comb-formed projections in the comb-toothed parts.

The term "approximately abut" indicates a distance equal to 1 mm or less as an estimate.

In the present invention, it is preferable that part of the applying parts that approximately abut virtual lines defined by joining the inner end faces of the comb-formed projections are positioned between the comb-formed projections defining the virtual lines, in the arrayed direction of the comb-formed projections in the comb-toothed parts.

In the present invention, it is preferable that part of the applying parts that approximately abut virtual lines defined by joining the inner end faces of the comb-formed projections and the other applying parts that do not approximately abut the virtual lines are arranged alternately.

In the present invention, it is preferable that the applying parts and the comb-formed projections are arranged approximately a fixed distance apart.

In the present invention, it is preferable that part of the applying parts that approximately abut virtual lines defined by joining the inner end faces of the comb-formed projections are formed so that the distal ends are shaped with a spherical side form.

Effect of the Invention

According to the first invention, the applicator has a liquid absorber impregnated with an application liquid, a jagged indicator portion that varies in reflectance of light depending on the amount of the application liquid in the liquid absorber is formed adjacent to the liquid absorber, and the formed portion of the indicator portion is made visible from the outside so that the amount of the application liquid can be displayed by the reflected light of the indicator portion. Accordingly, the reflectance of light from the indicator portion varies from the unused state to a state after use where the application liquid has decreased, so that it is possible to visually confirm the quantity of the application liquid being fully stored or less stored from the change of the reflected light.

As the indicator portion, the jagged configuration may be formed in an inclined zigzag pattern. If the jagged configuration is formed in an inclined zigzag pattern, the efficiency of reflection of the incident light is high so that the different in strength of reflected light depending on the presence or absence of the application liquid becomes large, thus making it easy to visually confirm the presence or absence of the application liquid.

In the present invention, when the applicator is adapted to use a liquid absorber as the applying part and include a pumping mechanism for appropriately supplying the application liquid freely stored in the container body to the applying part by operation of the user, it is possible to prevent excessive filling to the applying part by visual observation of the indicator portion.

Further, when a liquid absorber impregnated with the application liquid is arranged inside the container body while the indicator portion is placed adjacent to the liquid absorber so as to be visible from the outside to demonstrate the quantity of the application liquid in the container body, the residual quantity of the application liquid in the container body can be visually observed.

According to the applicator of the second invention, the pumping mechanism includes: a piston part that moves forwards and backwards; a compression room that is a space located in the rear part of the container body and partitioned by the piston part to compress a fixed amount of the application liquid by rearward movement of the piston part; and a path that is a channel for delivering the application liquid in the compression room to the applying part and has an inner volume smaller than that of the compression room. Therefore, when the user holds the applicator with the front side up, by moving the piston part rearward by user's operation it is possible to move the application liquid from the compression room located below to the applying part located on the front side via the path. Accordingly, it is possible to feed the application liquid to the applying part without changing the posture of the applicator every time for turning the position of the applying part. Thus, this configuration is convenient.

Since a hole that communicates the front side space of the piston part in the container body with the outside air at the position directly under a valve and immediately after release of the valve when the compression room is not compressed by the piston part is provided in the path, the internal pressure of the container is relieved to the outside air from the hole through the path, so that no spouting of the application liquid or the like will not occur. Further, a valve structure that communicates the compression room partitioned by the piston part with the front side space of the piston part in the container body before the start of compression in the compression room by means of the piston part and during a partial interval of the compressing stroke after the start of compression in the compression room and shuts off the interior of the container body during the remaining part of the compression stroke is provided. As a result, the long path, which may take an unsteady state (with liquid or the air) depending the state of storage, can be positively filled with the liquid and then shut off from the container body so that the liquid can be supplied to the applying part, thus making it possible to stabilize the ejection quantity.

According to the applicators of the third and fourth inventions, the comber can be taken off from the front barrel by releasing abutment between the engaging structures and the projected pieces when the pusher is pressed toward the center of the front barrel. Accordingly, it is possible to attach and remove the application unit by operating a single place, hence replacing the unit simply without soiling hands. Further, it is possible to avoid the risk of the application liquid ejecting due to a clicking malfunction in the state where the click operating portion remains in the main body when the applying part is taken off.

Since in the fifth invention, the comb-formed projections of the comb-toothed parts and the applying parts are arranged apart, and the outer peripheral sides of part of one or multiple applying parts approximately abut virtual lines that are defined by joining the inner end faces of the comb-formed projections in the comb-toothed part, the applying parts will not go too much away from the hair if the applicator is applied on the scalp in an tilted position. Hence this applicator provides easy application of the application liquid and hence is easy to use.

Part of the applying parts that approximately abut virtual lines defined by joining the inner end faces of the comb-formed projections are positioned between the comb-formed projections defining the virtual lines, in the arrayed direction of the comb-formed projections in the comb-toothed part. Even when the comb-tooted part abuts the scalp, this configuration assures reliable application of the application liquid to the hair without bringing the applying part close to the scalp and soiling the scalp with the application liquid.

Moreover, part of the applying parts that approximately abut virtual lines defined by joining the inner end faces of the comb-formed projections and the other applying parts that do not approximately abut the virtual lines are arranged alternately, so that this arrangement enables efficient application at the time of using the applicator, hence making it possible for the applying part to apply in a more reliable manner.

Further, since the applying parts and comb-formed projections are arranged an approximately fixed distance apart, the application liquid is unlikely to stain the comb-formed projections, hence the comber is unlikely to soil, hence this configuration is preferable.

Also, when part of the applying parts that approximately abut virtual lines defined by joining the inner end faces of the comb-formed projections are shaped with a spherical side form in their distal ends, this configuration makes the contact with the hair mild and hence is preferable.

BRIEF DESCRIPTION OF DRAWINGS

FIG. 1A is a side view seen from the lever side, FIG. 1B is a perspective view seen from the applying part side and FIG. 10 is a side view seen from the applying part side.

FIG. 2A is a front view seen from the applying part side, FIG. 2B is a plan view seen from the front side, FIG. 2C is a side view, FIG. 2D is a vertical cross-sectional view taken along plane A1-A2 of FIG. 2A and FIG. 2E is a rear view.

FIG. 3A is a front view seen from the side on which an applying part is attached, FIG. 3B is a side view, FIG. 3C is a vertical cross-sectional view taken along plane B1-B2 of FIG. 3A and FIG. 3D is a rear view.

FIG. 4A is an illustrative vertical cross-sectional view taken along plane A1-A2 of FIG. 2A and FIG. 4B is a side view.

FIG. 5A is a side view and FIG. 5B is a front view.

FIG. 6A is a front view seen from the side on which comb-toothed projections of the comber reside, FIG. 6B is a plan view seen from the front side, FIG. 6C is a side view, FIG. 6D is a view seen from the rear side, FIG. 6E is a front-side perspective view, FIG. 6F is a vertical cross-sectional view taken along plane C1-C2 of FIG. 6A and FIG. 6G is a rear view.

FIG. 7A is a front view seen from the side on which an applying part (not shown) is attached, FIG. 7B is a perspective view, FIG. 7C is a vertical cross-sectional view taken along plane D1-D2 of FIG. 7A, FIG. 7D is a front side view, FIG. 7E is a side view, FIG. 7F a rear side view, FIG. 7G is a vertical cross-sectional view taken along plane D3-D4 of FIG. 7A, FIG. 7H is a front side perspective view, FIG. 7I is a rear side perspective view and FIG. 7J is a rear view.

FIG. 8A is a rear side view, FIG. 8B is a top view from the top, FIG. 8C is a side view, FIG. 8D is a view from the bottom, FIG. 8E is a front side perspective view of an applying part and FIG. 8F is a plan view seen from the front side.

FIG. 9A is a front side perspective view seen from the side on which no slit portion is formed, FIG. 9B is a side view of the same, FIG. 9C is a view from the front side, FIG. 9D is a side view from the other side of FIG. 9B, FIG. 9E is a view from the rear side, FIG. 9F is a front side perspective view seen from the side on which a slit portion is formed, FIG. 9G is a vertical cross-sectional view taken along plane F1-F2 of FIG. 9C, FIG. 9H is a rear side perspective view seen from the side on which a slit portion is formed and FIG. 9I is a side view seen from the side on which a slit portion is formed.

FIGS. 10A to 10D are illustrative diagrams of a container body of the same applicator, FIG. 10A is a view from the rear side, FIG. 10B is a side view, FIG. 100 is a vertical cross-sectional view taken along plane G1-G2 of FIG. 10A and FIG. 10D is a view from the front side.

FIGS. 11A to 11H are illustrative diagrams of a piston body of the same applicator, FIG. 11A is a view from the rear side, FIG. 11B is a perspective view from the rear side, FIG. 11C is a side view seen from the side on which a liquid passage is formed, FIG. 11D is a side view from the other side, FIG. 11E is a vertical cross-sectional view taken along plane H1-H2 of FIG. 11A, FIG. 11F is a side view on which no liquid passage is formed, FIG. 11G is a view from the front side and FIG. 11H is a perspective view from the front side.

FIG. 12A is a rear side perspective view, FIG. 12B is a rear side view, FIG. 12C is a side view seen from the liquid passage side, FIG. 12D is a vertical cross-sectional view taken along plane I1-I2 of FIG. 12C, FIG. 12E is a side view showing the same state as in FIG. 12D, FIG. 12F is a side view seen from the rear side of FIG. 12C, FIG. 12G is a front side perspective view and FIG. 12H is a front side view.

FIG. 13A is a rear side perspective view, FIG. 13B is a rear side view, FIG. 13C is another rear side perspective view, FIG. 13D is a side view seen from the side on which a return hole is formed, FIG. 13E is a side view 90° rotated from FIG. 13D, FIG. 13F is a vertical cross-sectional view taken along plane J1-J2 of FIG. 13D, FIG. 13G is a side view seen from the side on which a slide hole is formed, FIG. 13H is a front side perspective view seen from the side on which a return hole is formed, FIG. 13I is a front side view and FIG. 13J is a front side perspective view seen from the side on which a slide hole is formed.

FIG. 17A is a front seen from the applying part side, FIG. 17B is a plan view seen from the front side, FIG. 17C is a side view, FIG. 17D is a side view (rear view) seen from the lever side, FIG. 17E is a front side perspective view seen from the lever side and FIG. 17F is an oblique front view.

FIG. 18A is a side view, FIG. 18B is a front view and FIG. 18C is a perspective view from the front side.

FIG. 19A is a perspective view from the front side, FIG. 19B is a front view, FIG. 19C is a plan view from the front side, FIG. 19D is a side view, FIG. 19E is a view from the rear side, FIG. 19F is an oblique front view, FIG. 19G is a vertical cross-sectional view taken along plane L1-L2 of FIG. 19B and FIG. 19H is a rear view.

FIG. 20A is an oblique rear view, FIG. 20B is an oblique front view, FIG. 20C is a front view seen from the side on which an applying part (not shown) is attached, FIG. 20D is a plan view seen from the front side, FIG. 20E is a side view, FIG. 20F is a view from the rear side, FIG. 20G is a vertical cross-sectional view taken along plane M1-M2 of FIG. 20C and FIG. 20H is a rear view.

FIG. 21A is a rear side view, FIG. 21B is a top view from the top, FIG. 21C is a side view, FIG. 21D is a view from the bottom, FIG. 21E is a perspective view seen from the front side and FIG. 21F is a plan view seen from the front side.

FIG. 22A is a front side perspective view seen from the side on which no slit portion is formed, FIG. 22B is a side view of the same, FIG. 22C is a plan view from the front side, FIG. 22D is a side view from the other side of FIG. 22B, FIG. 22E is a view from the rear side, FIG. 22F is a front side perspective view seen from the side on which a slit portion is formed, FIG. 22G is a vertical cross-sectional view taken along plane N1-N2 of FIG. 22C and FIG. 22H is a side view seen from the side on which a slit portion is formed.

FIG. 23A is a vertical cross-sectional view taken along plane O1-O2 of FIG. 23B and FIG. 23B is a view from the front side.

FIG. 24A is a view from the rear side, FIG. 24B is a side view seen from the side on which a projection is formed, FIG. 24C is a side view seen from the other side, FIG. 24D is a vertical cross-sectional view taken along plane P1-P2 of FIG. 24B, FIG. 24E is a side view seen from the side on which a liquid passage is formed and FIG. 24F is a view from the front side.

FIG. 25A is a rear side perspective view, FIG. 25B is a rear side view, FIG. 25C is a side view seen from the opposite side from the liquid passage side, FIG. 25D is a side view with a liquid communication path down, FIG. 25E is a vertical cross-sectional view taken along plane Q1-Q2 of FIG. 25C, FIG. 25F is a side view seen from the liquid communication path side, FIG. 25G is a front side perspective view and FIG. 25H is a front side view.

FIG. 26A is a vertical cross-sectional view taken along plane K1-K2 of FIG. 17A and an illustrative view when the applicator is unused, FIG. 26B is a vertical cross-sectional view taken along plane K1-K2 of FIG. 17A and a view when the applicator starts being pressed, FIG. 26C is a vertical cross-sectional view taken along plane K1-K2 of FIG. 17A and a view during being pressed, FIG. 26D is a vertical cross-sectional view taken along plane K1-K2 of FIG. 17A and a view when being further pressed from FIG. 26C and FIG. 26E is a vertical cross-sectional view taken along plane K1-K2 of FIG. 17A and a view when pressed completely.

FIG. 27A is a side view, FIG. 27B is a front view and FIG. 27C is a perspective view from the front side.

FIG. 28A is a side view seen from the pusher side, FIG. 28B is a perspective view seen from the applying part side and FIG. 28C is a side view seen from the applying part side.

FIG. 29A is a front view seen from the applying part side, FIG. 29B is a plan view seen from the front side, FIG. 29C is a side view, FIG. 29D is a vertical cross-sectional view taken along plane R1-R2 of FIG. 29A and FIG. 29E a rear view.

FIG. 30A is a front view seen from the side on which an applying part is attached, FIG. 30B is a side view, FIG. 30C is a vertical cross-sectional view taken along plane S1-S2 of FIG. 30A and FIG. 30D is a rear view.

FIG. 31A is an illustrative vertical cross-sectional view taken along plane T1-T2 of FIG. 31C, FIG. 31B is a side view and FIG. 31C is a rear view.

FIG. 32A is a cross-sectional view taken along plane A3-A4 of FIG. 32B, FIG. 32B is a side view, FIG. 32C is a front view and FIG. 32D is a front view seen from the direction in which an applying part is attached.

FIG. 33A is a front view seen from the side on which comb-toothed projections of the comber reside, FIG. 33B is a plan view seen from the front side, FIG. 33C is a side view, FIG. 33D is a view seen from the rear side, FIG. 33E a front side perspective view, FIG. 33F is a vertical cross-sectional view taken along plane U1-U2 of FIG. 33A and FIG. 33G is a rear view.

FIGS. 34A to 34I are illustrative diagrams of an application liquid feeder of the same applicator, FIG. 34A is a front view seen from the side on which an applying part (not shown) is attached, FIG. 34B is a perspective view, FIG. 34C is a vertical cross-sectional view taken along plane V1-V2 of FIG. 34A, FIG. 34D is a plan view from the front side, FIG. 34E is a side view, FIG. 34F is a rear side view, FIG. 34G is a rear side perspective view, FIG. 34H is a vertical cross-sectional view taken along plane V3-V4 of FIG. 34A and FIG. 34I is a rear view.

FIG. 35A is a rear side view, FIG. 35B is a top view from the direction of attachment, FIG. 35C is a side view, FIG. 35D is a view from the direction opposite to the direction of attachment, FIG. 35E is a front side perspective view of an applying part and FIG. 35F is a plan view seen from the front side.

FIG. 36A is a front side perspective view seen from the side on which no slit portion is formed, FIG. 36B is a side view of the same, FIG. 36C is a view from the front side, FIG. 36D is a side view from the other side of FIG. 36B, FIG. 36E is a view from the rear side, FIG. 36F is a front side perspective view seen from the side on which a slit portion is formed, FIG. 36G is a vertical cross-sectional view taken along plane W1-W2 of FIG. 36B, FIG. 36H is a rear side perspective view seen from the side on which a slit portion is formed and FIG. 36I is a side view seen from the side on which a slit portion is formed.

FIG. 37A is a view from the rear side, FIG. 37B is a side view, FIG. 37C is a vertical cross-sectional view taken along plane X1-X2 of FIG. 37D and FIG. 37D is a view from the front side.

FIG. 38A is a view from the rear side, FIG. 38B is a perspective view from the rear side, FIG. 38C is a vertical cross-sectional view taken along plane Y1-Y2 of FIG. 38D with a liquid passage down, FIG. 38D is a side view of the same state as FIG. 38C, FIG. 38E is a side view from the side on which a liquid passage is formed, FIG. 38F is a view from the front side and FIG. 38G is a perspective view from the front side.

FIG. 39A is a rear side perspective view, FIG. 39B is a rear side view, FIG. 39C is a vertical cross-sectional view taken along plane Z1-Z2 of FIG. 39B, FIG. 39D is a side view of the same state as FIG. 39C, FIG. 39E is a side view 90° rotated from FIG. 39D, FIG. 39F is a rear side perspective view when FIG. 39A is viewed from the rear side and FIG. 39G is a front side view.

FIG. 40A is a rear side perspective view, FIG. 40B is a rear side view, FIG. 40C is another rear side perspective view, FIG. 40D is a side view seen from the side on which a slide hole is formed, FIG. 40E is a vertical cross-sectional view taken along plane A5-A6 of FIG. 40D, FIG. 40F is a side view showing the same state as FIG. 40E, FIG. 40G is a side view from the side on which a return hole is formed, FIG. 40H is a front side perspective view seen from the side on which a slide hole is formed, FIG. 40I is a front side view and FIG. 40J is a front side perspective view seen from the side on which a return hole is formed.

FIG. 41A is a vertical cross-sectional view taken along plane R1-R2 of FIG. 29A and an illustrative view when the applicator is unused, FIG. 41B is a vertical cross-sectional view taken along plane R1-R2 of FIG. 29A and a view when the applicator starts being pressed, FIG. 41C is a vertical cross-sectional view taken along plane R1-R2 of FIG. 29A and a view during being pressed, FIG. 41D is a vertical cross-sectional view taken along plane R1-R2 of FIG. 29A and a view when being further pressed from FIG. 41C and FIG. 41E is a vertical cross-sectional view taken along plane R1-R2 of FIG. 29A and a view when pressed completely.

FIG. 42A is a front view seen from the applying part side, FIG. 42B is a plan view seen from the front side, FIG. 42C is a side view, FIG. 42D is a vertical cross-sectional view taken along plane B3-B4 of FIG. 42A and FIG. 41E is a rear view.

FIG. 43A is a front view seen from the side on which an applying part is attached, FIG. 43B is a front side plan view, FIG. 43C is a side view, FIG. 43D is a vertical cross-sectional view taken along plane C3-C4 of FIG. 43A and FIG. 43E is a rear view.

FIG. 44A is an illustrative vertical cross-sectional view taken along plane D3-D4 of FIG. 44C, FIG. 44B is a side view and FIG. 44C is a rear view.

FIG. 45A is a front side perspective view seen from the side on which no slit portion is formed, FIG. 45B is a side view of the same, FIG. 45C is a view from the front side, FIG. 45D is a side view from the other side of FIG. 45B, FIG. 45E is a view from the rear side, FIG. 45F is a front side perspective view seen from the side on which a slit portion is formed, FIG. 45G is a side view seen from the side on which a slit portion is formed, FIG. 45H is a rear side perspective view seen from the side on which a slit portion is formed and FIG. 45I is a vertical cross-sectional view taken along plane E3-E4 of FIG. 45C.

MODES FOR CARRYING OUT THE INVENTION

Hereinafter, embodiment modes of the present invention will be described with reference to the accompanying drawings.

Here, in the following description, FIGS. 1A to 10, FIGS. 2A to 2E, FIGS. 3A to 3D, FIGS. 4A to 4B, FIGS. 5A to 5B, FIGS. 6A to 6G, FIGS. 7A to 7J, FIGS. 8A to 8F, FIGS. 9A to 9I, FIGS. 10A to 10D, FIGS. 11A to 11H, FIGS. 12A to 12H, and FIGS. 13A to 13J may be also be generally referred to as FIG. 1, FIG. 2, FIG. 3, FIG. 4, FIG. 5, FIG. 6, FIG. 7, FIG. 8, FIG. 9, FIG. 10, FIG. 11, FIG. 12 and FIG. 13, respectively.

Similarly, FIGS. 17A to 17F, FIGS. 18A to 18C, FIGS. 19A to 19H, FIGS. 20A to 20H, FIGS. 21A to 21F, FIGS. 22A to 22H, FIGS. 23A to 23B, FIGS. 24A to 24F, FIGS. 25A to 25H, FIGS. 26A to 26E, FIGS. 27A to 27C, FIGS. 28A to 28C, FIGS. 29A to 29E, FIGS. 30A to 30D, FIGS. 31A to 31C, FIGS. 32A to 32D, FIGS. 33A to 33G, FIGS. 34A to 34I, FIGS. 35A to 35F, FIGS. 36A to 36I, FIGS. 37A to 37D, FIGS. 38A to 38G, FIGS. 39A to 39G, FIGS. 40A to 40J, FIGS. 41A to 41E, FIGS. 42A to 42E, FIGS. 43A to 43E, FIGS. 44A to 44C, and FIGS. 45A to 45I may also be generally referred to as FIG. 17, FIG. 18, FIG. 19, FIG. 20, FIG. 21, FIG. 22, FIG. 23, FIG. 24, FIG. 25, FIG. 26, FIG. 27, FIG. 28, FIG. 29, FIG. 30, FIG. 31, FIG. 32, FIG. 33, FIG. 34, FIG. 35, FIG. 36, FIG. 37, FIG. 38, FIG. 39, FIG. 40, FIG. 41, FIG. 42, FIG. 43, FIG. 44, and FIG. 45, respectively.

FIGS. 1 to 13 are illustrative diagrams of an applicator according to the first embodiment of the invention. Here, in the following description and drawings inclusive of those of the second embodiment, the front side and rear side of the applicator are defined by assuming that a comber 12 is arranged on the front side relative to a container body 12 as shown in FIG. 1, for example.

Figure 1C:
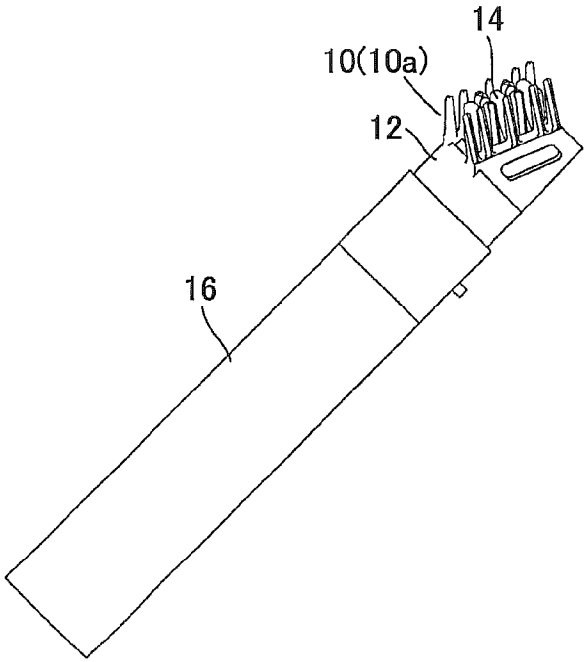
FIGS. 1A to 1C are overall illustrative diagrams of an applicator according to the first embodiment of the present invention.
Figure 1B:
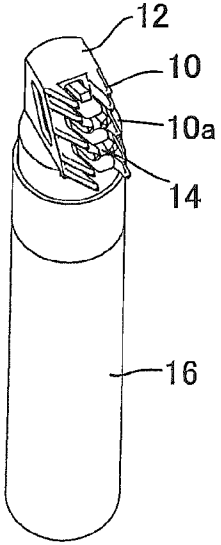
Figure 1A:
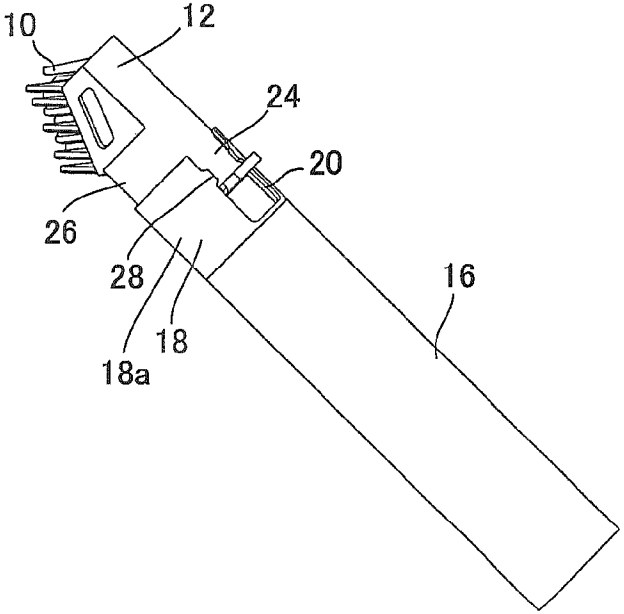
Figure 2B:
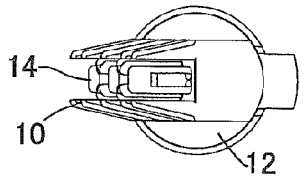
FIGS. 2A to 2E are illustrative diagrams when the same applicator is not operated.
Figures 2A, 2C, 2D, 2E:
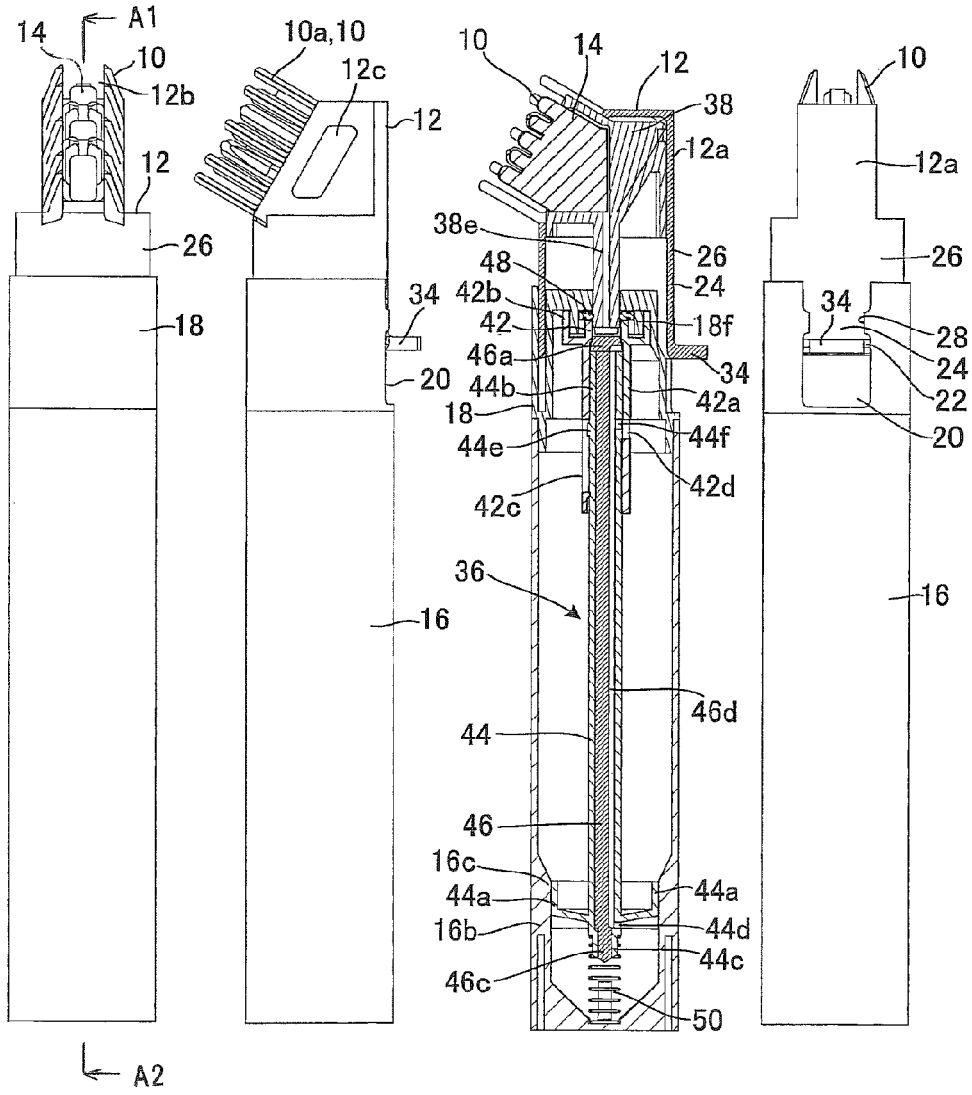
Figures 3A, 3B, 3C, 3D:
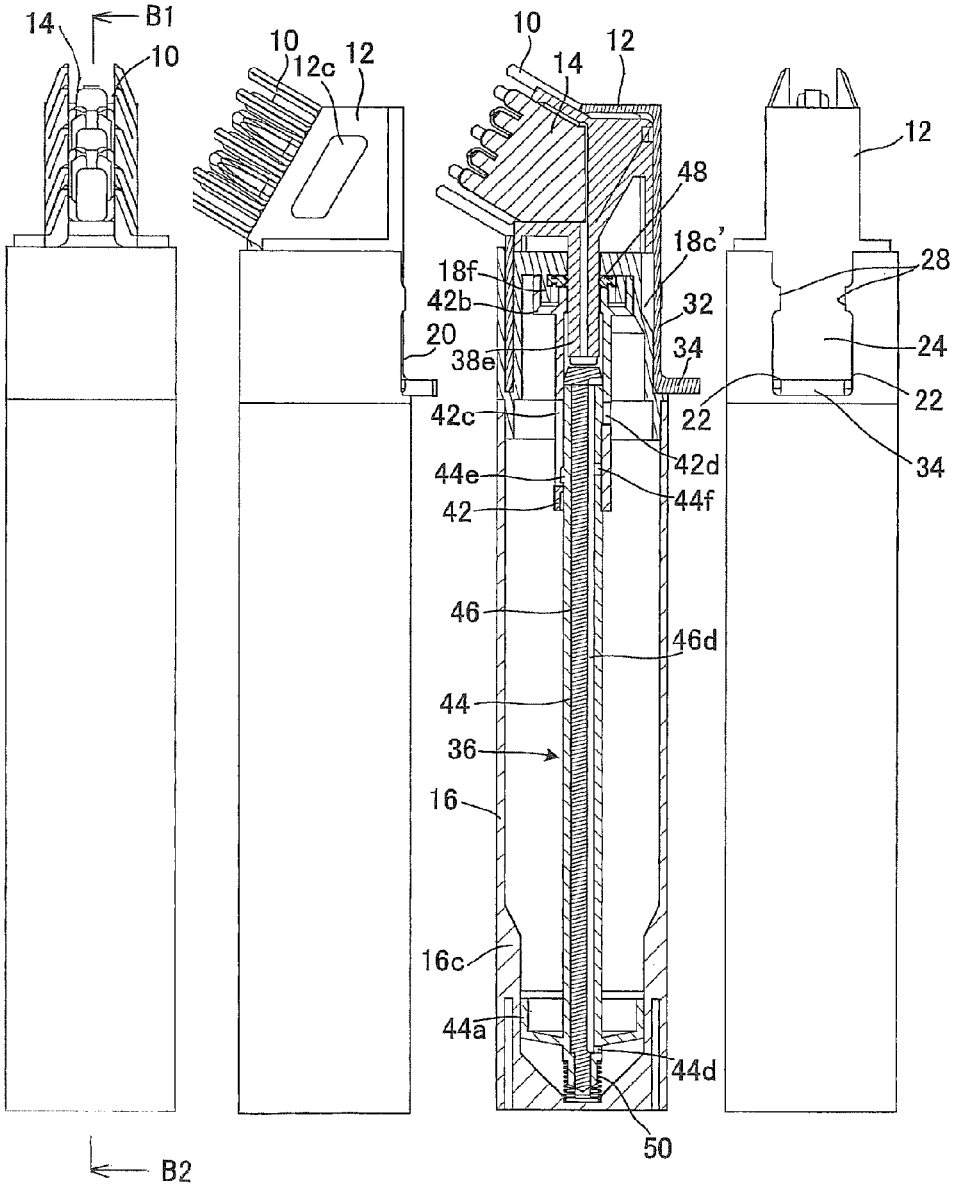
FIGS. 3A to 3D are illustrative diagrams when the same applicator is operated.
Figure 4A:
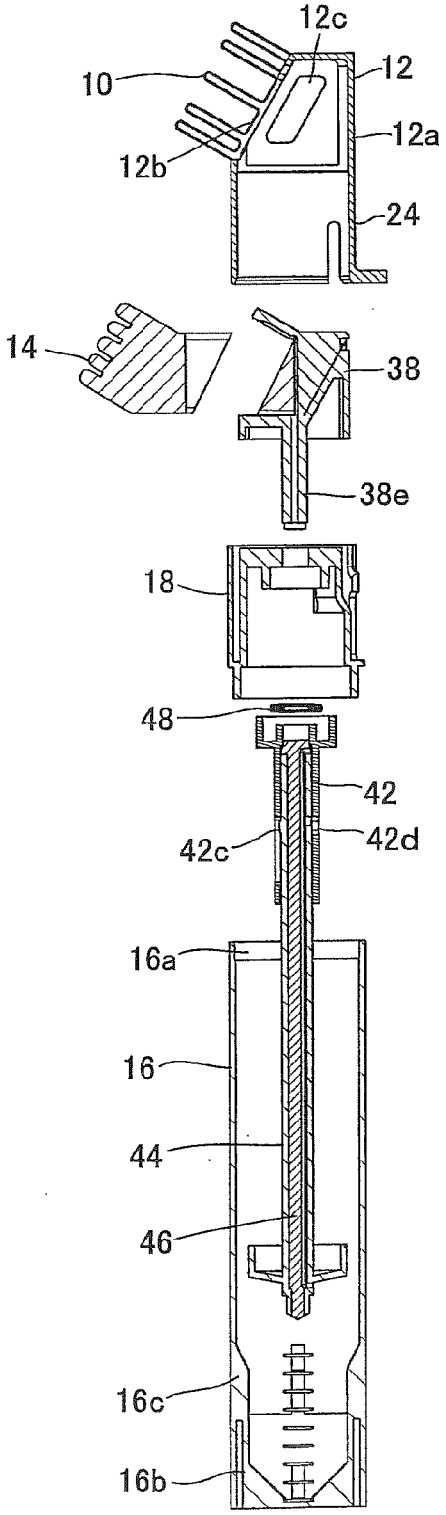
FIGS. 4A and 4B are illustrative exploded and assembly diagrams of the same applicator.
Figure 4B:
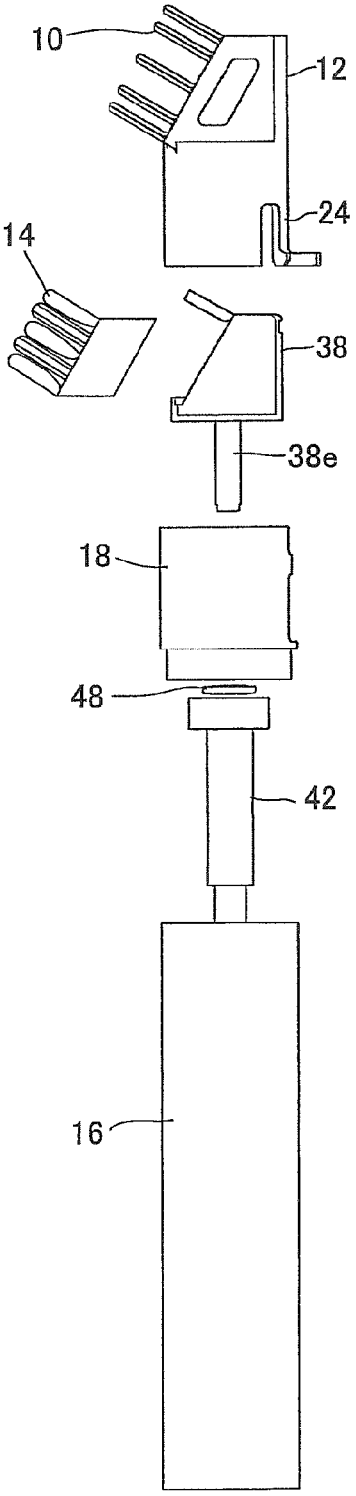
Figure 5B:
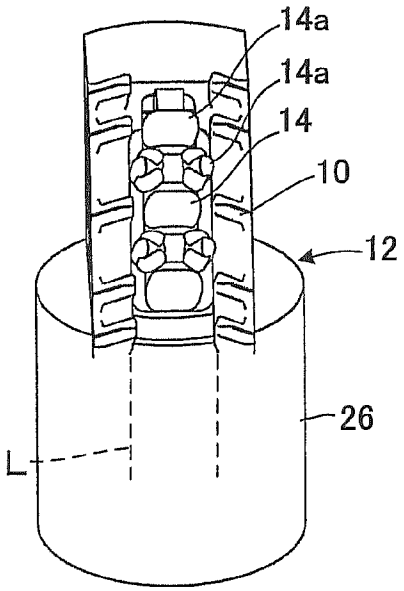
FIGS. 5A and 5B are partial assembly diagrams of a state where an applying part is attached to a comber of the same applicator.
Figure 5A:
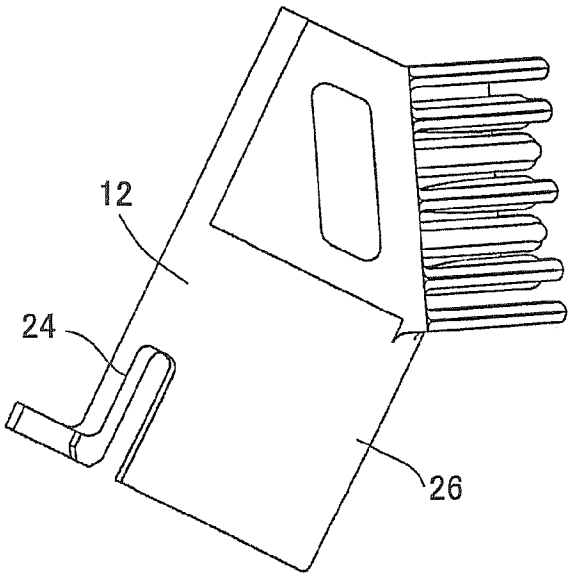
Figure 6B:
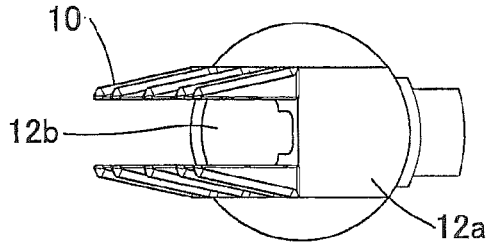
FIGS. 6A to 6G are illustrative diagrams of a comber of the same applicator.
Figure 6A:
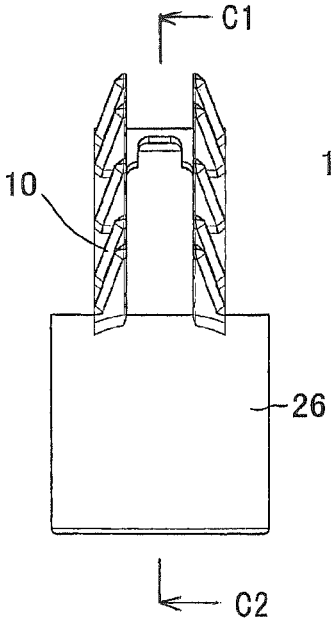
Figure 6C:
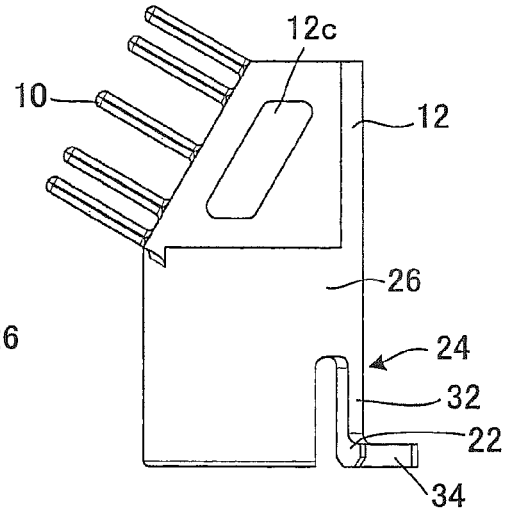
Figure 6D:
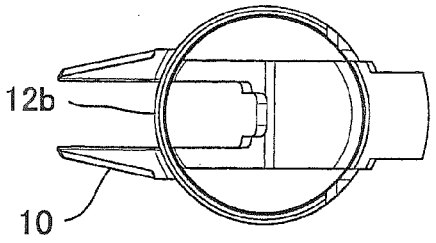
Figure 6E:
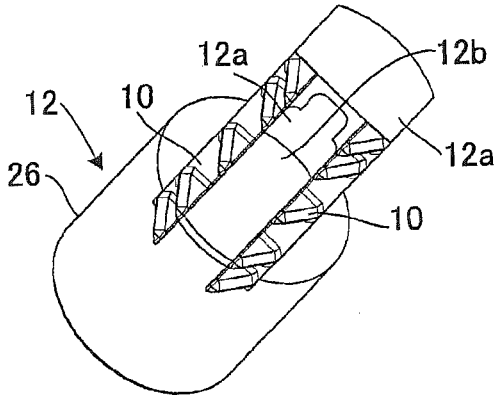
Figure 6F:
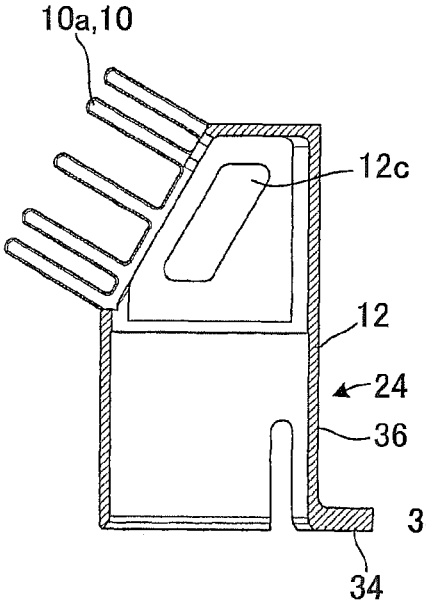
Figure 6G:
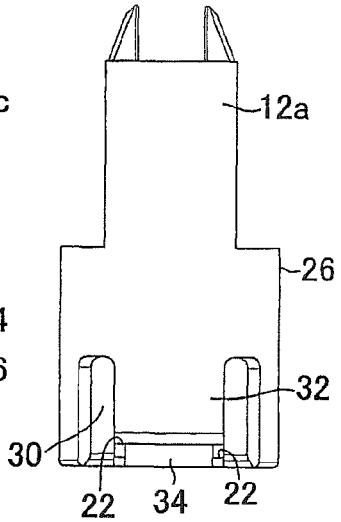
Figure 7B:
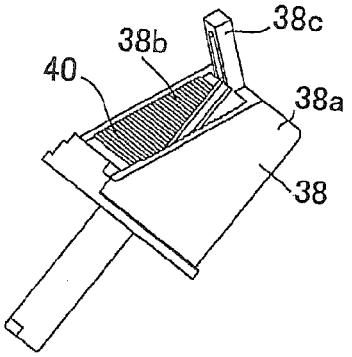
FIGS. 7A to 7J are illustrative diagrams of an application liquid feeder of the same applicator.
Figure 7D:
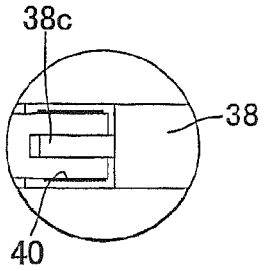
Figure 7A:
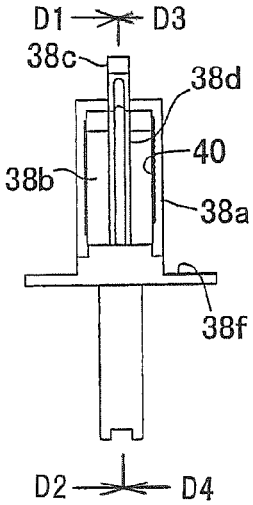
Figure 7C:
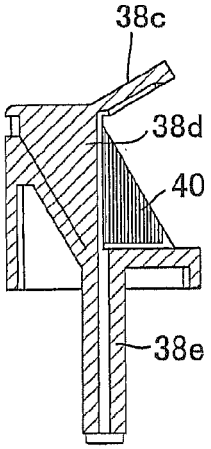
Figure 7E:
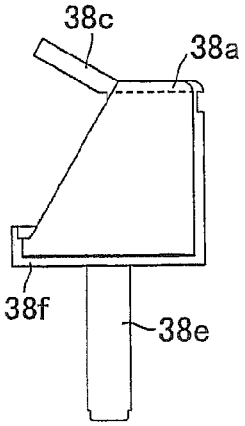
Figure 7F:
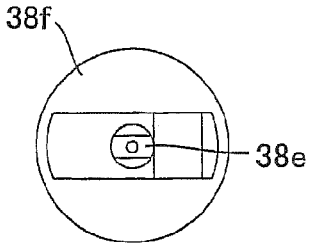
Figure 7I:
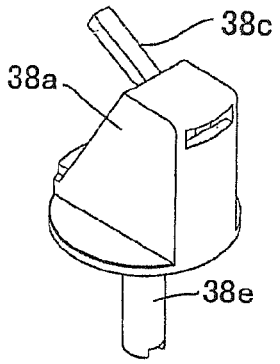
Figure 7G:
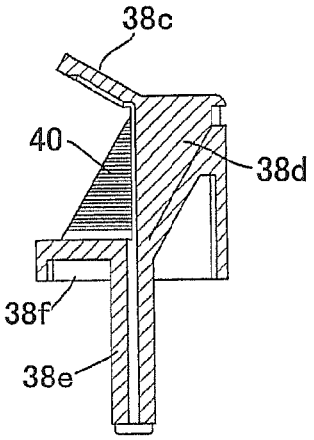
Figure 7J:
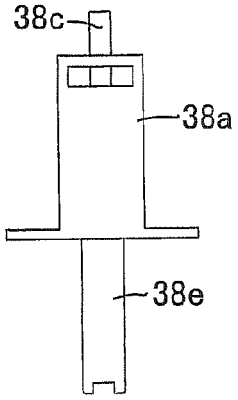
Figure 7H:
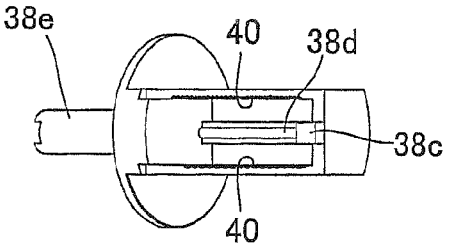
Figure 8B:
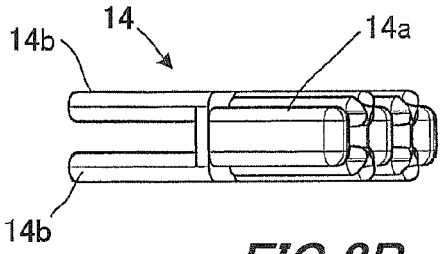
FIGS. 8A to 8F are illustrative diagrams of an applying part of the same applicator.
Figure 8A:
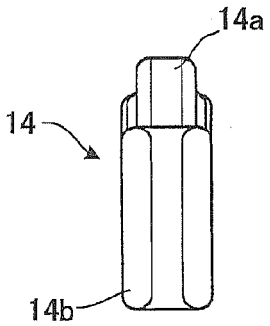
Figure 8C:
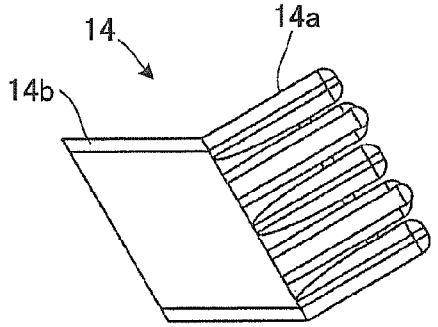
Figure 8D:
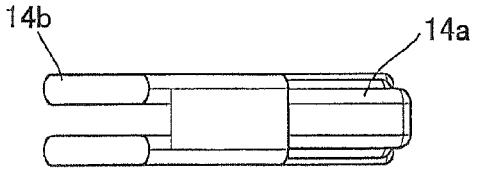
Figure 8E:
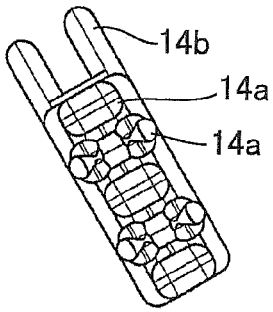
Figure 8F:
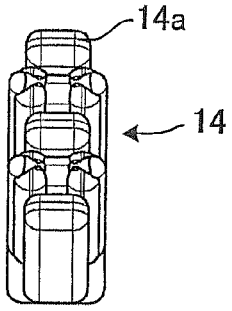
Figure 9A:
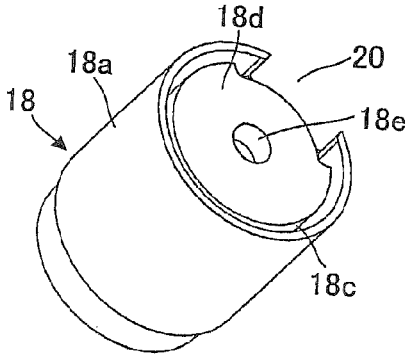
FIGS. 9A to 9I are illustrative diagrams of a front barrel of the same applicator.
Figure 9C:
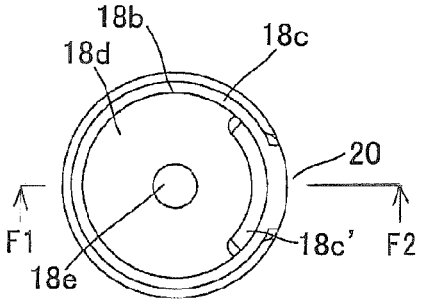
Figure 9B:
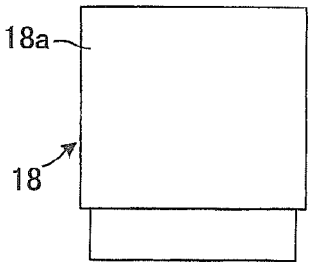
Figure 9D:
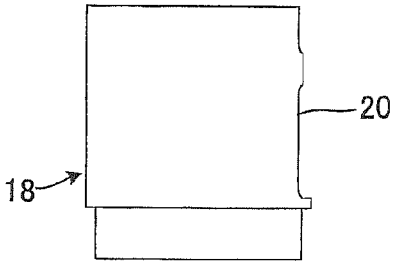
Figure 9E:
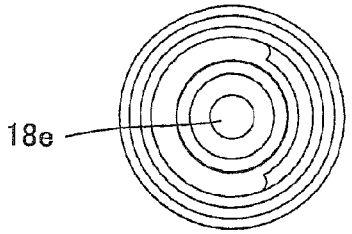
Figure 9F:
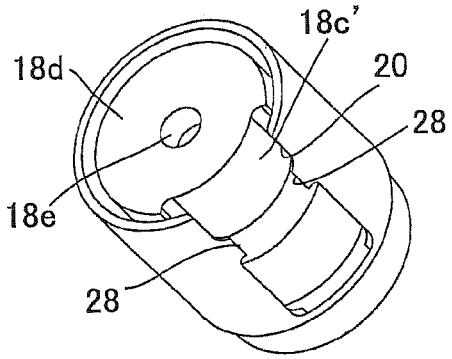
Figure 9G:
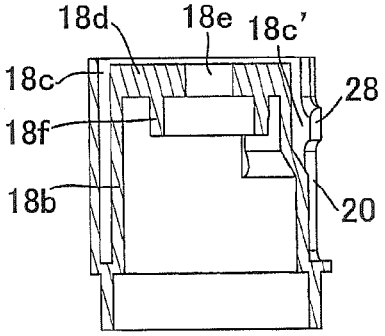
Figure 9I:
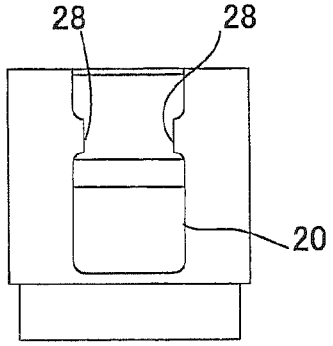
Figure 9H:
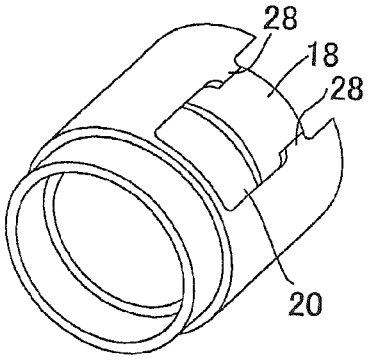
Figure 11E:
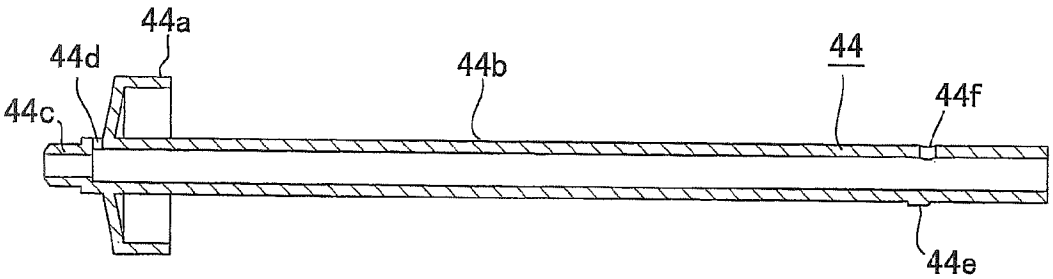
Figure 11H:
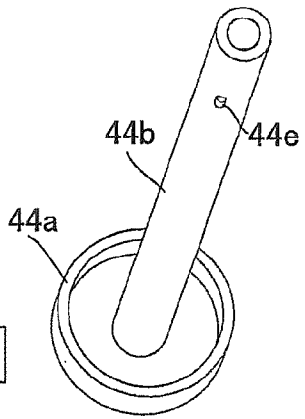
Figure 11F:
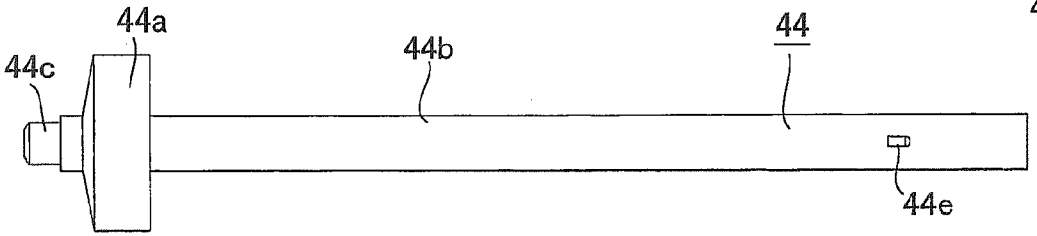
Figure 11B:
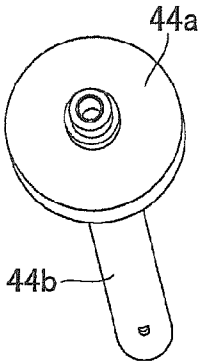
Figure 12G:
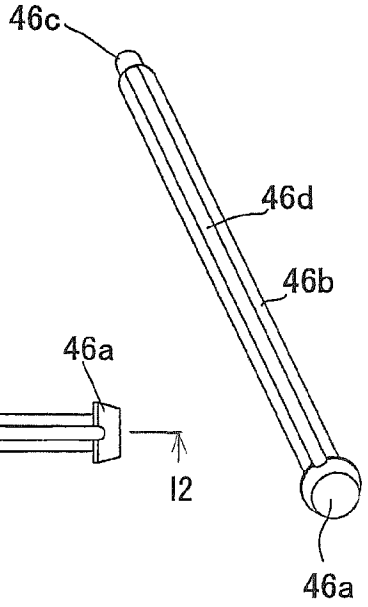
FIGS. 12A to 12H are illustrative diagrams of a valve rod of the same applicator.
Figure 12C:
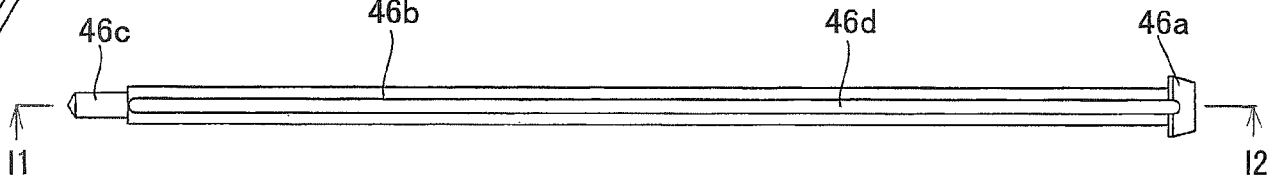
Figure 12D:
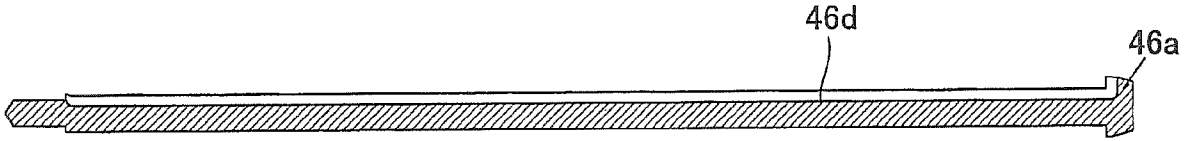
Figure 12A:
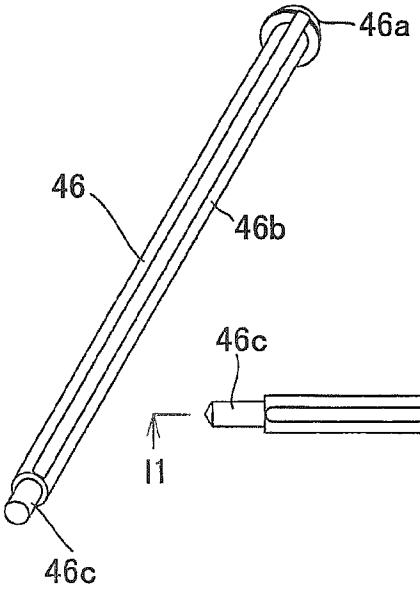
Figure 12H:
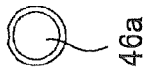
Figure 12E:
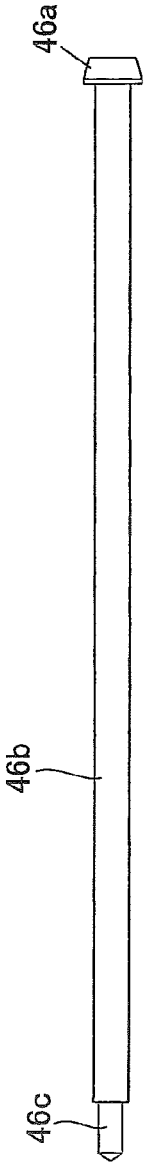
Figure 12F:
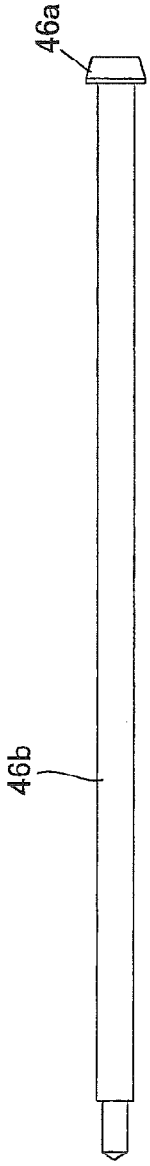
Figure 12B:
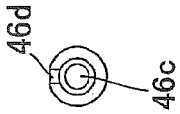
Figure 13A:
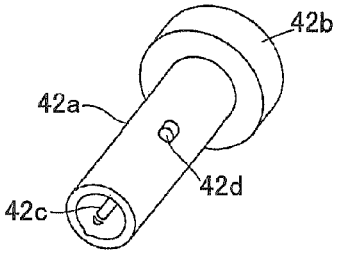
FIGS. 13A to 13J are illustrative diagrams of a valve seat body of the same applicator.
Figure 13B:
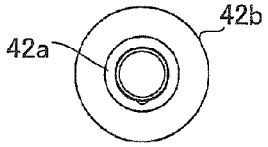
Figure 13C:
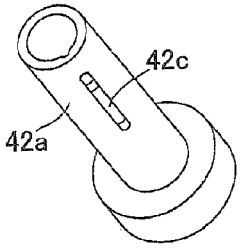
Figure 13D:
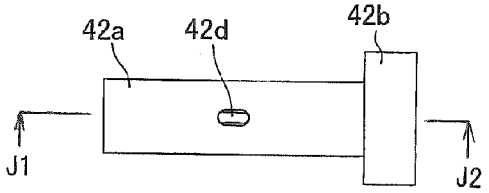
Figure 13E:
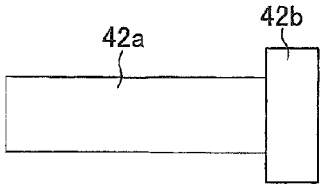
Figure 13F:
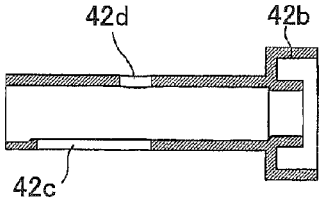
Figure 13G:
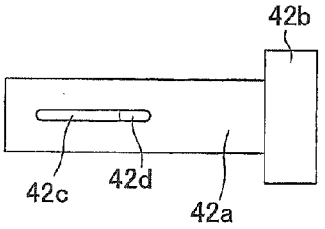
Figure 13H:
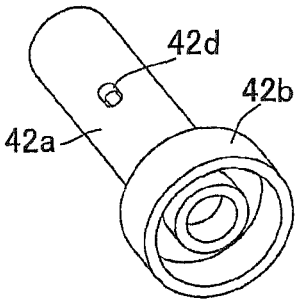
Figure 13I:
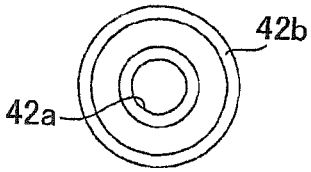
Figure 13J:
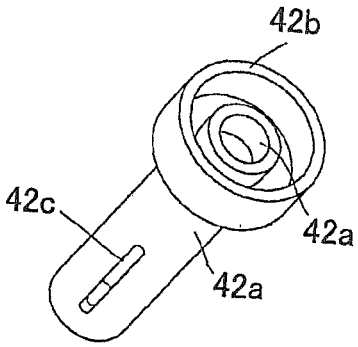

As shown in FIGS. 1 to 3, the applicator according to the embodiment is equipped with a comber 12 that has comb-toothed parts 10 with multiple comb-formed projections 10*a* projectively formed and arrayed. Arranged between comb-toothed parts 10, 10 of the comber 12 in which multiple comb-formed projections 10*a*, 10*a* . . . are arrayed is an applying part 14, which is provided in a replaceable manner. The applicator is a hair-care applicator that delivers an application liquid stored in container body 16 to the hair while combing the hair by means of this comber 12.

In the applicator, a front barrel 18 for attaching comber 12 to the front end of container body 16 has a slit portion 20 formed on the outer periphery 18*a*, opening toward the front side in the axial direction.

The comber 12 has the comb-toothed parts 10, 10 formed in front part 12*a* located on the front side with respect to the axial direction while the comber 12 has a cantilevered pressing part 24 having engaging structures 22, 22 formed at both sides with respect to the width direction, on the side surface in the rear part 26 of the comber 12.

The cylindrically formed rear part 26 of the comber 12 is attached to the front barrel 18 so as to be moveable back and forth with pressing part 24 fitted in the slit portion 20.

The engaging structures 22 of the pressing part 24 when attached to the slit portion 20 abut projected pieces 28, 28 projected inwards with respect to the width direction in the slit portion 20 so as to constrain the comber 12 from moving forwards (see FIG. 2).

When pressing part 24 is pressed toward the center of front barrel 18, the abutment between the engaging structures 22 and the projected pieces 28 is released so that comber 12 can be taken off from front barrel 18.

Further, the rear part 26 of the comber 12 has a rear-open approximately cylindrical form while the pressing part 24 has, in the rear part 26, an elastically deformable arm 32 that is defined by forming cuts 30 partially in the circumferential direction, from the rear end toward the front, forming a cantilevered configuration and engaging structures 22,22 projected radially outward at both sides with respect to the width direction in the rear end of arm 32, and a lever 34 projected radially outward (see FIG. 6).

The front barrel 18 has a wall-like outer periphery 18*a* and an inner peripheral wall portion 18*b* formed thereinside and spaced a clearance 18*c* therefrom so that the rear part 26 of the comber 12 is fitted in clearance 18*c* between outer periphery 18*a* and inner peripheral wall portion 18*b* so as to be movable back and forth while a clearance 18*c*' inside the area between projected pieces 28 of the slit portion 20 is formed with such spacing as to permit release of the engagement between engaging structures 22 and projected pieces 28 when pressing part 24 is pressed and elastically deformed (see FIG. 9).

Specifically, as to clearance 18*c* between outer periphery 18*a* and inner peripheral wall portion 18*b*, as shown in FIG. 9 a clearance 18*c*' that is depressed deeper than the other area is formed in the area of clearance 18*c* corresponding to slit portion 20 and located on the front side of projected pieces 28 (with such spacing as to relieve the engagement between engaging structures 22 and projected pieces 28), the clearance in the other area is formed substantially uniform. Since this clearance 18*c*' is formed, arm 32 of pressing part 24 elastically deforms toward the center axis when pressing part 24 is pressed toward the center axis so that engaging structures 22 come out of projected pieces 28. Other than this, arm 32 will not bend if it is pressed forward or rearward, hence engaging structures 22 will not come off projected pieces 28 (see FIG. 2).

The pressing part 24 is further formed with lever 34 or a pusher that extends radially outward from the rear end of the arm 32 and is narrower than the distance between projected pieces 28 and 28 of the slit portion 20. The rear end of the arm 32 is bent radially outward so that lever 34 rises, and engaging structures 22 are formed at both sides at the bottom of the rise. The width of lever 34 is made narrower stepwise at a position radially outward from engaging structures 22 so that lever 34 leaves projected pieces 28, 28 (see FIGS. 2 and 6).

As shown in FIG. 9, the front barrel 18 has a front part 18*d* forming a lid-like enclosure continuous from inner peripheral wall portion 18*b*. Formed in the axial center of the lid-like front part 18*d* is an insert hole 18*e*, through which a pipe portion 38*e* of an aftermentioned application liquid feeder 38 is inserted so as to be movable back and forth. Further, a valve seat insert 18*f* to which the front part of a valve seat body 42 that is cylindrically projected and formed so as to enclose insert hole 18*e* is formed on the rear side of lid-like front part 18*d*.

As shown in FIG. 2, container body 16 is equipped with a pumping mechanism 36 that supplies the application liquid in container body 16 to applying part 14 of comber 12 when comber 12 is moved rearwards relative to front barrel 18 and container body 16 by moving lever 34 of the pressing part 24 rearward in the axial direction.

[Comber 12]

As shown in FIGS. 1 to 6, comber 12 has an approximately box-like configuration having an opening 12*b* with comb-toothed parts 10 arranged at both sides thereof in front part 12*a*. The brim of opening 12*b* is formed to be inclined, in sectional view, in such a manner as to become closer to the axial center at the front side with respect to the axial direction of the opening. Comb-forming projections 10*a* of comb-toothed parts 10 are projected from opening 12*c* and formed obliquely upward. The approximately box-like front part 12*a* is hollow inside, and the rear portion of front part 12*a* is connected to a rear part 26 shaped in a skirt-like tubular form. The hollow inside is continuous.

The comb-toothed parts 10 arranged around opening 12*b* that is formed by obliquely cutting off front part 12*a* are formed of multiple (five in the first embodiment) thin strip-like (bar-like) comb-formed projections 10*a* extending obliquely with respect to the axial direction and arrayed on the left and right sides.

Front part 12*a* of comber 12 has a viewing window 12*c* formed on the flank for permitting a view of the condition of applying part 14. The aforementioned pressing part 24 is formed in rear part 26 of comber 12.

Comber 12 may be formed of any material as long as it is resinous and can achieve the function as comber 12. Preferably, use of a resin material excellent in water-repellence and cleansability, such as PP (polypropylene) and the like is desired.

[Applying Part 14]

As shown in FIGS. 1 to 5, applying part 14 is fitted in the interior of comber 12 with its tips exposed between comb-toothed parts 10 and 10. Applying part 14 is configured such that a plurality of thick plate-like or column-like projections 14*a*, 14*a*, . . . obliquely projecting relative to the axial direction are formed at intervals. The multiple projections 14*a*, 14*a*, . . . are formed approximately as high as, or lower than, the multiple comb-formed projections 10*a*, 10*a* of the comber 12. Also, the multiple projections 14*a*, 14*a*, . . . (corresponding to "multiple applying parts") are formed to vary alternately in size or height.

The lower part of applying part 14 is extended and formed with spaced plate-like shapes. Rear sections 14*b*, 14*b* of applying part 14 are given in parallel plate-like shapes spaced to each other and inserted into the aftermentioned application liquid feeder 38 and fixed thereto (see FIG. 8).

Comb-formed projections 10*a* of the comb-toothed parts 10 and projections 14*a* . . . of applying part 14 are arranged apart from each other. Further, as shown in FIG. 5, these are arranged so that the outer peripheral sides of part of projections 14*a* . . . of applying part 14 among multiple applying parts (projections 14*a* . . . ) approximately abut the virtual lines L, which are defined by joining the inner end faces of comb-formed projections 10*a* . . . of the comb-toothed part 10. In the case of FIG. 5, the second and fourth projections 14*a*, 14*a* from the top correspond to these. Other variational configurations of comber 12 and applying part 14 will be described later in the second and third embodiments.

As the material of applying part 14, various kinds of liquid absorbers such as brushes, porous material, continuous foam materials, compacts of non-woven fabric, or any material that can appropriately suck up the application liquid can be used.

Applying part 14 is preferably formed of sintered plastics.

[Application Liquid Feeder 38]

Applying part 14 is fitted in the application liquid feeder 38 and exposed from the opening of the comber 12. Detailedly shown in FIG. 7, the application liquid feeder 38 is constructed such that a main part 38*a* has an interior space for receiving applying part 14 through an opening 38*b* while indicator portions (application liquid feed indicator) 40 are formed on the inner surface of both side walls from the opening 38*b*. An indicator portion 40 changes transparent and opaque areas of light as the application liquid of applying part 14 touches the indicator, whereby the presence or absence of the application liquid can be visually known from that change through a hole or a viewing window 12*c*.

Further, the opening 38*b* is obliquely formed corresponding to an opening 12*b* of the comber 12. An arm piece 38*c* that holds the top of applying part 14 is extended radially outwards and obliquely frontwards, from the opening 38*b* in the front part of a main body 38*a*. Formed in the space inside the opening 38*b* is a gutter structure 38*d* that has a wall-like partition dividing the space into left and right sections and forms an application liquid leading groove on the mounted side of applying part 14. The rear sections 14*b*, 14*b* of applying part 14 are inserted into, and fixed to, application liquid feeder 38 so as to sandwich the gutter structure 38*d*.

Extended rearwards from the rear part of main body 38*a* of the application liquid feeder 38 is a hollow pipe portion 38*e*. The application liquid leading groove is formed from the arm piece 38*c* to the opening 12*b* side of gutter structure 38*d*. This application liquid leading groove joins to the hollow application liquid feeding bore of pipe portion 38*e* so that the application liquid can readily flow. The application liquid leading groove of the gutter structure 38*d* is formed near the central axis of the aforementioned space while the application liquid feeding bore is formed passing through the pipe portion 38*e* and flush with the interior side of the application liquid leading groove. A circular flange 38*f* is formed in the rear of main body 38*a* so as to surround the pipe portion 38*e*.

[Indicator Portion 40]

In the embodiment, as shown in FIG. 7 the indicator portion 40 is constructed such that an indicator structure having a jagged configuration that varies in reflectance of light depending on the presence and absence of the application liquid is formed on the inner wall on the applying part 14 side and the formed area of the indicator structure can be viewed from the outside.

The structure for making the presence and absence of the application liquid in indicator portion 40 is realized by forming the injection-molding resin material of the whole of application liquid feeder 38 or in the vicinity of the indicator portion 40, with a transparent or translucent resin.

The structure on the comber 12 side for making the indicator portion 40 visible is provided by forming a hole as the aforementioned viewing window 12*c* around the position corresponding to indicator portion 40. Of course, this viewing window 12*c* may be formed of a transparent or translucent material to permit visual observation.

The structure and principle of indicator portion 40 will be described based on FIG. 14.

Reflection of light in indicator portion 40 will be explained. When light propagates from a high-refraction medium to a low-refraction medium, incident light at an angle equal to or greater than the critical angle is totally reflected. The critical angle of the tilted surface of the indicator portion is formed based on Snell's law.

For the reflection other than the total reflection range, the reflectance is determined from the Fresnel equations, and the reflectance for p-polarized light and the reflectance for s-polarized light are summed to calculate the mean reflectance. Here, it is assumed that the absorption of light during propagation through the medium is null.

Figure 14:
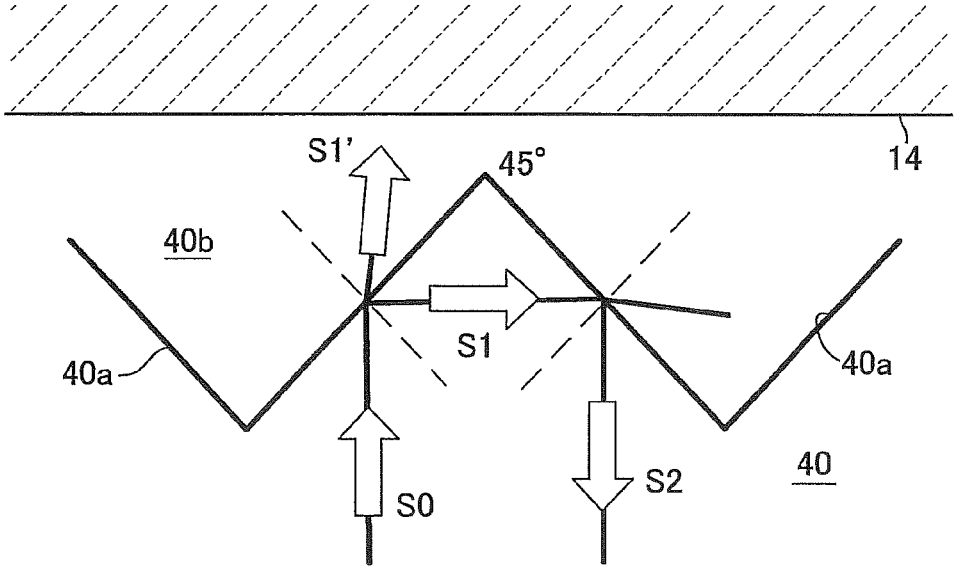
FIG. 14 is a sectional diagram for illustrating the function of an indicator portion formed in the application liquid feeder.

As shown in FIG. 14, indicator portion 40 is formed with a large number of grooves 40*b* of V-shaped section, defined with inclined planes 40*a*, 40*a* that are tilted 45 degrees (the open angle of groove 40*b* is 90 degrees). When the grooves 40*b* are not filled with the application liquid, the air exists. The index of refraction of the air, n is equal to 1. On the other hand, it is assumed that the application liquid of the embodiment has a refractive index, n=1.36 and the refractive index of the injection-molding of indicator portion 40 is n=1.48 when PP is presumed to be used. Since the application liquid to be stored in the applicator product is selectable, in order to make it easy to check the presence or absence of the application liquid in indicator portion 40, it is preferable that the material of the injection molding of indicator portion 40 and the tilt angle of the inclined plane should be selected and set so as to make it easy to view the application liquid in consideration of the refractive index of the application liquid.

When applying part 14 does not hold an excessive amount of the application liquid, no application liquid exists in grooves 40*b*, so that the critical angle for the incidence of light from the injection molding product with a refractive index n=1.48 to the air with an refractive index n=1 is 42.5 degrees. Accordingly, the incident light S0 of the external light incident on inclined planes 40*a*, 40*a* at the incident angle of 45 degrees is totally reflected (reflective light S1). Similarly, the reflective light S1 is incident on the other inclined plane 40*a* and totally reflected (reflective light S2). As a result, this state is observed as being light by human eyes.

On the other hand, when the application liquid exists in applying part 14, the application liquid exists and wets grooves 40*b*, so that the critical angle for the incidence of light from the molding product with a refractive index n=1.48 to the application liquid with an refractive index n=1.36 is 64 degrees. Accordingly, the incident light S0 (the incident angle 45 degrees) of the external light incident on inclined planes 40*a*, 40*a* almost transmits to the applying part 14 side (transmitted light S1') (the mean reflectance: 0.4%) because the incident angle is smaller than the critical angle. As a result, this state is observed as being dark by human eyes.

In the embodiment, indicator portion 40 is given in a planar configuration with a large number of grooves 40*b* formed thereon. Accordingly, when the area with no application liquid and the area with the application liquid in applying part 14 are observed, in the area where no application liquid exists in grooves 40*b*, the external light is reflected by inclined planes 40*a*, 40*a* with the air, presenting a light tone. In contrast, in the area where the application liquid exists in grooves 40*b*, incident light S0 transmits through inclined planes 40*a*, 40*a* and the application liquid with no light reflected, presenting a dark tone.

Accordingly, when the application is about being used up, or when the application liquid partially exists in the applying part, the user can visually check the size of the light area where the external light is reflected in indicator portion 40 so as to visually confirm the residual quantity of the application liquid, which is remarkably easy to use.

Here, the direction in which grooves 40*b* are formed may be either along the axial direction or perpendicular to the axis.

It is preferable that grooves 40*b* of indicator portion 40 are precisely specified as to groove width and depth, taking into consideration the capillary force (capillarity) to the application liquid. Further, since the reflectance is affected by the application liquid and the composition of indicator portion 40, not limited to the above-descried grooves 40*b* (having an open angle of 90 degrees) the depth, angle and other dimensions of the grooves, the application liquid and the composition (resin, the quality of glass and the like) of indicator portion 40 can be of course taken into consideration to specify.

In view of water-repellence of the application liquid, it is preferable that the material of (application liquid feeder 38 including) indicator portion 40 is formed of a resin such as polypropylene or the like, or various kinds of water-repellent processes are implemented under consideration of water-repellence.

The jagged configuration of indicator portion 40 should not be limited to the grooves formed with inclined planes. For example, dots may be used depending on the utility, processing convenience and design.

Further, indicator portion 40 is more responsive when the jagged surface is more or less spaced from the applying part as a whole, forming a proximal state so as to allow easy release of air by securing connection with the external air at both ends, than when the applying part (liquid absorber) is put in close contact with the jagged surface. When a system for making an "appropriate" supply of the application liquid by providing a pumping mechanism 36 or the like such a valve, squeezing piston, etc., is adopted, it is possible to achieve the function of confirming the residual quantity if the applying part or a sliver having the function of preventing excessive filling is put in proximity.

Now, a variational example 1 will be described in which grooves 40*b* of the above indicator portion 40 are modified.

Figure 15:
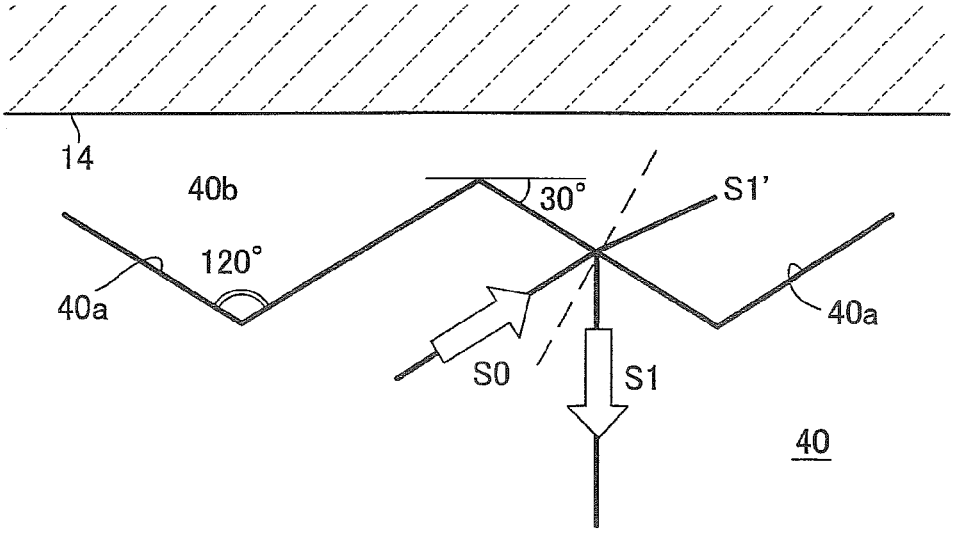
FIG. 15 is a sectional diagram for illustrating the function of a variational example 1 of the indicator portion.

As shown in FIG. 15, variational example 1 presents a configuration in which the angles of inclined planes 40*a*, 40*a* are 30 degrees (the open angle of groove 40*b* is 120 degrees). In this variational example 1, when no application liquid exists inside groove 40*b*, transmitted light S1' exists in some degree for incident light S0 on the inclined plane, but reflected light S1 (the mean reflectance of 5.1%) also exists so that this is enough for visual observation to recognize though the level is low compared to the embodiment. The other aspects are the same as in the above embodiment.

A variational example 2 of groove 40*b* of the above indicator portion 40 will be described.

Figure 16:
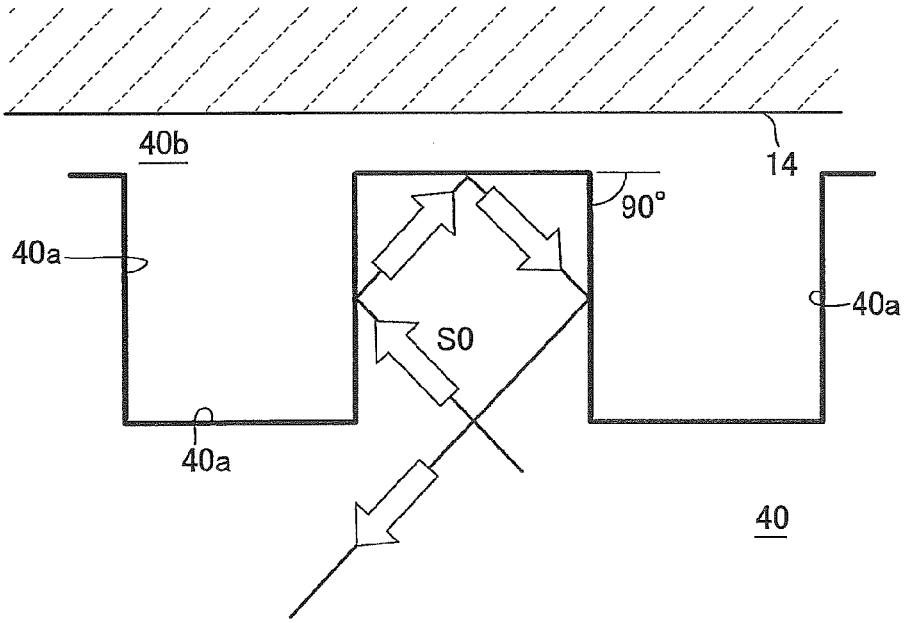
FIG. 16 is a sectional view for illustrating the function of a variational example 2 of the indicator portion.
Figure 17B:
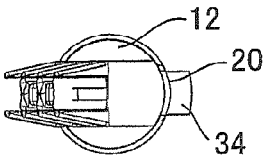
FIGS. 17A to 17F are overall illustrative diagrams of an applicator according to the second embodiment of the present invention.
Figures 17A, 17C, 17D:
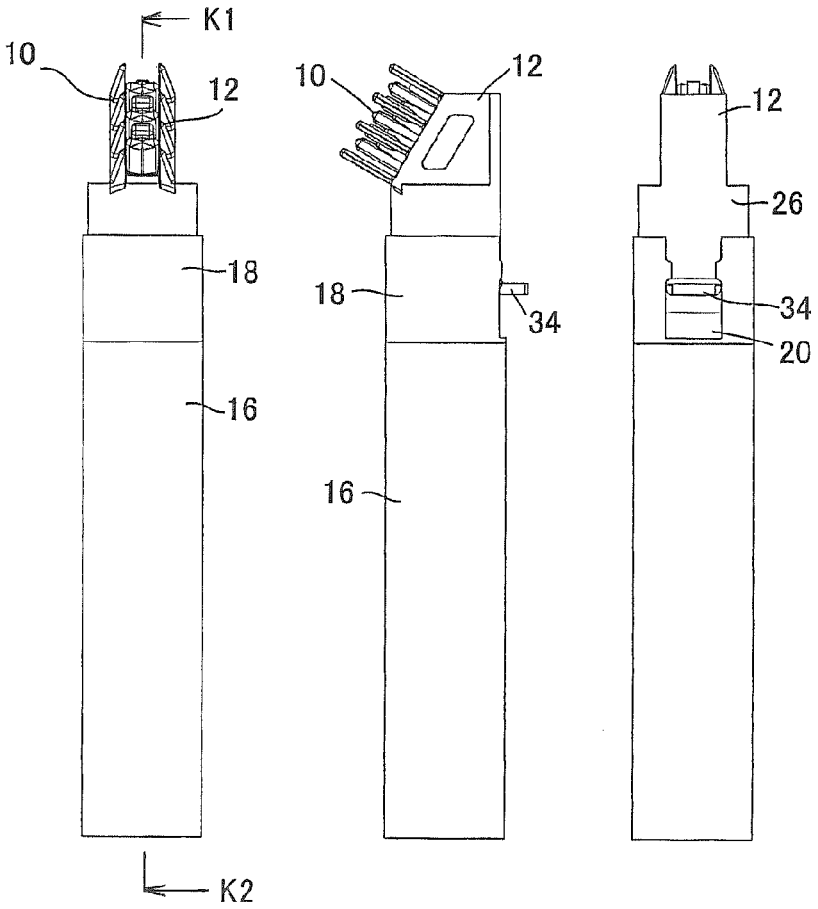
Figure 17E:
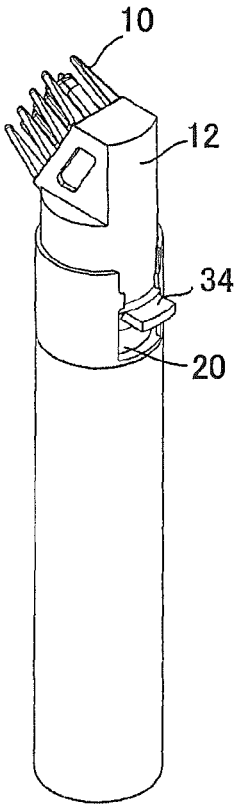
Figure 17F:
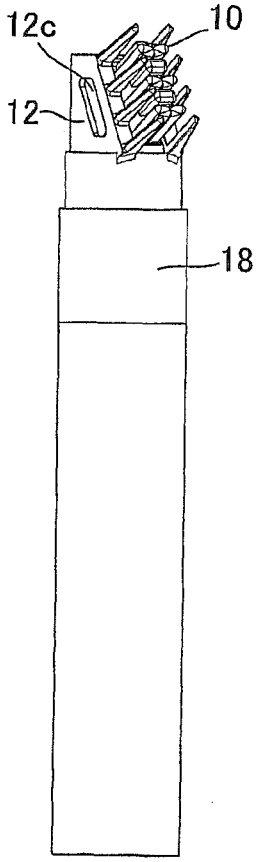
Figure 18C:
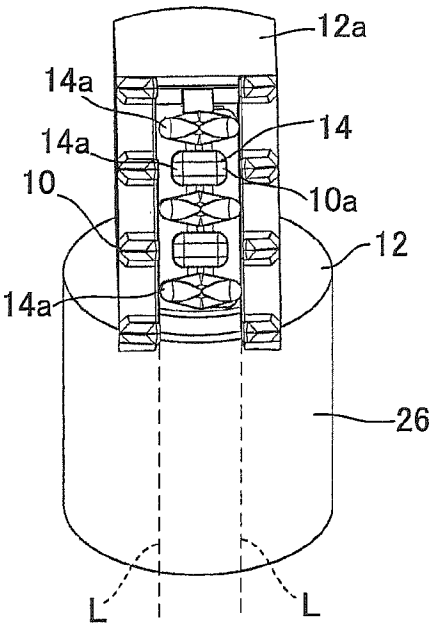
FIGS. 18A to 18C are illustrative diagrams of an applying part and a comber of the same applicator.
Figure 18B:
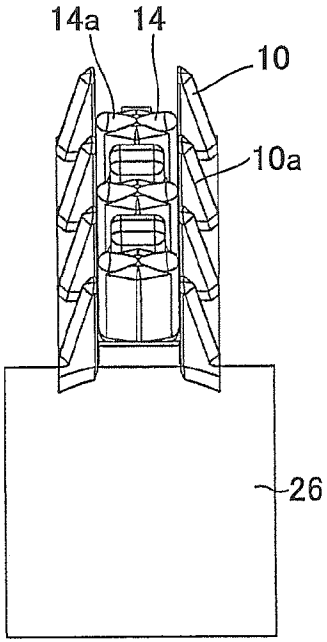
Figure 18A:
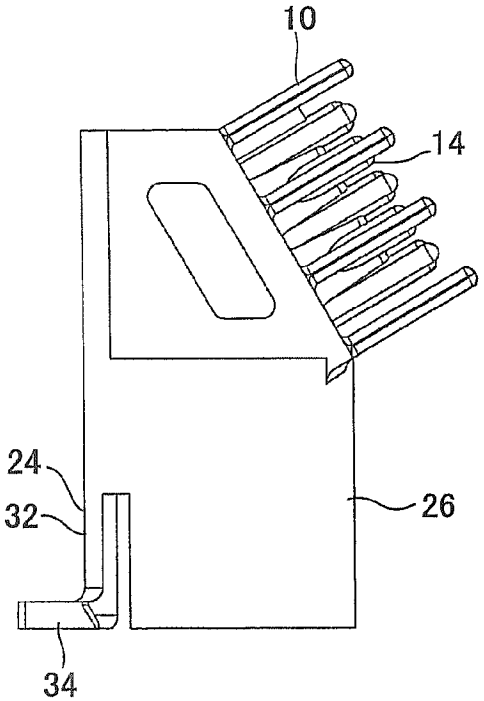
Figure 19A:
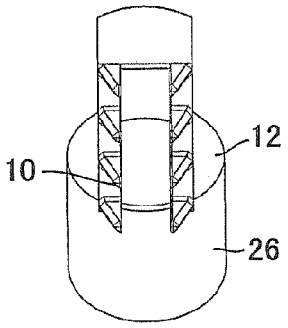
FIGS. 19A to 19H are illustrative diagrams of a comber of the same applicator.
Figure 19C:
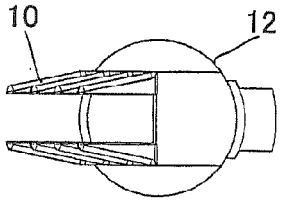
Figure 19B:
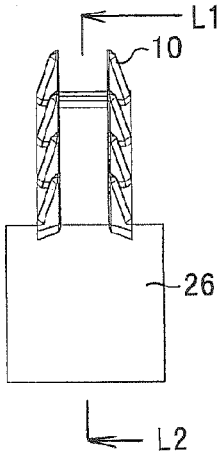
Figure 19D:
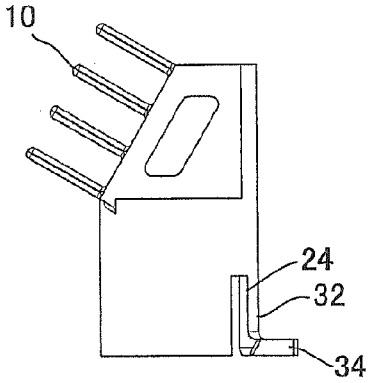
Figure 19E:
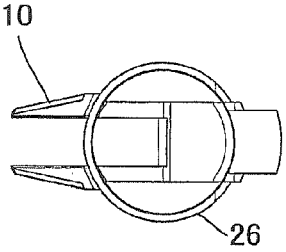
Figure 19F:
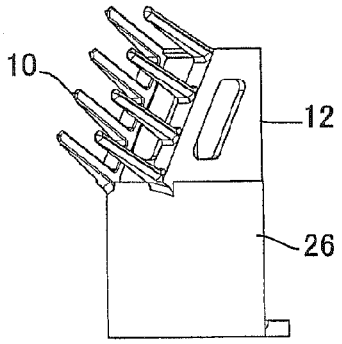
Figure 19G:
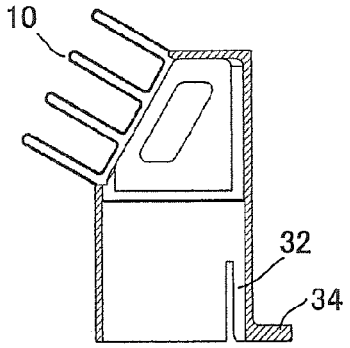
Figure 19H:
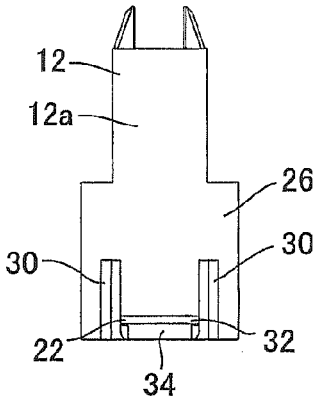
Figure 20A:
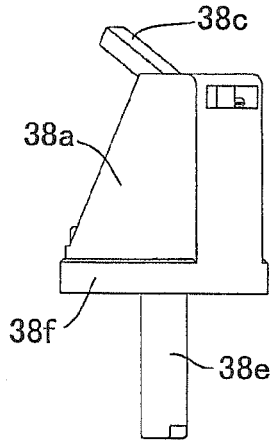
FIGS. 20A to 20H are illustrative diagrams of an application liquid feeder of the same applicator.
Figure 20C:
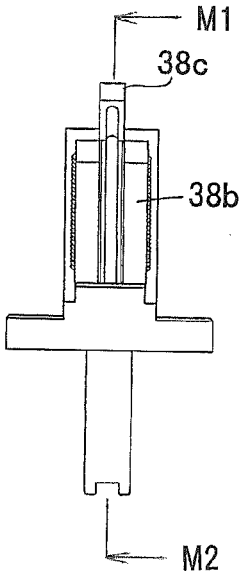
Figure 20B:
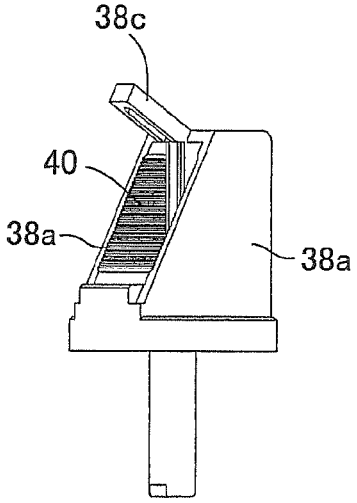
Figure 20D:
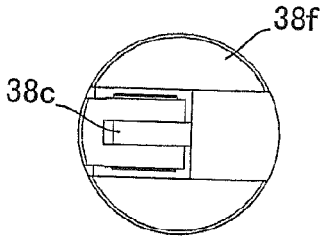
Figure 20E:
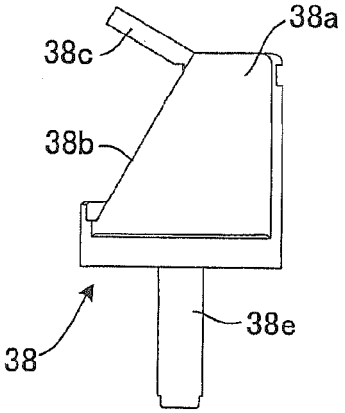
Figure 20G:
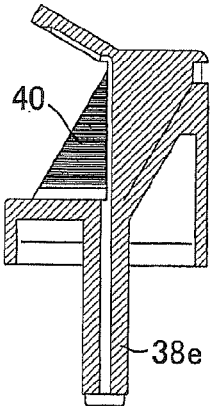
Figure 20H:
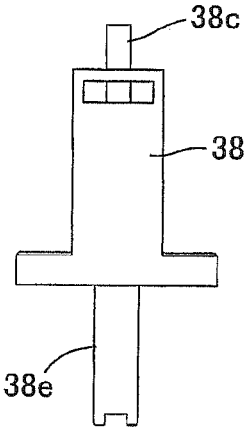
Figure 20F:
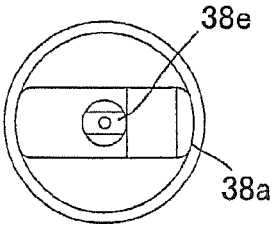
Figure 21B:
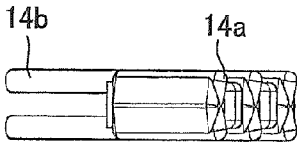
FIGS. 21A to 21F are illustrative diagrams of an applying part of the same applicator.
Figure 21E:
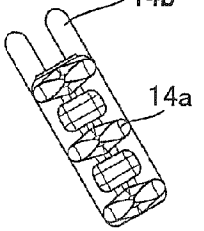
Figure 21F:
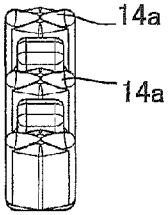
Figure 21C:
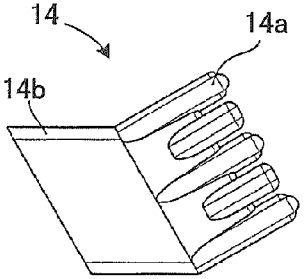
Figure 21A:
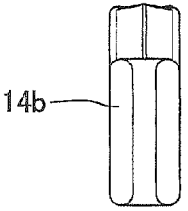
Figure 21D:
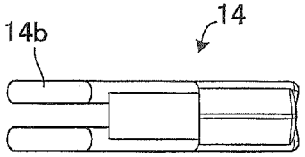
Figure 22A:
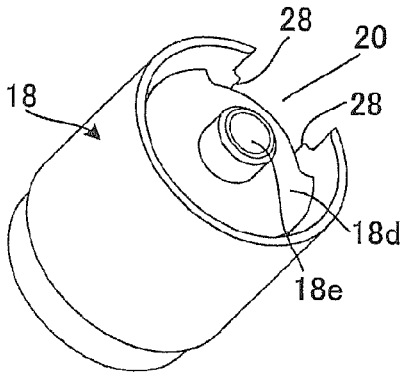
FIGS. 22A to 22H are illustrative diagrams of a front barrel of the same applicator.
Figure 22C:
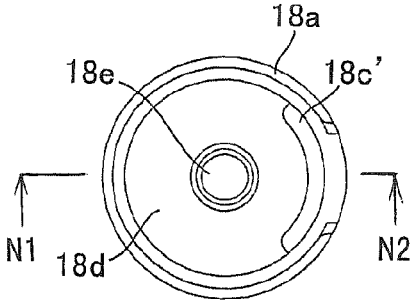
Figure 22B:
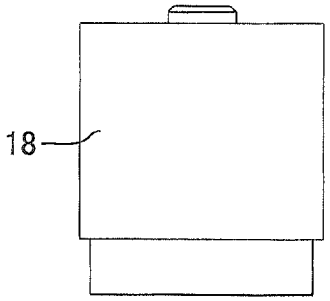
Figure 22D:
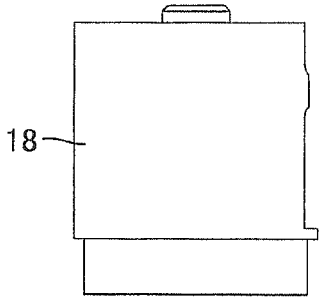
Figure 22E:
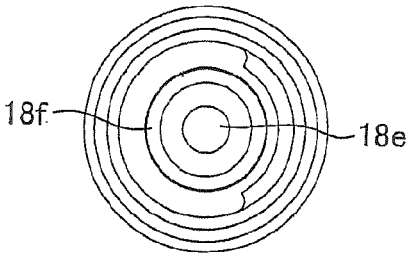
Figure 22F:
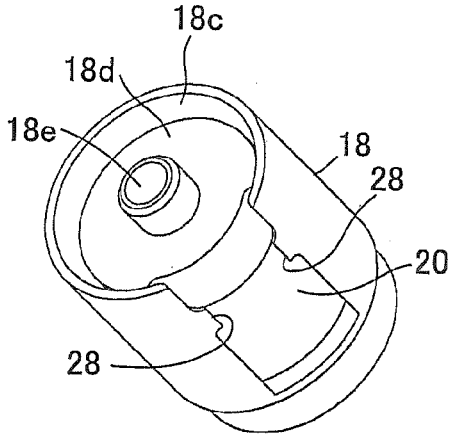
Figure 22G:
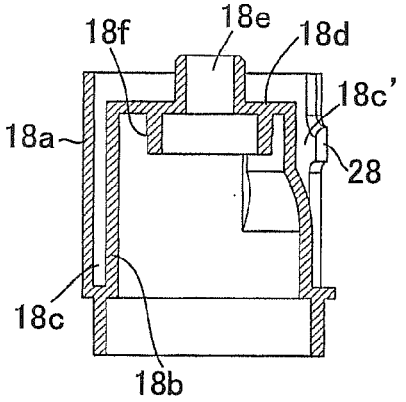
Figure 22H:
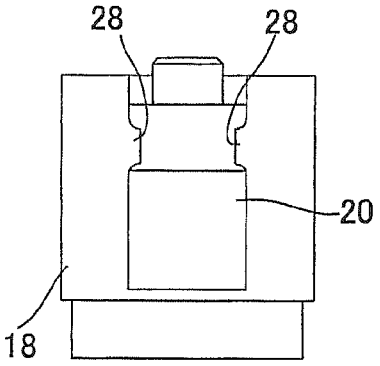
Figure 23B:
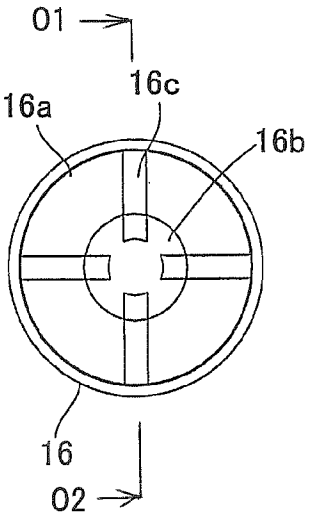
FIGS. 23A and 23B are illustrative diagrams of a container body of the same applicator.
Figure 23A:
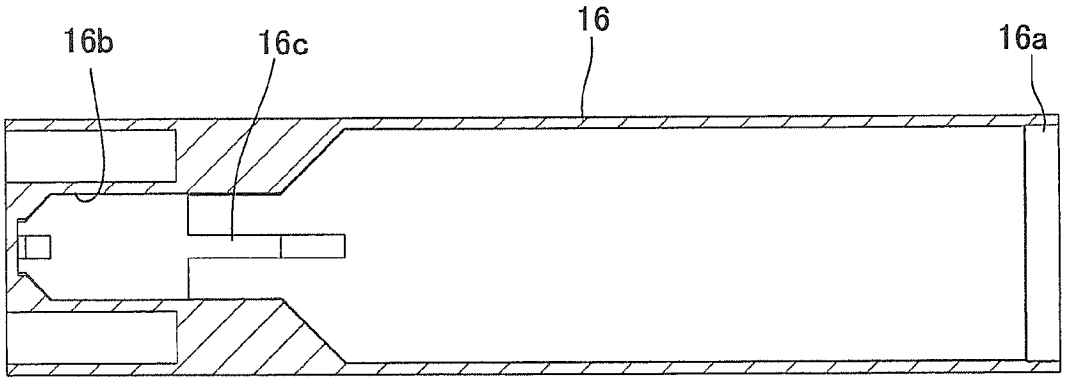
Figure 24B:
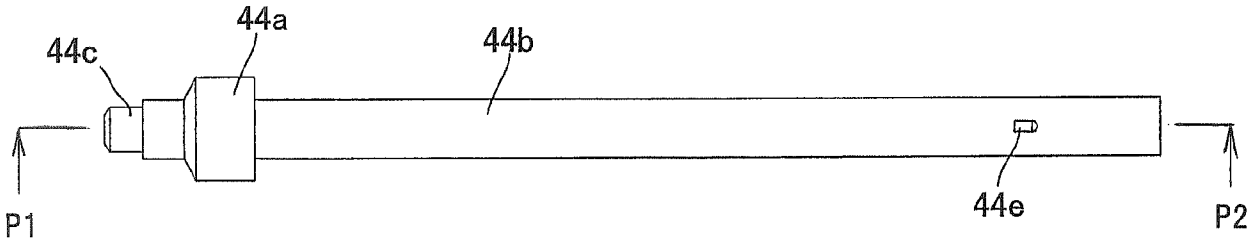
FIGS. 24A to 24F are illustrative diagrams of a piston body of the same applicator.
Figure 24C:
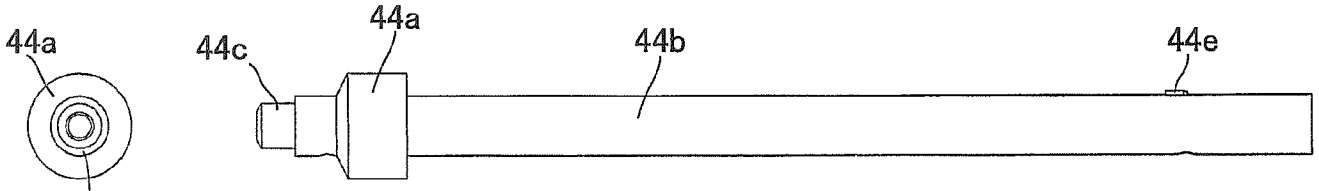
Figure 24F:
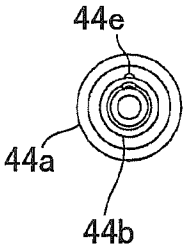
Figure 24A:
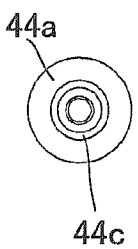
Figure 24D:
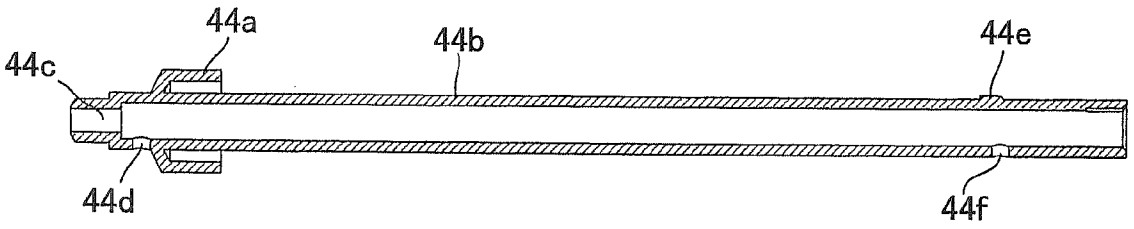
Figure 24E:
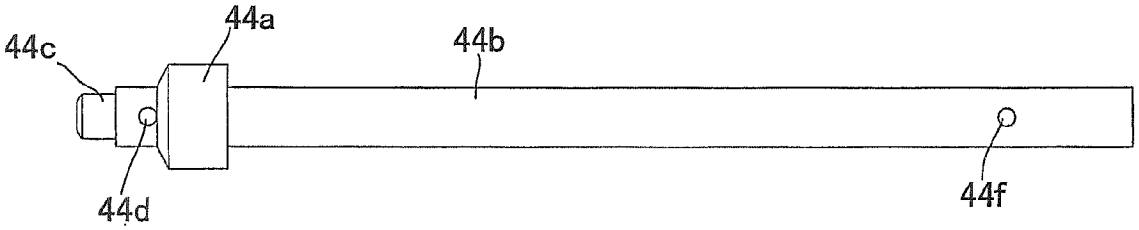
Figure 25G:
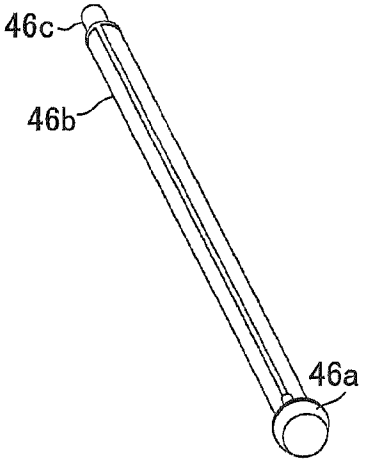
FIGS. 25A to 25H are illustrative diagrams of a valve rod of the same applicator.
Figure 25C:
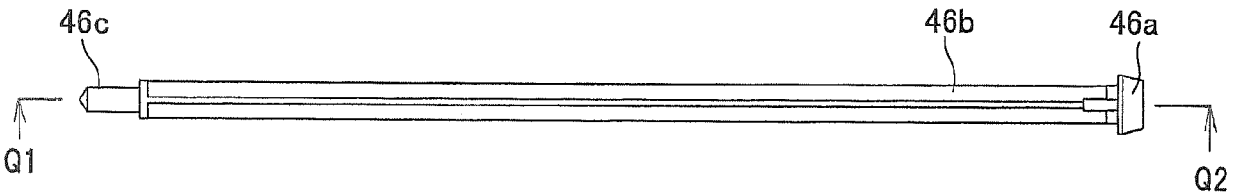
Figure 25A:
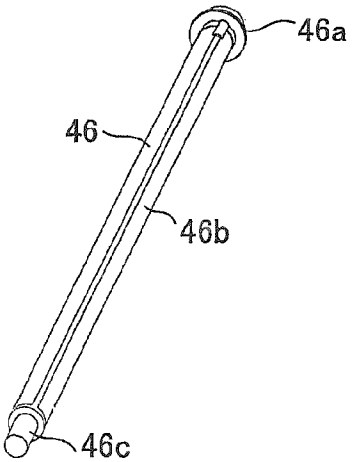
Figure 25H:
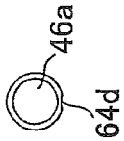
Figure 25D:
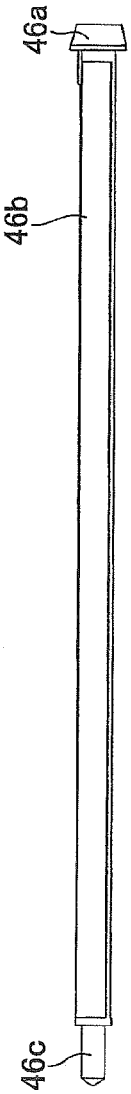
Figure 25E:
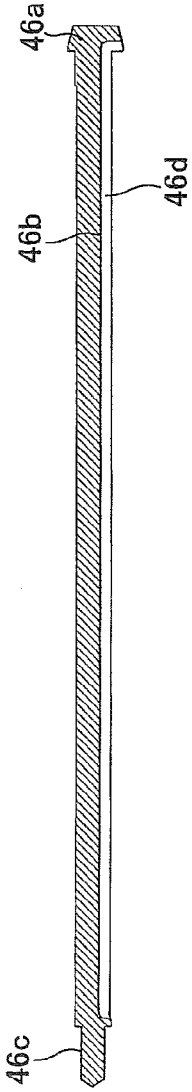
Figure 25F:
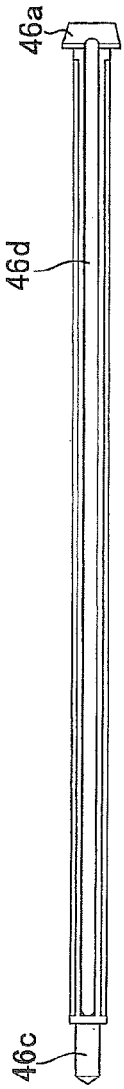
Figure 25B:
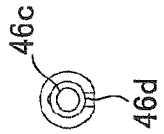

Variational example 2 presents a jagged configuration (square-toothed sectional configuration) in which inclined planes 40*a*, 40*a* . . . of grooves 40*b* have no inclinations, as shown in FIG. 16. When viewed from the front, no effect of reflection cannot be obtained. However, the liquid is retained thanks to capillarity, it becomes possible to visually observe the residual quantity as with the liquid absorber in a simulating manner using the free liquid. Further, when viewed slantly at a 45-degree angle, the effect of reflection can be obtained, hence this configuration may become markedly available depending on the geometry. The above is one example that does need no inclination.

As a still another variational example, provision of indicator portion 40 for a liquid absorber arranged in the container body enables visual observation to check decrease of the application liquid.

[Container Body 16]

As shown in FIG. 10, in container body 16, a front opening 16*a* is undercut, and the rear part of front barrel 18 is fitted snugly into front opening 16*a*. Of course, screw coupling may be used.

Container body 16 has an approximately cylindrical configuration with its rear end closed while a reduced-diametric portion 16*b* with which a piston part 44*a* of a piston body 44 comes into sliding contact, is formed inside the rear part thereof. A plurality of ribs 16*c* . . . are formed forward continuously from reduced-diametric portion 16*b*. When this reduced-diametric portion 16*b* is in contact with piston part 44*a*, liquid-tight can be established. On the other hand, when the piston part is put in sliding contact with the ribs 16*c*, the application liquid is released into container body 16 through the gaps between ribs 16*c* . . . and flows into container body 16.

Here, a stem-like spring receiver is projected forwards at the center inside the rear part of reduced-diametric portion 16*b* of container body 16.

[Pumping Mechanism 36]

The aforementioned pumping mechanism 36 includes, as shown in FIGS. 2 and 3, in addition to the valve seat body 42 and piston body 44, a valve rod 46 inside piston body 44, a sealing member 48 at the front end of valve seat body 42 and a spring member 50 that urges piston body 44 forwards.

Pumping mechanism 36 includes: piston part 44*a* that moves forwards and backwards; a compression room (the space enclosed between a reduced-diametric portion 16 and piston part 44*a*) that is a space located in the rear part of container body 16 inside reduced-diametric portion 16*b* partitioned by piston part 44*a* to compress a fixed amount of the application liquid by rearward movement of the piston part 44*a*; and a path (the passage formed by the inner wall of main part 44*b* of piston body 44 and a groove 46*d* of valve rod 46) that is a channel for delivering the application liquid in the compression room to the applying part 14 and has an inner volume smaller than that of the compression room, and is provided with a handle (arm 32 and lever 34 of pressing part 24 in the comber 12) for moving the piston part 44*a* rearwards by user's single-handed operation.

As shown in FIG. 2, in the front part of the aforementioned path (the main part 44*b* and groove 46*d*) inside container body 16 before reaching applying part 14, holes (liquid delivery hole 44*f* and return hole 42*d*) for communicating the compression room in the reduced-diametric portion 16*b* enclosed by piston part 44*a* when the compression room is not compressed by the piston part 44*a*, with the space on the front side of the piston part in the container body are formed in the path (the main part 44*b* and groove 46*d*).

Detailedly, provided in the front side of the path (the main part 44*b* and groove 46*d*) inside container body 16 before reaching applying part 14 and application liquid feeder 38) is a valve structure (liquid delivery hole 44*f* and return hole 42*d* provided respectively for valve seat body 42 body 42 and main part 44*b* of piston body 44 with valve rod 46 fitted therein) which communicates the compression room enclosed by the piston part 44*a* with the space on the front side of piston part 44*a* in the container body 16 from before the start of compression of the compression room by the piston part 44*a* up to a fixed distance after compression (from non-operated stage in FIG. 2 to the initial stage of compression in FIG. 3), and shuts off the path from the interior of container body 16 (at the time of operation in FIG. 3) as the pressured room continues being compressed.

[Valve Seat Body 42]

As shown in FIG. 13, valve seat body 42 is formed of a tubular main part 42*a* with a bowl-like outer fitting part 42*b* on the outer periphery in the front end. This outer fitting part 42*b* is fitted to valve seat insert 18*f* on the rear side of front barrel 18 so as to fix valve seat body 42 to front barrel 18, as shown in FIG. 2. In this fixture, a sealing member 48 is interposed liquid-tightly on the inner periphery of valve seat insert 18*f* between the front end of main part 42*a* of valve seat body 42 and the rear surface of front barrel 18. The sealing member 48 assures liquid-tightness between pipe portion 38*e* and valve seat body 42 in the state where pipe portion 38*e* of application liquid feeder 38 is inserted in insert hole 18*e* so that if pipe portion 38*e* slides back and forth, the application liquid will not leak out of pipe portion 38*e*, thus making it possible to reliably prevent the application liquid from leaking out of front barrel 18 through insert hole 18*e*, for example.

Further, a slide hole 42*c* and return hole 42*d* are formed in the peripheral wall portion of the main part 42*a*, penetrating from the interior to exterior surfaces.

[Piston Body 44]

As shown in FIG. 11, piston body 44 is formed of a hollow cylindrical or tubular main part 44*b* opening at the front and rear ends with an approximately bowl-like piston part 44*a* opening frontwards, arranged on the outer periphery in the rear end of the main part. As shown in FIGS. 2 to 3, piston part 44*a* moves forwards and rearwards in sliding contact with the inner peripheral surface of container body 16. Further, a spring receiver 44*c* whose inner and outer peripheries reduced, stepwise, in diameter is formed at the rear end of hollow main part 44*b*. Spring member 50 is fitted on the outer periphery on the reduced-diameter side of the spring receiver 44*c* and abutted against the stepped portion. Formed between the spring receiver 44*c* and piston part 44*a* is a liquid passage 44*d* that penetrates from the inner to outer peripheries of main body 44*b*. This liquid passage 44*d* allows for feeding of the application liquid such as an application liquid inside the rear space of piston part 44*a* into main part 44*b* (groove 46*d* of valve rod 46). Further, in the front part of main part 44*b*, a projection 44*e* that fits in slide hole 42*c* of the valve seat body 42 movably back and forth while limiting the axial rotation of piston part 44 is formed, and liquid delivery hole 44*f* is formed on the side opposite from the projection.

[Valve Rod 46]

As shown in FIG. 2, valve rod 46 is fitted inside main part 44*b* of piston body 44. Further, as shown in FIG. 12, valve rod 46 is formed of a stem-like main part 46*b* and a valve part 46*a* having an umbrella-like shape tapering to the front, in the front end of the main part. A reduced-diametric portion 46*c* reduced, stepwise, in diameter is formed at the rear end of main part 46*b*. Formed on one side of valve rod 46 is groove 46*d* that is continuously formed from the rear side of valve part 46*a* to reduced-diametric portion 46*c*.

As shown in FIGS. 2 to 3, when valve rod 46 is fitted in piston body 44, the rear surface side of valve part 46*a* abuts the front end of main part 44*b* of piston body 44 while reduced-diametric portion 46*c* closely fits into spring receiver 44*c* at the rear end of the main part 44*b*. In this state, the rear end of groove 46*d* communicates with liquid passage 44*d* while the front part of groove 46*d* communicates with the rear side of valve part 46*a* through liquid delivery hole 44*f* and the front end of main body 44*b*. When valve part 46*a* of valve rod 46 is set to the inner periphery of valve seat body 42, groove 46*d* between the side surface of valve part 46*a* and the inner peripheral surface of valve seat body 42 creates a clearance allowing the application liquid to flow, so as to deliver the application liquid from the groove 46*d* to the front of the valve seat body 42 and application liquid feeder 38 and further to applying part 14. Valve part 46*a* of valve rod 46 is put in pressure contact with the inner periphery of main part 42*a* of valve seat body 42, forming a closed space when the applicator is not used, whereby it is possible to prevent the application liquid from flowing out when the applicator is unused.

In the state where piston body 44 and valve rod 46 are set with valve seat body 42, projection 44*e* of piston body 44 is fitted in slide hole 42*c* of valve seat body 42 movably back and forth while liquid delivery hole 44*f* fits in with return hole 42*d* when the applicator is not operated, as shown in FIG. 2. Accordingly, the rear side space of piston part 44*a* (the rear side space inside container body 16) and liquid passage 44*d* are connected to the front side space of piston part 44*a* (the front side space inside container body 16) by way of groove 46*d*, liquid delivery hole 44*f* and return hole 42*d*.

Further, when the applicator is operated as in FIG. 3, projection 44*e* of piston body 44 slides, being fitted movably back and forth in slide hole 42*c* of valve seat body 42. Further, liquid delivery hole 44*f* and return hole 42*d* are shut off, and a flow passage of the application liquid is created from the rear side space of piston part 44*a* (the rear side space inside container body 16) and liquid passage 44*d* to valve part 46*a* of valve rod 46 by way of groove 46*d*. A flow path is formed on the side surface of the valve part 46*a* with the inner surface of main body 42*a* of valve seat body 42 by means of the groove 46*d*. The application liquid reaches pipe portion 38*e* of application liquid feeder 38 through the flow path created by the groove 46*d* so that the application liquid is supplied to applying part 14 from the interior passage of the pipe portion 38*e*.

Next, the operation of the applicator according to the first embodiment will be described.

When the applicator is not operated, projection 44*e* of piston body 44 is fitted in slide hole 42*c* of valve seat body 42 while liquid delivery hole 44*f* fits in with return hole 42*d*, as shown in FIG. 2. In this state, the rear side space of piston part 44*a* (the rear side space inside container body 16) and liquid passage 44*d* are connected to the front side space of piston part 44*a* (the front side space inside container body 16) by way of groove 46*d*, liquid delivery hole 44*f* and return hole 42*d*.

Provision of projected ribs 16*c* . . . of container body 16 in cooperation with piston part 44 of piston body 44 creates gaps between the peripheral surface of piston part 44 and ribs 16*c* . . . so that the application liquid freely flows before and behind piston part 44*a*.

When the applicator is operated as in FIG. 3, comber 12 is pressed down by control of lever 34 of pressing part 24 of comber 12, projection 44*e* of piston body 44 moves rearwards with itself fitted in slide hole 42*c* of valve seat body 42 while liquid delivery hole 44*f* and return hole 42*d* are connected to each other up to some distance of shift. As a result, the front side space is connected to the external air, hence the internal pressure is released. As the comber is further pressed down, piston part 44*a* of piston body 44 gets out of ribs 16*c* . . . projected from container body 16 and moves rearwards so that the peripheral surface of piston part 44*a* slides liquid-tightly in contact with container body 16. The pressure inside the rear side space of piston part 44*a* increases in container body 16.

The liquid or the air is returned from the rear side space (the rear side space inside container body 16) of piston part 44*a* and liquid passage 44*d* to the front side space (the front side space inside container body 16) of piston part 44*a* by way of groove 46*d* and liquid delivery hole 44*f* and return hole 42*d*.

Then, liquid delivery hole 44*f* moves out of return hole 42*d* so that communication is shut off. Resultantly, the pressurized application liquid against directly below valve seat body 42 and the inner periphery of valve seat body 42, passes through the groove 46*d* to the front side of the valve seat body 42 and reaches application liquid feeder 38 and is further delivered to applying part 14 because there a channel for the application liquid to flow, created by groove 46 between the side surface of valve part 46*a* of valve rod 46 and the inner peripheral side of valve seat body 42.

When the pressing force is loosened after pressing down comber 12 by means of lever 34 as described above, comber 12 returns forwards by virtue of the repulsive force of spring member 50 and returns to the state shown in FIG. 2. Repeating the phases in FIG. 2 and FIG. 3 by means of lever 34 enables the application liquid to be supplied to applying part 14.

When applying part 14 wants replacing, lever 34 of pressing part 24 is pressed toward the center of the axis so as to take off engaging structures 22 from projected pieces 28 and take out comber 12 forwards from front barrel 18. Thus, it is possible to replace applying part 14 by removing comber 12 from application liquid feeder 38 or in any other way.

FIG. 4 shows a state when comber 12 is removed from front barrel 18. When comber 12 wants cleaning, lever 34 of pressing part 24 is pressed toward the center of the axis so as to take off engaging structures 22 from projected pieces 28 and take out comber 12 forward from front barrel 18. As a result, application liquid feeder 38 and applying part 14 can be taken out together from front barrel 18. Further, when applying part 14 can be taken off from application liquid feeder 38, applying part 14 is removed from application liquid feeder 38, then comber 12 can be taken off from application liquid feeder 38, so that comber 12 alone can be washed. Moreover, when applying part 14 can be removed from application liquid feeder 38, the applying part can be taken off before removal of comber 12 from front barrel 18.

According to the applicator of the embodiment, it is possible to attach and remove the application unit (applying part 14 and comber 12) by operating a single place or by operating lever 34 of pressing part 24, so that applying part 14 can be replaced markedly simply. Further, by moving comber 12 back and forth by means of lever 34 with comber 12 directed up, the application liquid can be supplied to applying part 14. Thus, this configuration is extremely convenient because there is no need to turn applying part 14 downwards.

Jagged indicator portion 40 that varies in reflectance of light depending on the amount of the application liquid in the liquid absorber is formed adjacent to applying part 14 of the liquid absorber, and the formed portion of the indicator portion 40 in the application liquid feeder 38 is made visible from the outside so that the amount of the application liquid can be displayed by the reflected light of indicator portion 40. Accordingly, the reflectance of light from indicator portion 40 varies from the unused state to a state after use where the application liquid has decreased, so that it is possible to visually confirm the state of the application liquid being fully stored or less stored from the change of the reflected light.

As indicator portion 40, the jagged configuration may be formed in an inclined zigzag pattern. If the jagged configuration is formed in an inclined zigzag pattern, the efficiency of reflection of the incident light is high so that the different in strength of reflected light depending on the presence or absence of the application liquid becomes large, thus making it easy to visually confirm the presence or absence of the application liquid.

Since the embodiment is an applicator that uses the liquid absorber as applying part 14 and includes a pumping mechanism 36 for appropriately supplying the application liquid freely stored in container body 16 to the applying part by user operation, it is possible to prevent excessive filling to applying part 14 by visual observation of indicator portion 40.

As another configuration than the embodiment, when a liquid absorber impregnated with the application liquid is set inside container body 16 while indicator portion 40 is placed adjacent to the liquid absorber so as to be visible from the outside to demonstrate the quantity of the application liquid in container body 16, the residual quantity of the application liquid in the container body 16 can be visually observed.

When the user holds the applicator with the front side up, by moving the piston body rearward by user's operation of lever 34 it is possible to move the application liquid from the compression room (the space enclosed between reduced-diametric portion 16*b* in the rear part of container body 16 and piston part 44*a*) located below to applying part 14 located on the front side via the path (the passage formed between the inner wall of main part 44*b* of piston body 44 and groove 46*d* of valve rod 46). Accordingly, it is possible to feed the application liquid to applying part 14 easily without any trouble such as changing the posture of the applicator every time for turning the position of the applying part. Thus, this configuration is convenient.

Further, since holes (liquid delivery hole 44*f* and return hole 42*d*) that communicates the interior of the compression room partitioned by the piston part 44*a* with the front side space of piston part 44*a* in the container body 16 when the interior of the compression room is not compressed by the piston part 44*a* are provided in the aforementioned path, the interior of the container body 16 is relieved via the communication path to the outside air as shown in FIG. 2 when not compressed or when the applicator is not used, whereby no spouting of the application liquid will not occur even when the outside air changes.

Moreover, inside container body 16 in front of the path (the passage defined by the inner wall of the main part 44*b* and groove 46*d* of valve rod 46) and before reaching applying part 14, the interior of the compression room partitioned by the piston part 44*a* is adapted to communicate with the front side space of piston part 44*a* in the container body 16 as shown in FIG. 2 during the interval from before the start of compression of the compression room by means of the piston part 44*a* up to the predetermined distance after compression. Then, a valve structure for shutting off the path from the interior of the container body is provided, as shown in FIG. 3. Accordingly, before start of compression the pressure of the compression room is relieved to the front side space inside container body 16 so as to prevent the application liquid from spouting out, and after compression the liquid or the air in the path is returned to the front side space during the interval of the predetermined distance, then the holes (liquid delivery hole 44*f* and return hole 42*d*) are shut off so that it is possible to deliver a stable amount of the application liquid.

Since comb-formed projections 10*a* of comb-toothed part of the comber 12 and applying part 14 (projections 14*a* . . . ) are arranged apart and the outer peripheral sides of part of projections 14*a* of multiple applying parts 14 approximately abut the virtual lines L which are defined by joining the inner end faces of comb-formed projections 10*a* of the comb-toothed parts 10, projections 14*a* . . . of applying part 14 will not go too much a distance away from the hair even when the applicator is applied on the scalp in a tilted position, this configuration enables easy application of the application liquid with applying part 14, and hence is easy to use.

As another configuration than the above first embodiment of the present invention, the second embodiment shown in FIGS. 17 to 26 can be provided. The same components as those in FIGS. 1 to 13 will be allotted with the same reference numerals.

This second embodiment differs from the applicator of the first embodiment in that comber 12 includes a pair of symmetrical left and right comb-toothed parts 10, 10, each having four comb-formed projections having approximately the same width and configuration, as shown in FIGS. 18, 19 and 21.

As to applying part 14, the same as the first embodiment are the aspects that projections 14*a* . . . have the same height and are laid out to be wide and narrow alternately.

The outer peripheral sides of projections 14*a* of applying part 14 approximately abut the virtual lines L, which are defined by joining the inner end faces of the comb-formed projections of the comb-toothed parts 10.

Further, part of the applying parts (projections 14*a*) that approximately abut the virtual lines L defined by joining the inner end faces of the comb-formed projections are positioned between the comb-formed projections defining the virtual lines L, with respect to the arrayed direction of comb-formed projections 10*a* . . . in the comb-toothed parts 10. In FIG. 18, there are five projections 14*a* . . . in applying part 14. Among these, the first, third and fifth projections 14*a*, 14*a*, 14*a* from the top are positioned between comb-formed projections 10*a* . . . .

Thus, projections 14*a*, 14*a*, 14*a* of applying part 14 are located between comb-formed projections 10*a* . . . defining the virtual lines L, so that it is possible to positively apply to the hair alone by keeping applying part 14 close to the scalp even if the comb-toothed parts 10 abut the scalp when the applicator is used.

Moreover, part of the applying parts (the first, third and fifth projections 14*a*, 14*a*, 14*a* from the top) that approximately abut the virtual lines L defined by joining the inner end faces of the comb-formed projections 10*a* and the other applying parts (the second and fourth projections 14*a*, 14*a* from the top) that do not approximately abut the virtual lines L are arranged alternately. This alternate arrangement enables efficient application at the time of using the applicator, hence making it possible for the applying part 14 to apply in a more reliable manner.

Also, part of projections of the applying part (the first, third and fifth projections 14*a*, 14*a*, 14*a* from the top) that approximately abut the virtual lines L defined by joining the inner end faces of the comb-formed projections 10*a* are formed with curved surfaces in their top ends and lateral ends, in particular, the distal ends being shaped with a spherical side form. Since the end parts of projections 14*a* . . . of applying parts 14 are shaped with a spherical side form, this configuration makes the contact with the hair mild and hence is preferable.

Further, as shown in FIGS. 20 and 22, a lid-like front side part 18*d* of front barrel 18 is formed with a guide sleeve projected forwards around an insert hole 18*e*. A tubular portion 38*e* of application liquid feeder 38 is formed long.

In this case, in the pumping mechanism 36, the outside diameter of piston part 44*a* of piston body 44 (and also the inside diameter of reduced-diametric portion 16*b* in the rear part of container body 16) is formed to be smaller than (may be approximately half of or smaller than half of) the inside diameter of container body 16, as shown in FIGS. 23 and 24.

The applicator of the second embodiment is chosen so as to lower the quantity of ejection of the application liquid to applying part 14 compared to the applicator of the first embodiment. Further, since front side part 18*d* of front barrel 18 is formed with a sleeve-like forward-facing projected portion in such a manner as to enclose insert hole 18*e*, tubular portion 38*e* of application liquid feeder 38 moves smoothly without rattle.

FIG. 26 shows the operation of the applicator. FIG. 26A shows a state when the applicator is not operated. As shown in FIG. 26B, at the start of lever 34 being pressed, the lower end of tubular portion 38*e* of application liquid feeder 38 abuts valve part 46*a* of valve rod 46. At this point, if the pressure (air) inside container body 16 increases due to change in temperature or the like the moment piston body 44 starts moving backwards, the air is released to the outside applying part 14 through liquid delivery hole 44*f* and return hole 42*d* and application liquid feeder 38, so that it is possible to prevent the application liquid from rushing out.

Figure 26E:
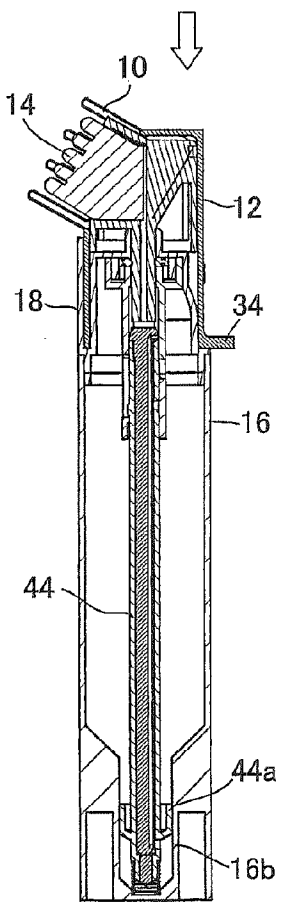
FIGS. 26A to 26E are diagrams for illustrating the function of the same applicator.
Figure 26D:
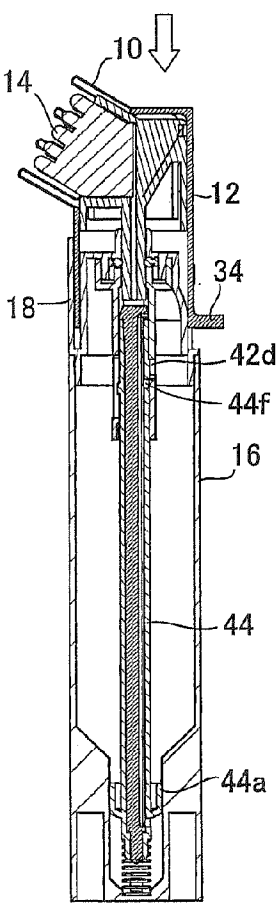
Figure 26C:
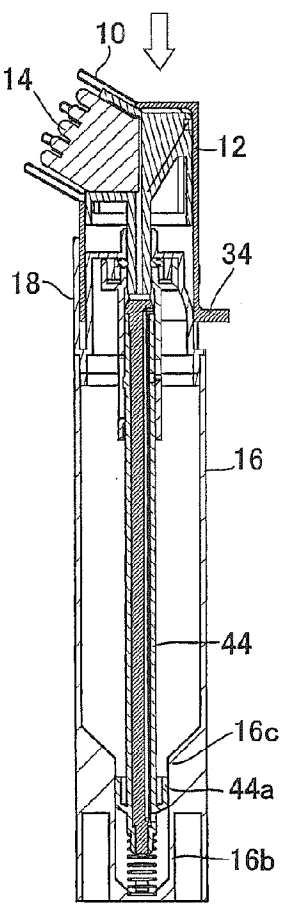
Figure 26B:
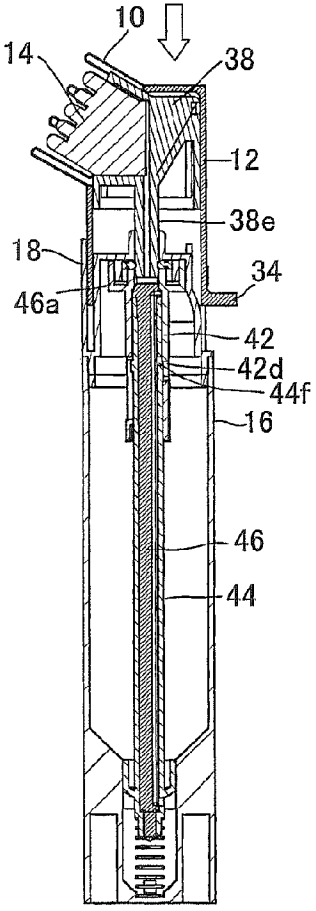
Figure 26A:
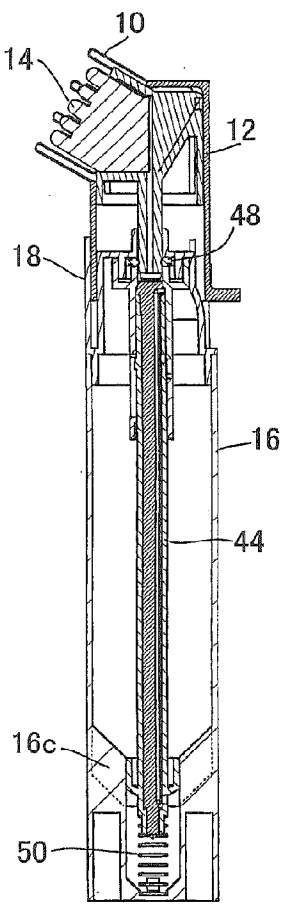
Figure 27C:
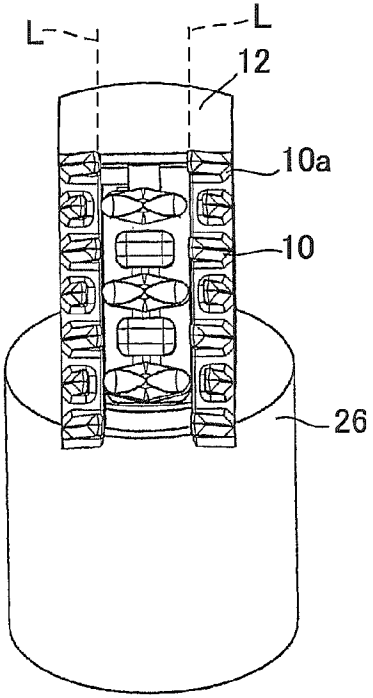
FIGS. 27A to 27C are illustrative diagrams of an applicator and a comber in an applicator according to the third embodiment of the present invention.
Figure 27B:
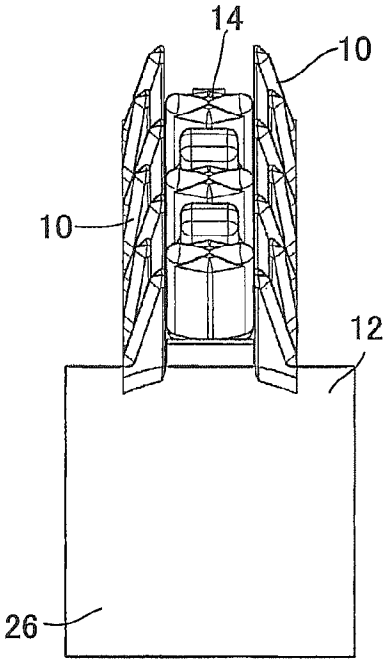
Figure 27A:
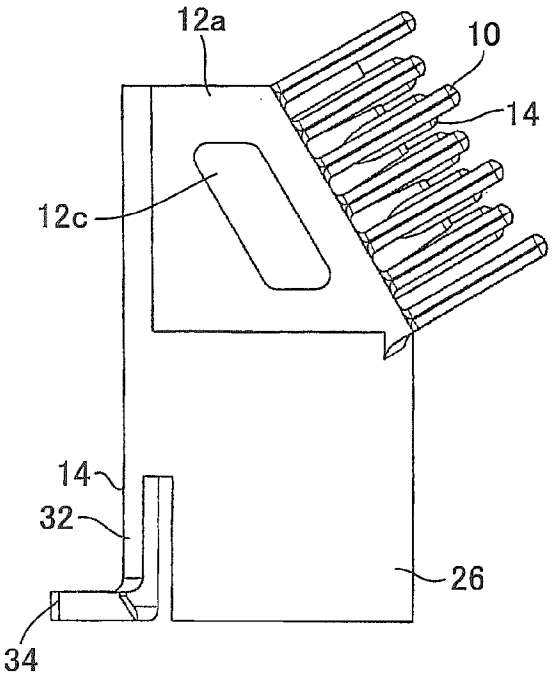
Figure 28A:
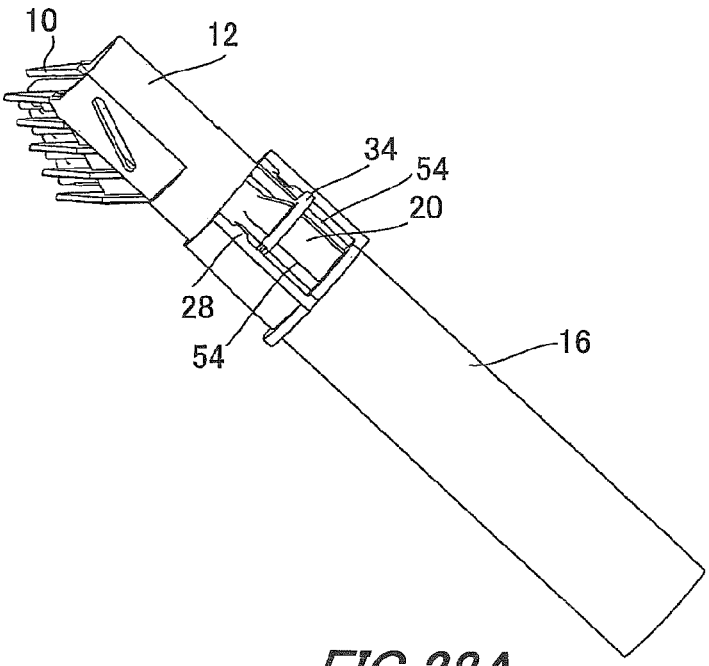
FIGS. 28A to 28C are overall illustrative diagrams of an applicator according to the fourth embodiment of the present invention.
Figure 28B:
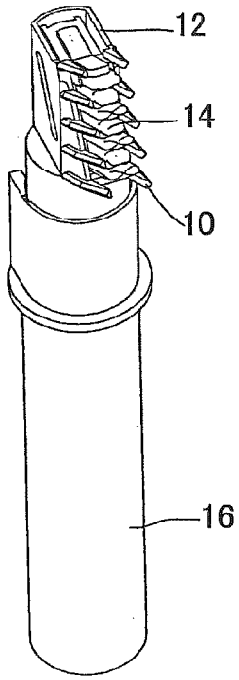
Figure 28C:
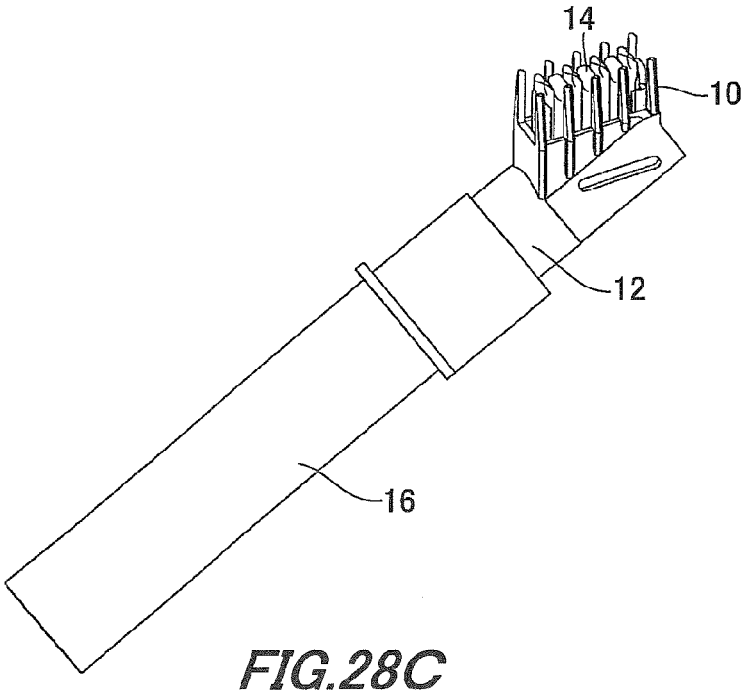
Figure 29B:
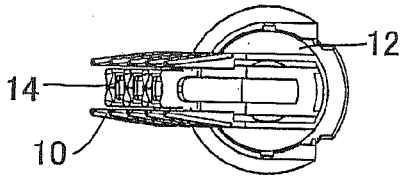
FIGS. 29A to 29E are illustrative diagrams when the same applicator is not operated.
Figure 29A:
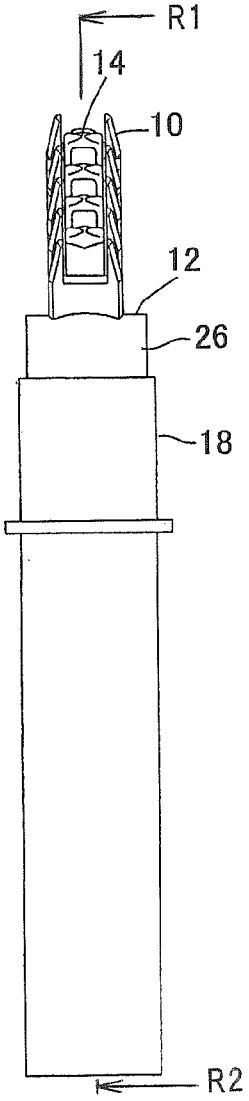
Figure 29C:
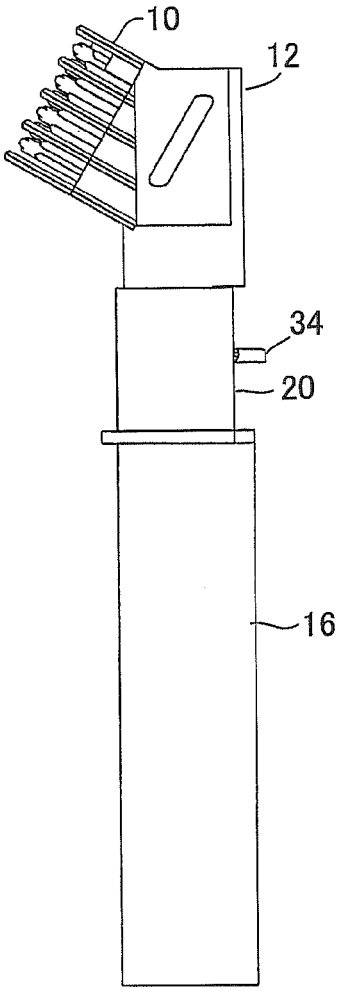
Figure 29D:
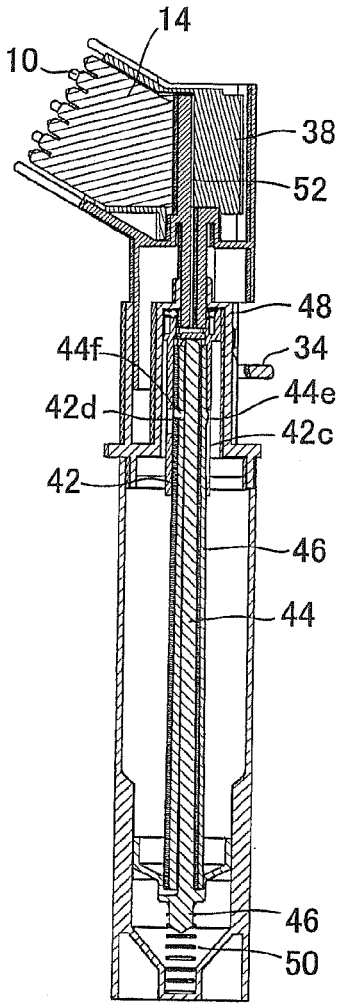
Figure 29E:
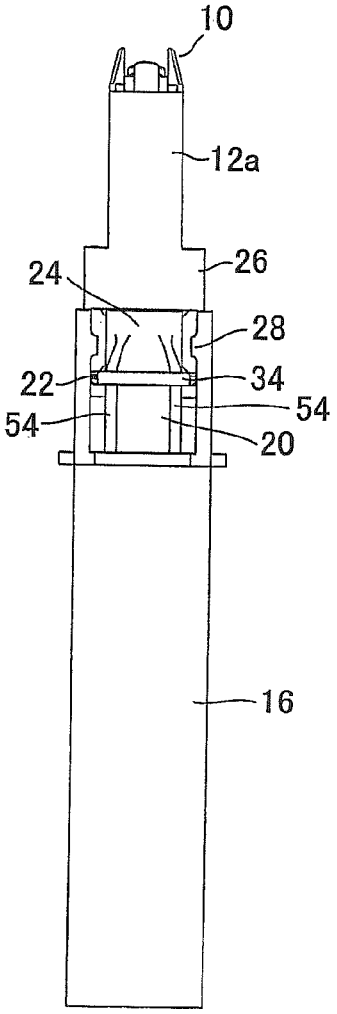
Figure 30A:
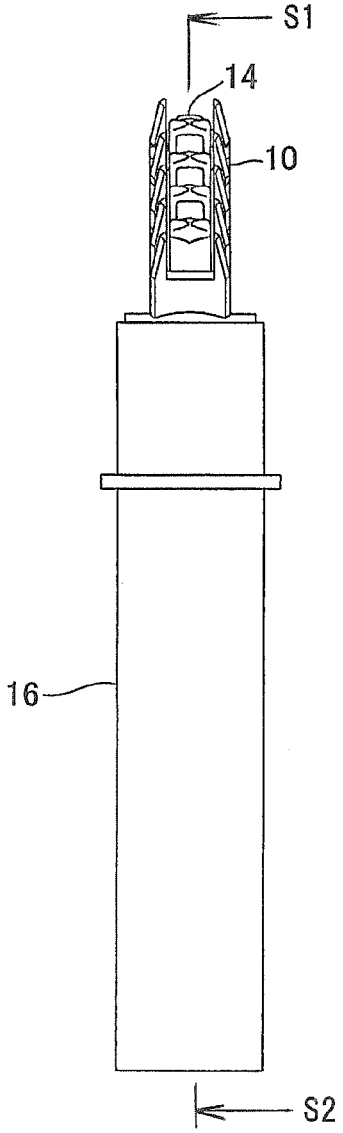
FIGS. 30A to 30D are illustrative diagrams when the same applicator is operated.
Figure 30B:
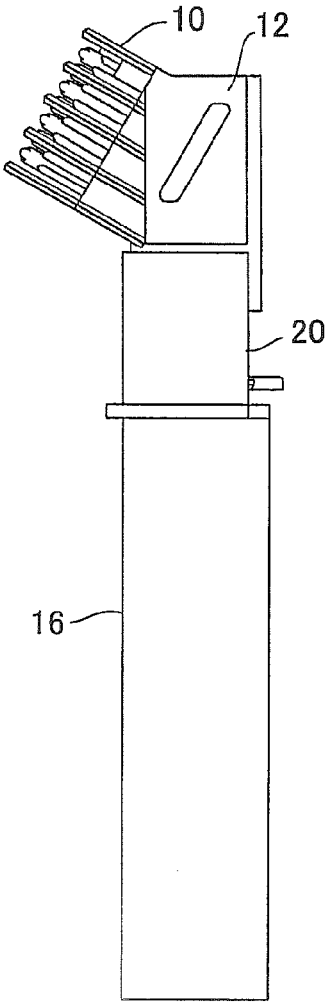
Figure 30C:
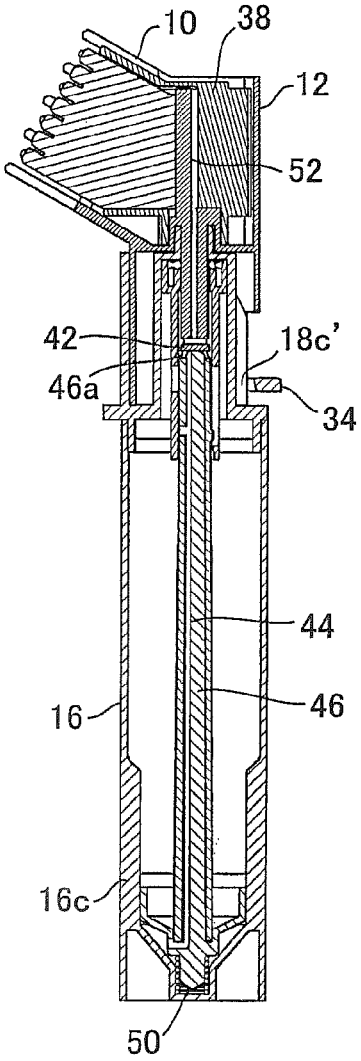
Figure 30D:
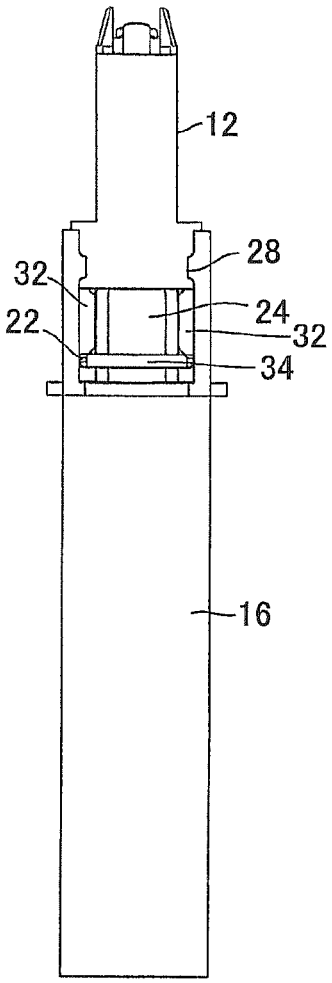
Figure 31A:
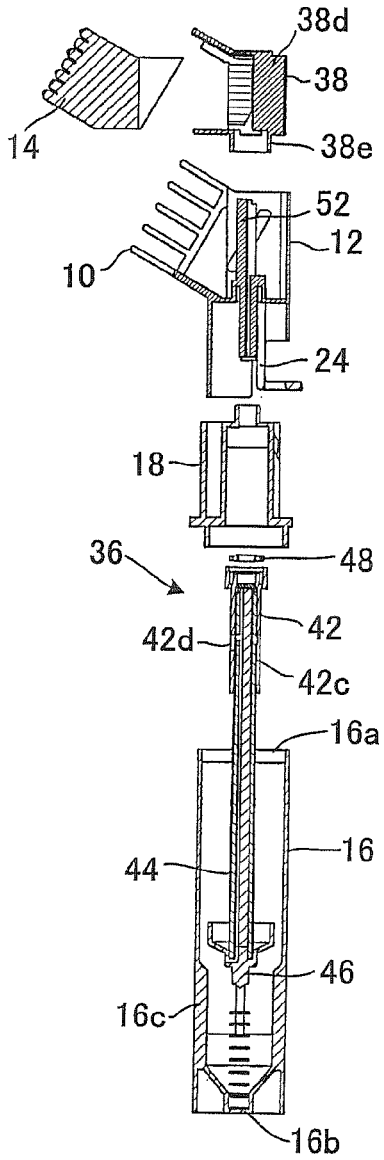
FIGS. 31A to 31C are illustrative exploded and assembly diagrams of the same applicator.
Figure 31B:
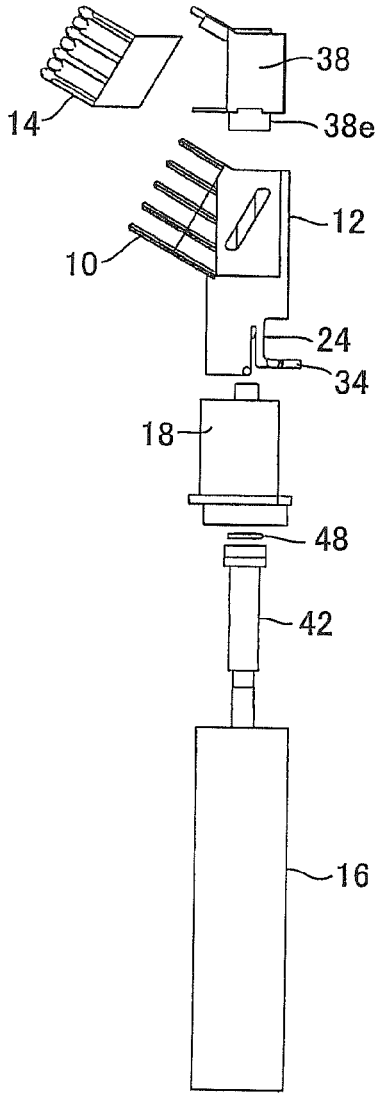
Figure 31C:
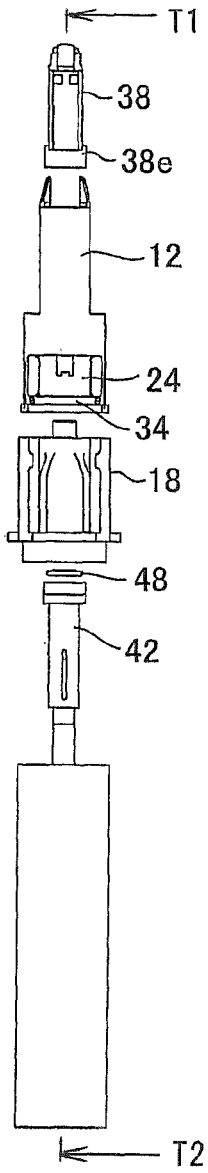
Figure 32A:
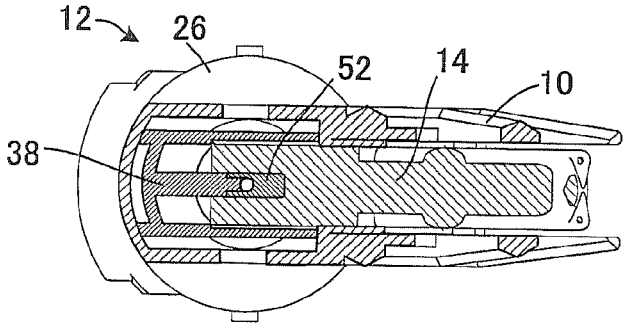
FIGS. 32A to 32D are partial assembly diagrams of a state where an applying part is attached to a comber of the same applicator.
Figure 32B:
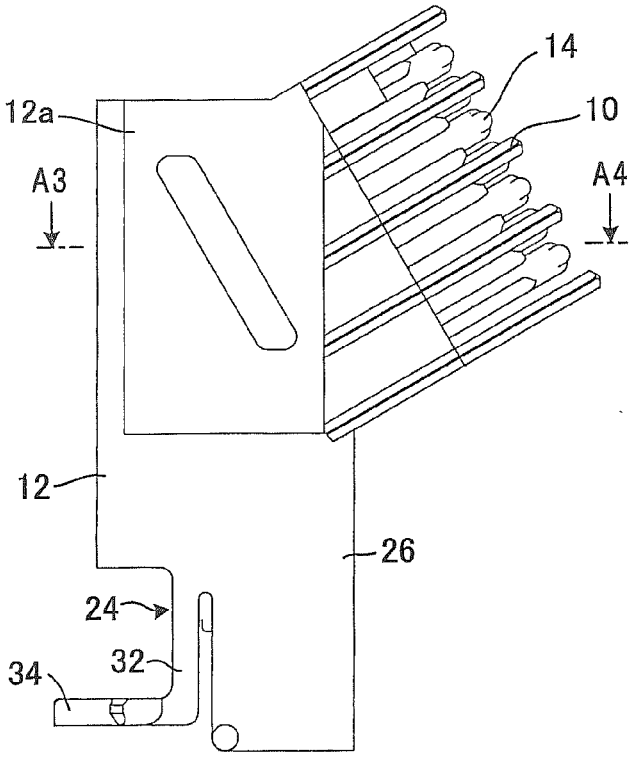
Figure 32C:
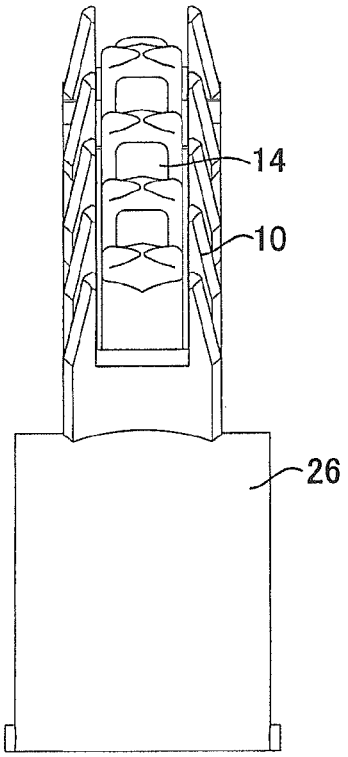
Figure 32D:
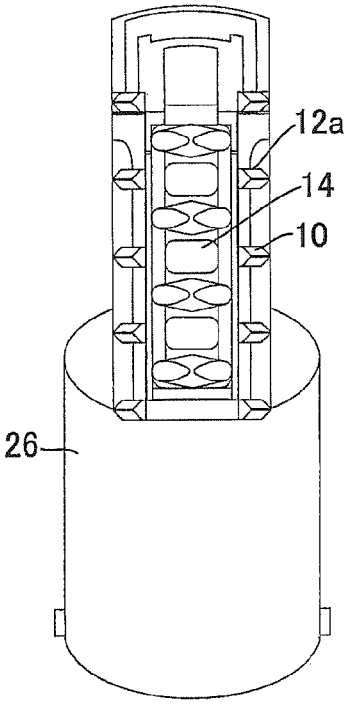
Figure 33B:
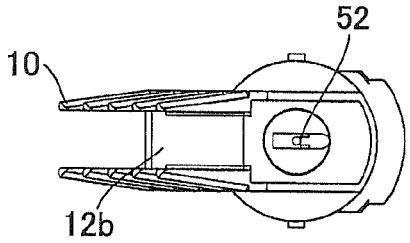
FIGS. 33A to 33G are illustrative diagrams of a comber of the same applicator.
Figure 33A:
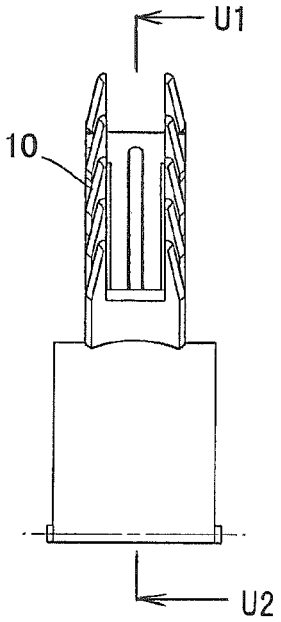
Figure 33C:
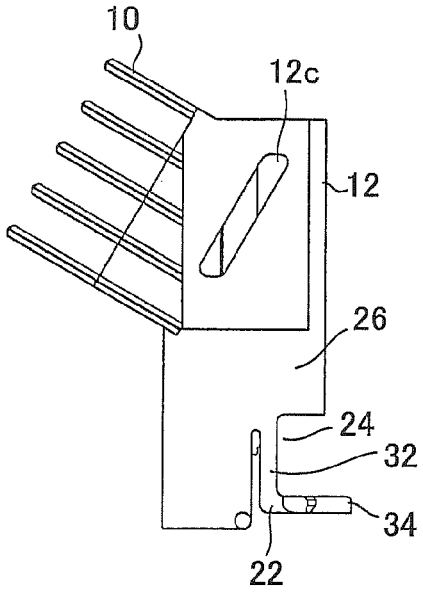
Figure 33D:
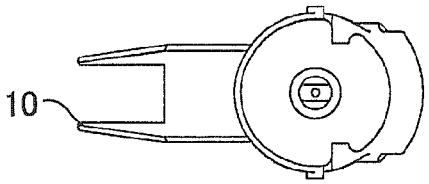
Figure 33E:
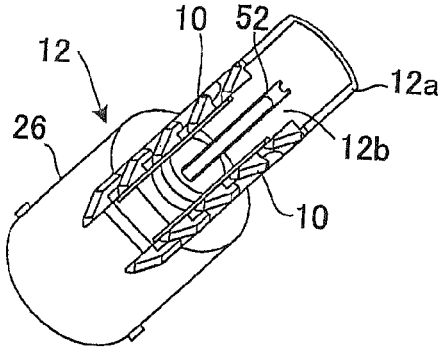
Figure 33F:
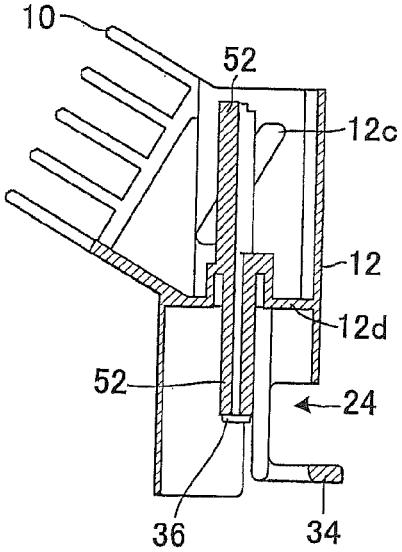
Figure 33G:
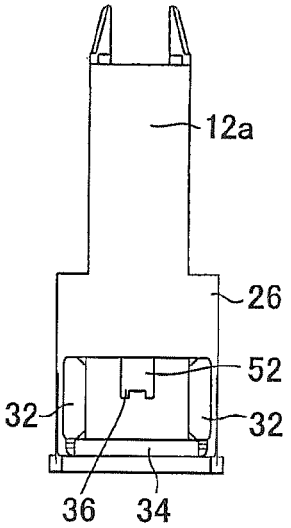
Figure 34D:
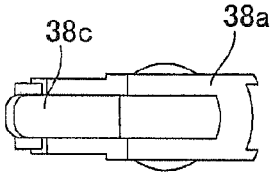
Figure 34G:
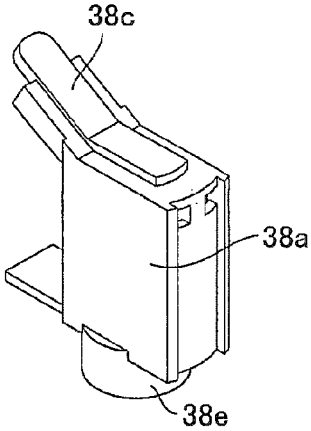
Figure 34E:
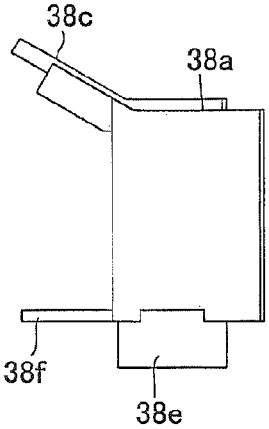
Figure 34H:
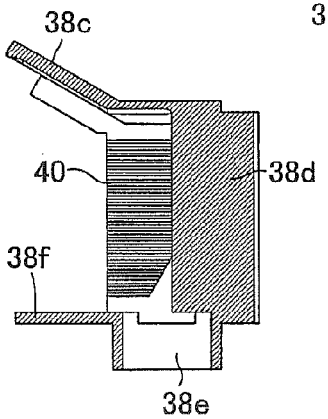
Figure 34I:
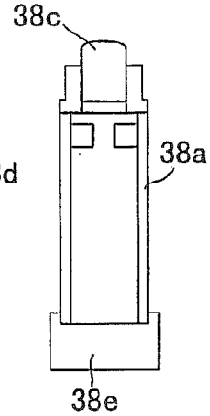
Figure 34F:
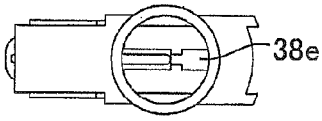
Figure 35B:
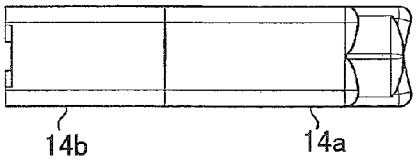
FIGS. 35A to 35F are illustrative diagrams of an applying part of the same applicator.
Figure 35A:
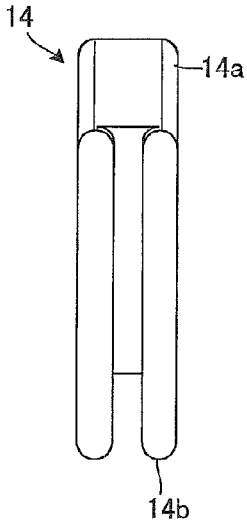
Figure 35C:
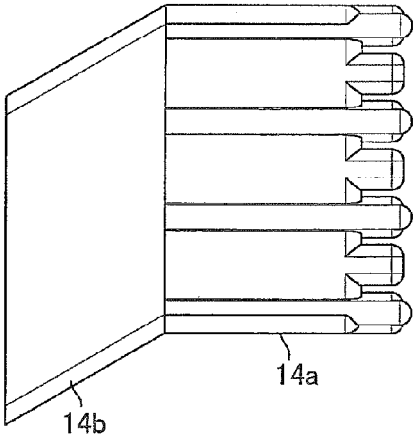
Figure 35F:
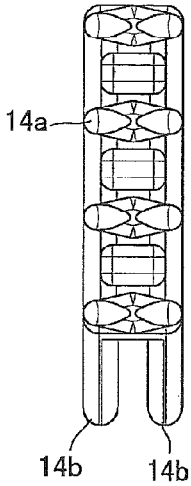
Figure 35D:
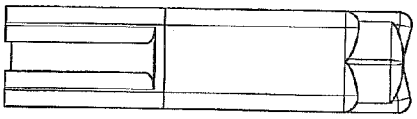
Figure 35E:
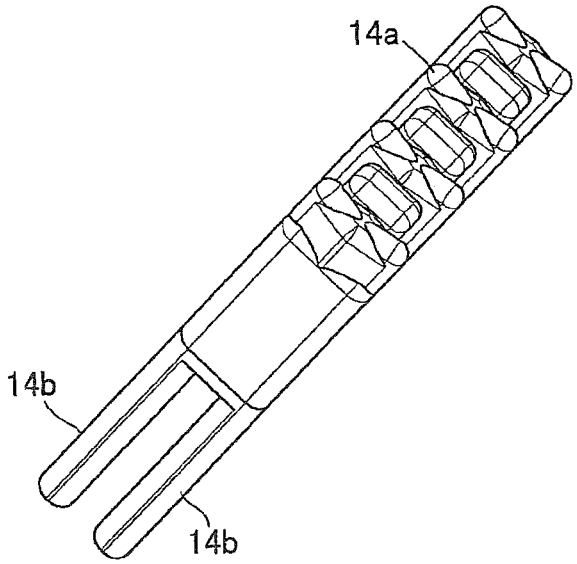
Figure 36A:
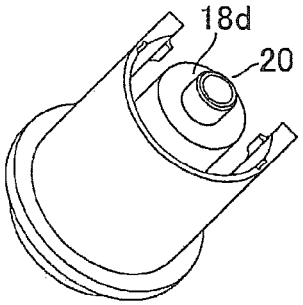
FIGS. 36A to 36I are illustrative diagrams of a front barrel of the same applicator.
Figure 36C:
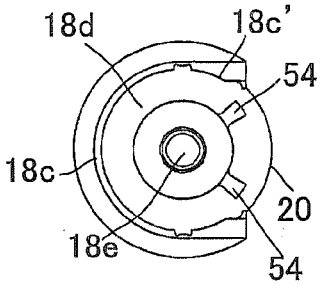
Figure 36B:
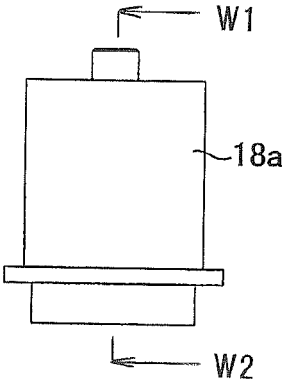
Figure 36D:
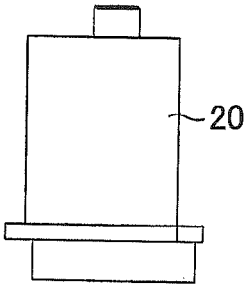
Figure 36E:
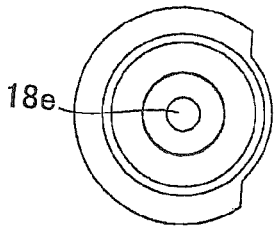
Figure 36F:
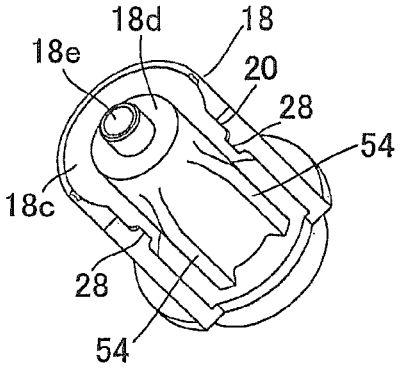
Figure 36G:
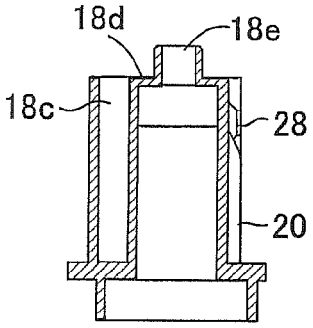
Figure 36I:
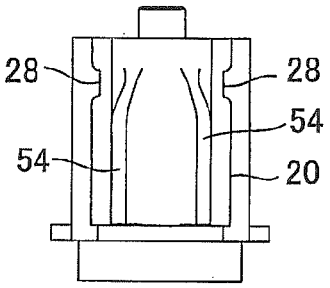
Figure 36H:
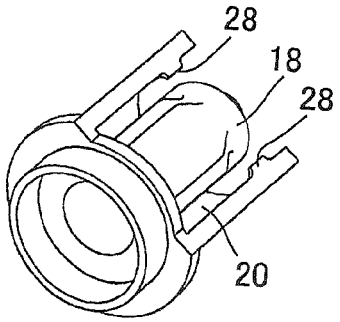
Figure 37D:
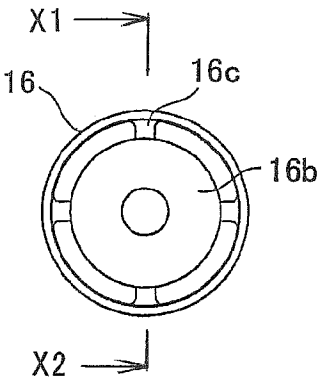
FIGS. 37A to 37D are illustrative diagrams of a container body of the same applicator.
Figure 37B:
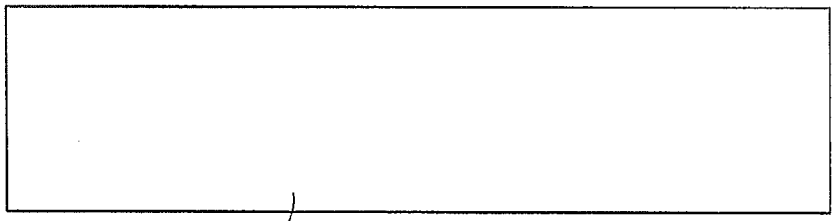
Figure 37C:
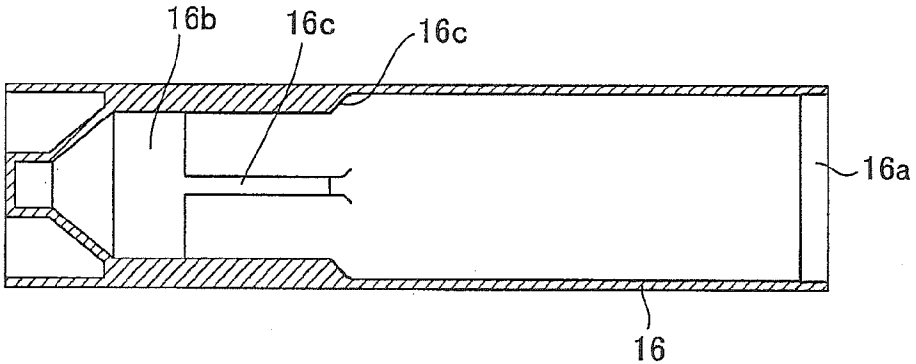
Figure 37A:
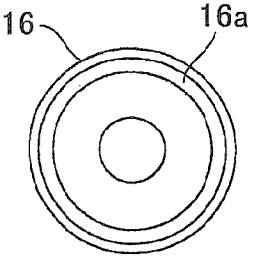
Figure 38C:
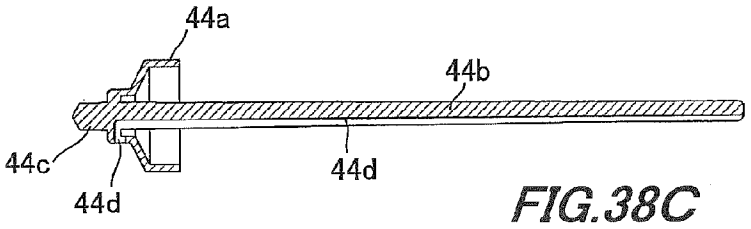
FIGS. 38A to 38G are illustrative diagrams of a piston body of the same applicator.
Figure 38D:
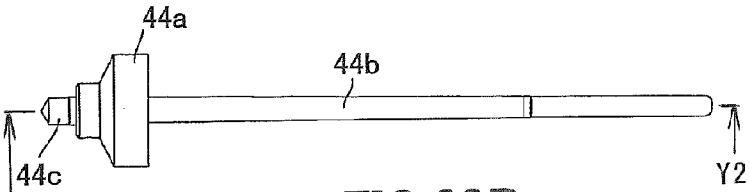
Figure 38E:
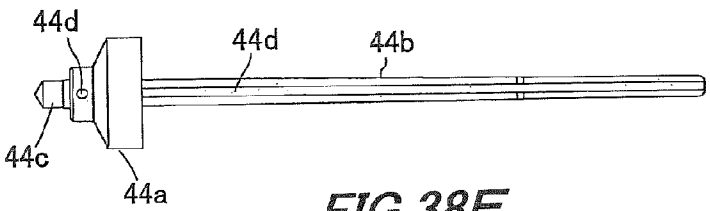
Figure 38A:
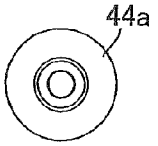
Figure 38B:
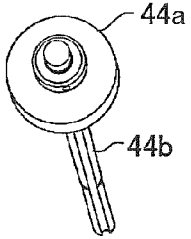
Figure 38F:
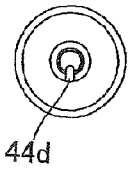
Figure 38G:
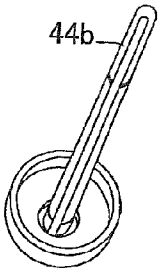
Figure 39F:
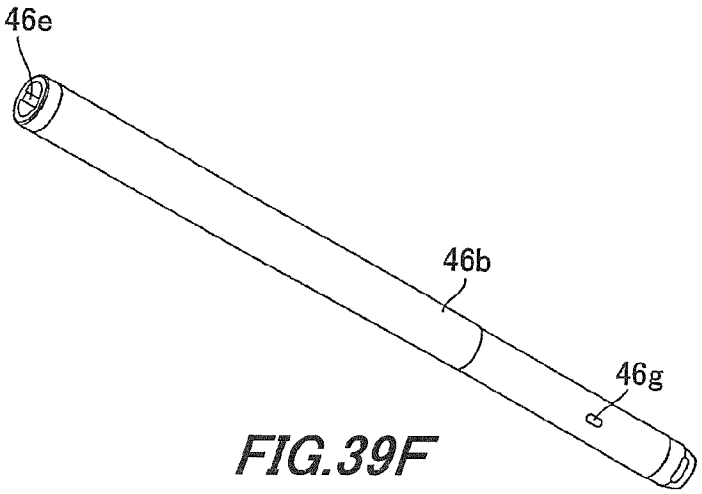
FIGS. 39A to 39G are illustrative diagrams of a valve rod of the same applicator.
Figure 39A:
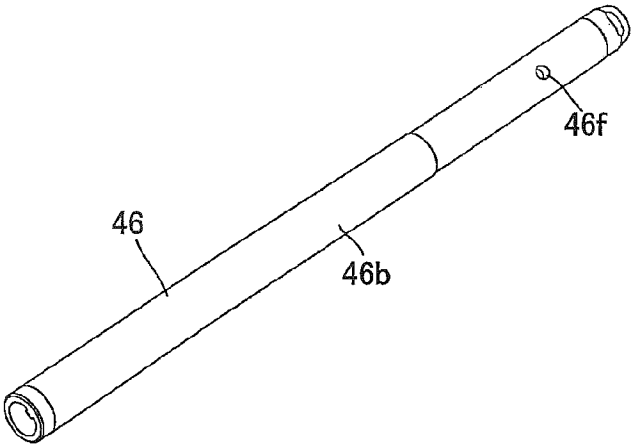
Figure 39C:
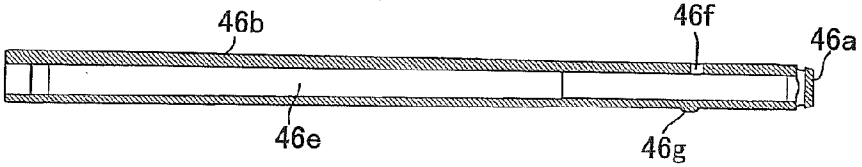
Figure 39D:
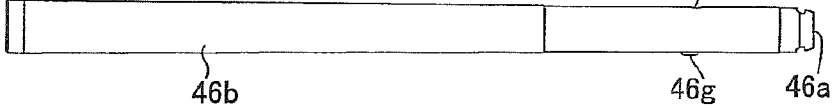
Figure 39E:
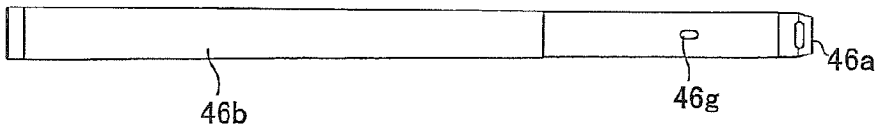
Figure 39G:
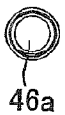
Figure 39B:
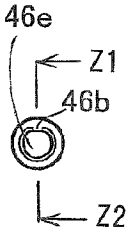
Figure 40H:
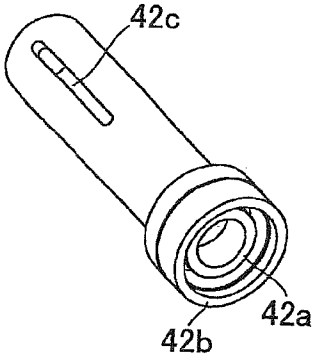
FIGS. 40A to 40J are illustrative diagrams of a valve seat body of the same applicator.
Figure 40D:
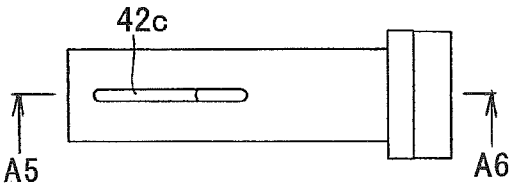
Figure 40E:
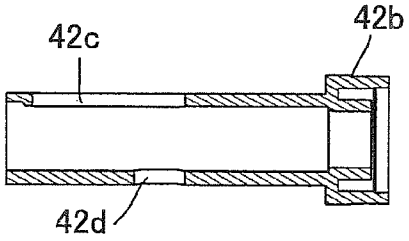
Figure 40A:
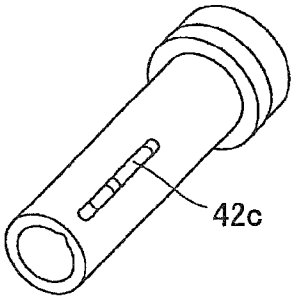
Figure 40B:
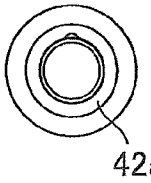
Figure 40F:
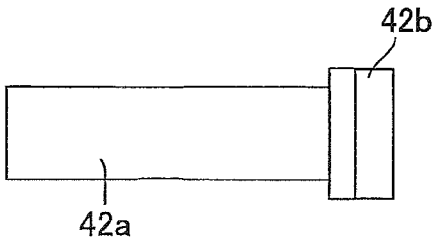
Figure 40I:
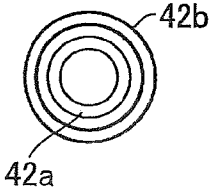
Figure 40C:
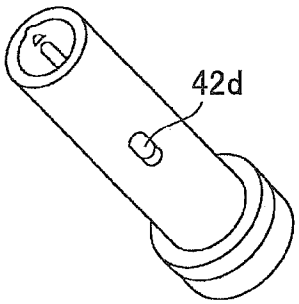
Figure 40G:
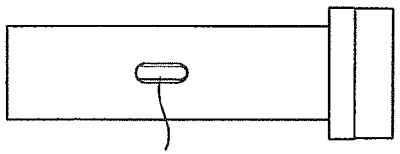
Figure 40J:
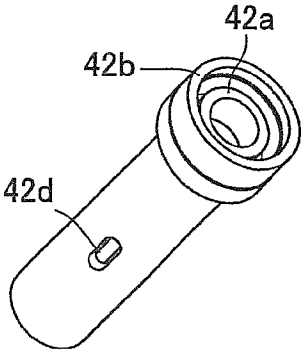

Thereafter, as shown in FIG. 26C, piston part 44*a* comes out of ribs 16*c* and into contact with the inner wall in the rear part of container body 16 (the gap between container body 16 and piston part 44*a* may be formed as small as 0.05 mm), the pressure of the application liquid inside reduced-diametric portion 16*b* increases. During this, liquid delivery hole 44*f* and return hole 42*d* communicate with each other up to a predetermined distance of shift, so that the application liquid or the air is returned.

Then, as shown in FIG. 26D and FIG. 26E, a further pressing of lever 34 shuts off the communication between liquid delivery hole 44*f* and return hole 42*d* to increase pressure so that the application liquid, passing through the path between main part 44*b* of piston body 44 and groove 46*d*, flows from the interior of valve body 42 to application liquid feeder 38 and impregnates applying part 14. Thereafter, as the pressing force is freed, the applicator returns to FIG. 26A.

Next, the applicator according to the third embodiment will be described with reference to FIG. 27.

In the applicator according to the third embodiment, as shown in FIG. 27 the comber 12 to which applying part 14 is attached has a different configuration from that of the first embodiment. The comber 12 has a pair of left and right comb-toothed parts 10, each having seven comb-formed projections 10*a* . . . projectively formed long and short in alternate manner. Applying part 14 is formed so that individual pieces are formed wide and narrow in alternate manner.

Projections 14*a* . . . of the applying part 14 and comb-formed projections 10*a* are correspondingly arranged a fixed distance apart.

Specifically, in the third embodiment, projections 14*a* . . . of applying part 14 are formed wide, narrow, wide . . . from top to bottom, as shown in FIG. 27. On the other hand, comb-formed projections 10*a* which are located corresponding to projections 14*a* are bent outwards so that the distance of each comb-formed projection 10*a* from corresponding projection 14*a* is made wide or narrow. As a result, projections 14*a* . . . and corresponding comb-formed projections 10*a* are arranged an approximately fixed distance apart. As described above, since projections 14*a* . . . of the applying part 14 and corresponding comb-formed projections 10*a* . . . are arranged an approximately fixed distance apart, the application liquid is unlikely to stain the comb-formed projections 10*a*, hence the comber is unlikely to soil, hence this configuration is preferable.

Referring next to FIGS. 28 to 41, an applicator according to the fourth embodiment will be described. The applicator according to the fourth embodiment is the same as those of the above first to third embodiments in that it is a hair-care applicator for supplying an application liquid stored in container body 16 to the hair from applying part 14 while combing the hair with comber 12. The difference in structure resides in, as shown in FIGS. 28 to 41, the following aspects: (1) applying part 14, (2) a liquid passage portion 52 of comber 12 for supplying the application liquid, (3) a clearance 20 of front barrel 18 and lever 34 of pressing part 24, (4) ribs 54 on the inner peripheral wall surface formed in clearance 20 of front barrel 18 and (5) a structure in which solid main part 44*b* of piston body 44 is inserted into liquid passage 46*e* inside hollow valve rod 46. The other configurations are the same as in the first embodiment so that description is omitted.

(1) Comber 12 is open to the front while applying part 14 attached to comber 12 is made bigger than those of the first to third embodiments.

In the above, as shown in FIGS. 28 to 41, the comber 12 has an angled U-shaped configuration when viewed from the front side with its front side part open. The large applying part 14 assembled with application liquid feeder 38 is adapted to be inserted rearwards from the front opening part of comber 12 so that large-sized applying part 14 can be fitted easily. The structure of applying part 14 of the fourth embodiment is shown in FIG. 35. However, the above-described structures of FIG. 8 and FIG. 31 and others can also be adopted.

(2) In order to fully spread the application liquid over the aforementioned applying part 14, comber 12 is formed with guttered liquid passage portion 52 that opposes and abuts a gutter structure 38*d* of application liquid feeder 38. Further, pipe portion 38*e* under application liquid feeder 38 has a cylindrical configuration to which liquid passage portion 52 of comber 12 is inserted.

Specifically, shown in FIGS. 32 to 33, inside comber 12, a partitioning wall 12*d* is formed between front side part 12*a*/ and rear side part 26. Liquid passage portion 52 is supported by the partitioning wall 12*d* so as to extend forwards and rearwards. Liquid passage portion 52 is configured such that its rear side behind partitioning wall 12*d* is pipe-shaped. This pipe-shaped portion (the rear side part of liquid passage portion 52) is inserted into valve seat body 42 from insert hole 18*e* of front barrel 18 and abuts valve part 46*a* at the front end of valve rod 46.

The part of liquid passage portion 52 on the front side of partitioning wall 12*d* is formed to be guttered with a groove that faces the side opposite to the projected side of applying part 14. Gutter structure 38*d* of application liquid feeder 38 inserted in comber 12 is projected in a wall-form having a groove at its front end. When the application liquid feeder 38 is assembled to comber 12, as shown in FIG. 31 etc., the pipe portion 38*e* located at the lower part of application liquid insert part 38 is formed large in diameter, so that liquid passage portion 52 is passed through pipe portion 38*e* and the gutter structure 38*d* in the front fits into the groove of the gutter structure of liquid passage portion 52, whereby a space for application liquid feeding is formed up to the top of applying part 14 between the front end of gutter structure 38*d* and liquid passage portion 52. The application liquid passing between piston body 44 and valve rod 46 of pumping mechanism 36 passes through the space for application liquid feeding formed between the front end of gutter structure 38*d* and liquid passage portion 52 and can be supplied to the top from the front side part of applying part 14. As a result, the application liquid can be spread over and impregnate the whole of applying part 14. Since the application liquid can be supplied from the top of applying part 14, applying part 14 can be fully impregnated with the application liquid so that the application liquid will not lack when the applicator is used.

(3) In pressing part 24 of pumping mechanism 36, in order to enable the fingers to fully push lever 34 of the pressing part, the position of lever 34 is depressed nearer to the center of axis than the peripheral position of front barrel 18, and the clearance 18*c*' on the interior side of slit portion 20 of front barrel 18 is made deep and wide.

In this case, as shown in FIGS. 28 to 33 and 36, the clearance 18*c* from the outer periphery 18*a* to inner peripheral wall portion 18*b* of front barrel 18 is formed greater than that of the first to third embodiment so as to allow the user to readily insert and hook the finger on lever 34.

Further, arm 32 of lever 34 is formed of a pair of arm parts arranged apart in the peripheral direction, extended gate-like in the axial direction and connected by lever 34 as shown in FIG. 33. Before assembling, liquid passage portion 52 can be seen between paired arms 32, 32, as shown in FIG. 33. When the finger is hooked on lever 34, it is possible to insert the fingertip between arms 32, 32 and position the finger to the more interior side so as to apply force at the position closer to the axis, it is hence possible to permit smooth operation of lever 34.

(4) In order to make the motion of pumping mechanism 36 more smooth, a pair of rail-like ribs 54, 54 that extend in the front-to-rear direction and project radially outwards are formed at the positions where the inner side of arms 32 of lever 34 abut, in the aforementioned clearance 18*c*' on the interior side of slit portion 20 of front barrel 18, as shown in FIGS. 29 and 36.

When lever 34 is pressed, these ribs 54, 54 abut the interior side of lever 34 to prevent arms 32 from flexing and enable lever 34 to slide smoothly. Accordingly, this configuration stabilizes and smoothens the operation of lever 34.

(5) In applicators according to the above first to third embodiments, main part 44*b* of piston body 44 is hollow cylindrical and valve rod 46 is inserted into the hollow, as shown in FIGS. 2, 3, 11, 12 and 21 to 26. In contrast, in the applicator according to the fourth embodiment, main part 44*b* of piston body 44 is rod-formed and the main part 44*b* is inserted into hollowed valve rod 46, as shown in FIGS. 38 and 39.

Detailedly, a stem-like main part 44*b* in piston 44 is formed solid and a liquid passage 44*d* having a sectionally U-shaped groove structure is formed on the peripheral side of main part 44*b* in the longitudinal direction of main part 44*b*. The hollowed part of valve rod 46 forms a liquid passage 46*e*. The space defined by the inner wall surface of valve rod 46 and liquid passage 44*d* of the main part 44*b* forms the flow path for flowing the application liquid.

Fitted in liquid passage 46*e* inside the hollow of valve 46 is main part 44 of piston 44. In valve rod 46, a valve part 46*a* having an umbrella-like shape tapering to the front in the front end of the stem-like main part 46*b* is formed while the rear end of main part 46*b* is made open. Further, in the front part of valve rod 46, a projection 46*g* that fits in slide hole 42*c* of the valve seat body 42 movably back and forth while limiting the axial rotation of valve rod 46 is formed, and a liquid delivery hole (return hole) 46*f* is formed on the side opposite from the projection.

When valve rod 46 is fitted in piston body 44, the rear surface side of valve part 46*a* of valve 46 abuts the front end of main part 44*b* of piston body 44 while the rear end of main part 46*b* of valve rod 46 closely fits into spring receiver 44*c* inside piston part 44*a* at the rear end of piston body 44 (see FIGS. 29, 38 and 39). In this state, the rear end of liquid passage 44*d* communicates with the rear face side of piston part 44*a* while the front part of liquid passage 44*d* communicates with the rear side of valve part 46*a* through liquid delivery hole 46*f* and the front end of main part 46*b* of valve rod 46. When valve part 46*a* of valve rod 46 is set to the inner periphery of valve seat body 42, liquid passage 46*e* between the side surface of valve part 46*a* and the inner peripheral surface of valve seat body 42 creates a gap allowing the application liquid to flow so as to deliver the application liquid from the liquid passage 46*e* to the front of the valve seat body 42 and liquid passage portion 52 and further to applying part 14.

Valve part 46*a* of valve rod 46 is put in pressure contact with the inner periphery of main part 42*a* of valve seat body 42, forming a closed space when the applicator is not used, whereby it is possible to prevent the application liquid from flowing out when the applicator is unused.

In the above way, according to the applicator of the fourth embodiment, compared to the applicators of the first to third embodiments, liquid passage portion 52 is formed in order to positively supply the application liquid to large-sized applying part 14, ribs 54 are formed in front barrel 18 in order to smoothen the motion of lever 34, and main part 44*b* of the piston body is formed solid while valve rod 46 is made hollow in order to simply piston body 44.

Figures 41A, 41B, 41C, 41D, 41E:
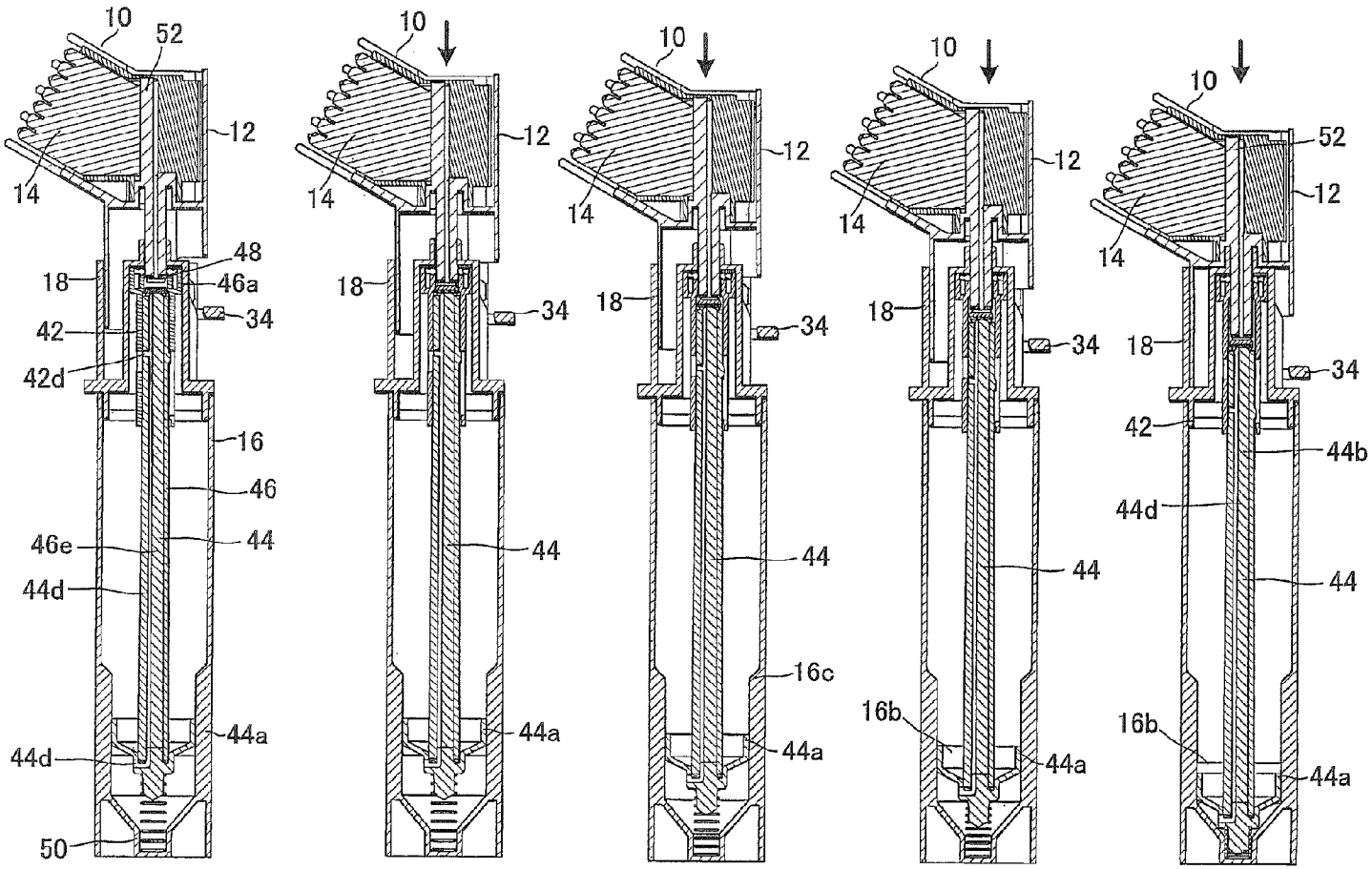
FIGS. 41A to 41E are diagrams for illustrating the function of the same applicator.
Figure 42B:
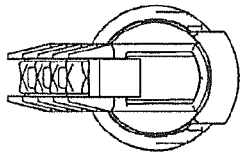
FIGS. 42A to 42E are illustrative diagrams of an applicator according to the fifth embodiment of the present invention when the applicator is not operated.
Figure 42A:
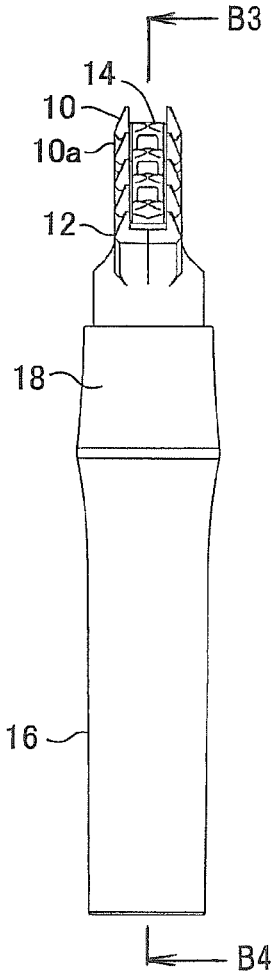
Figure 42C:
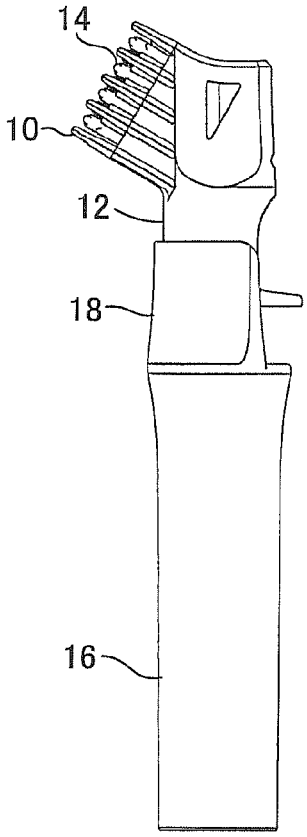
Figure 42D:
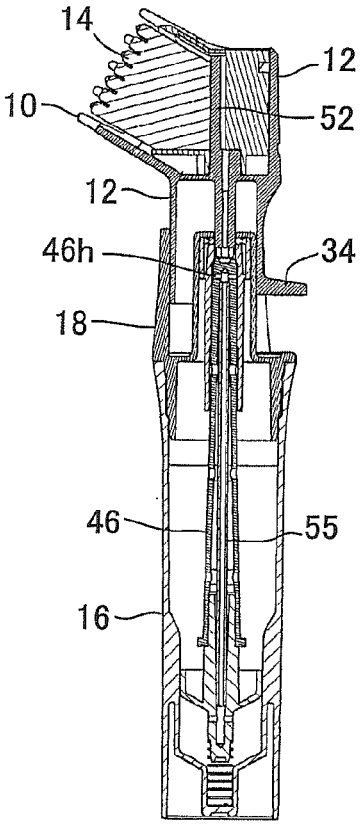
Figure 42E:
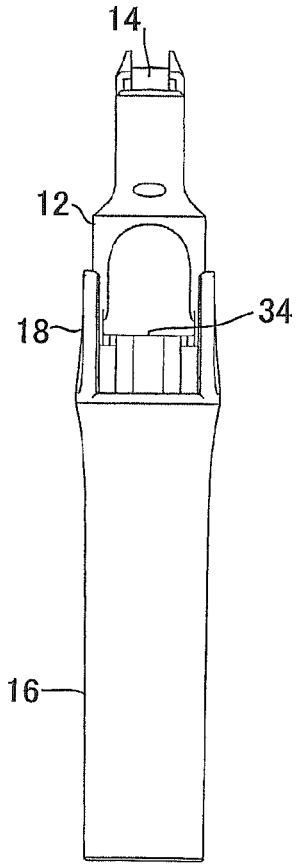
Figure 43B:
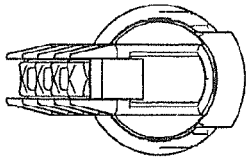
FIGS. 43A to 43E are illustrative diagrams when the same applicator is operated.
Figure 43A:
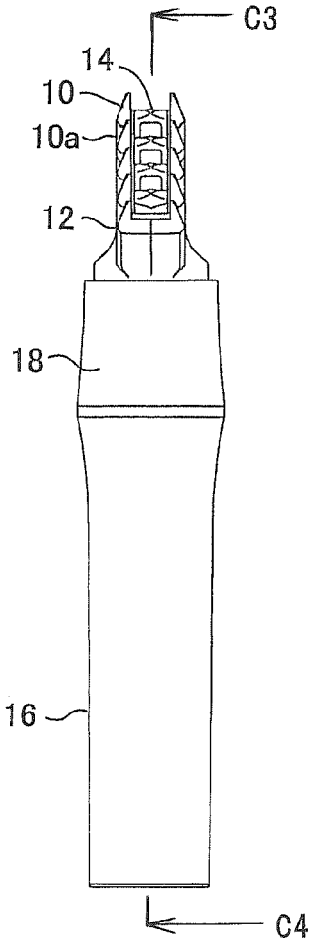
Figure 43C:
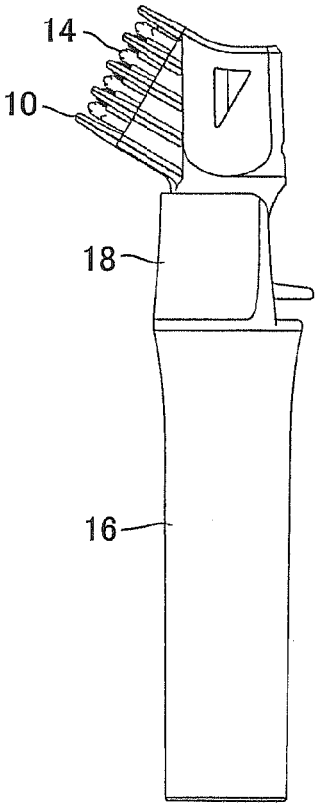
Figure 43D:
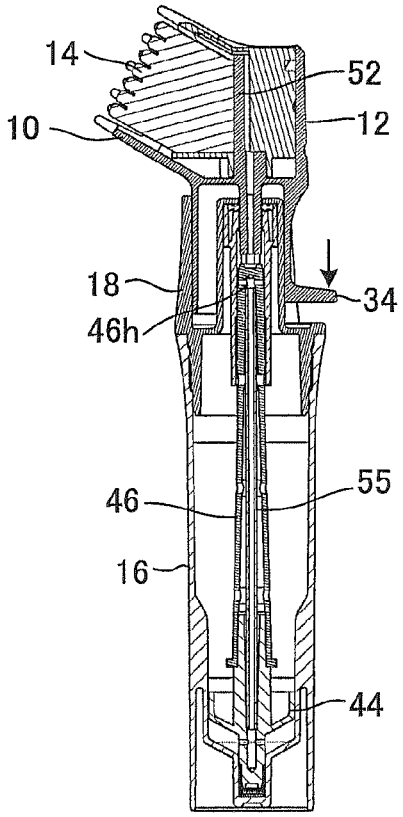
Figure 43E:
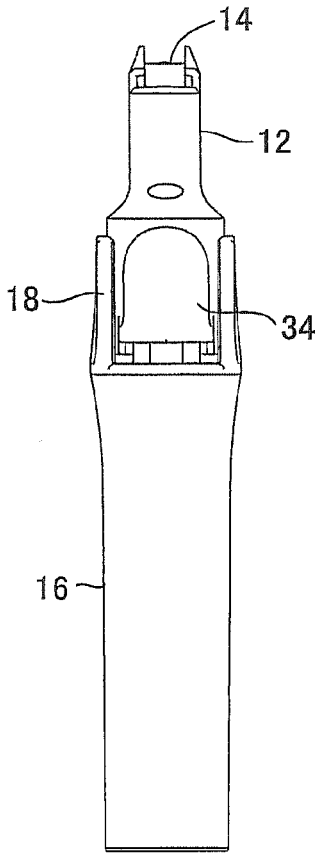
Figure 44A:
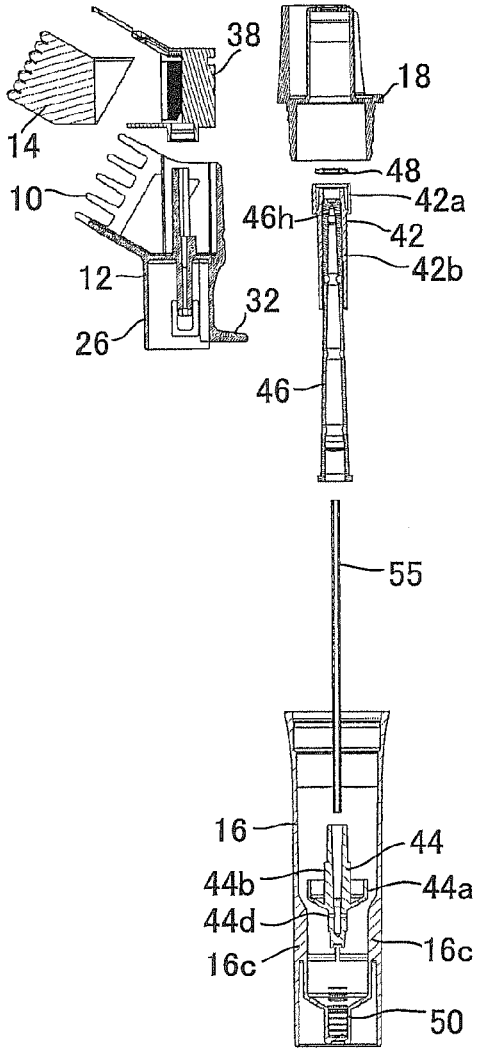
FIGS. 44A to 44C are illustrative exploded and assembly diagrams of the same applicator.
Figure 44B:
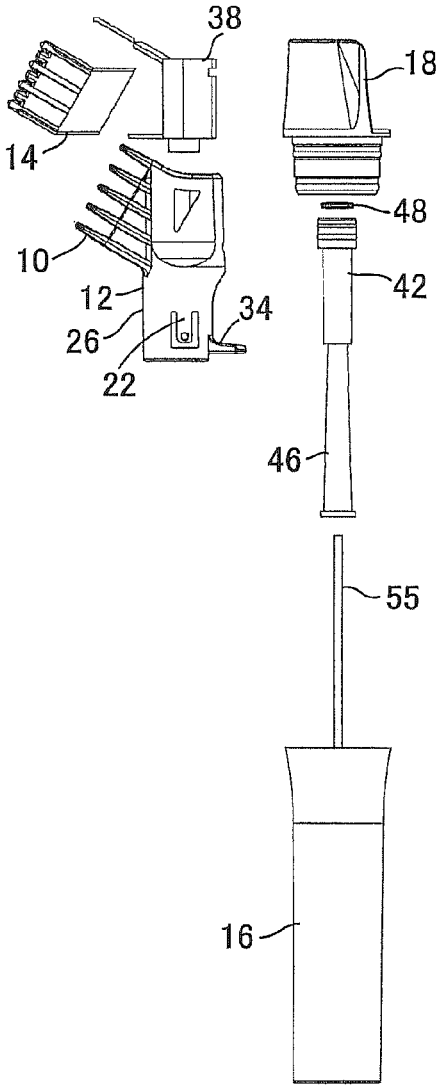
Figure 44C:
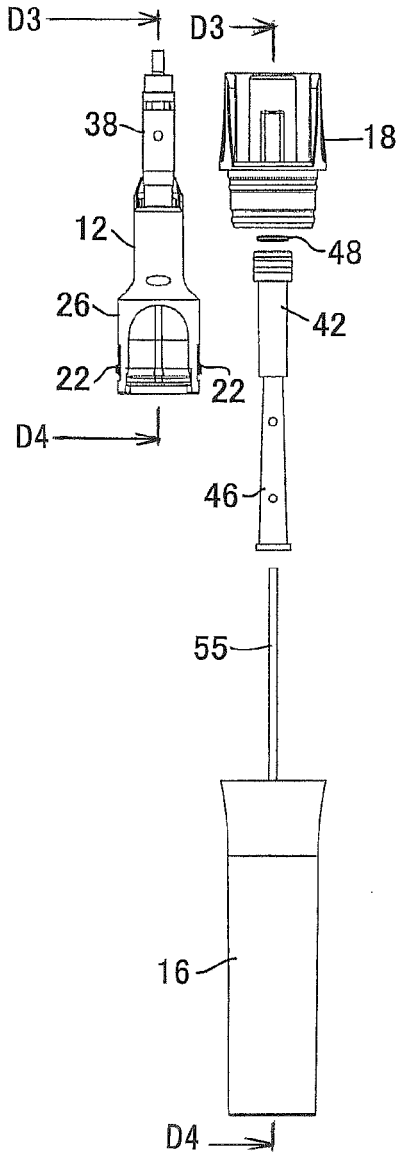
Figure 45A:
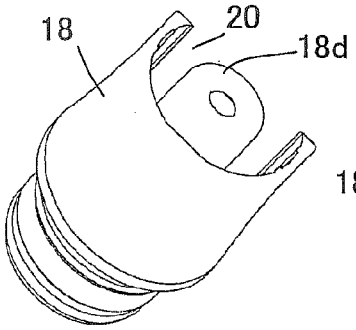
FIGS. 45A to 45I are illustrative diagrams of a front barrel of the same applicator.
Figure 45C:
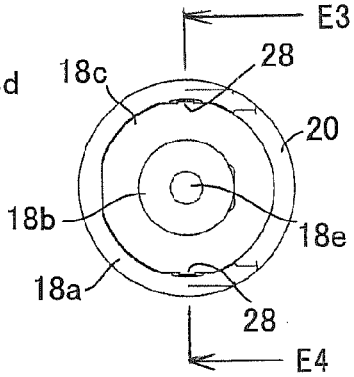
Figure 45B:
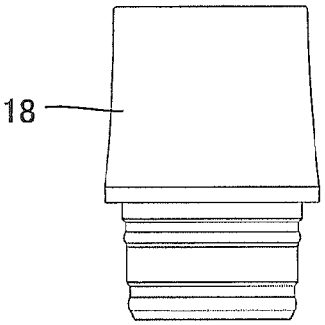
Figure 45D:
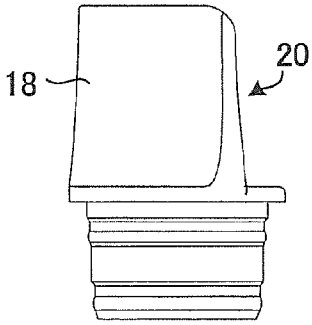
Figure 45E:
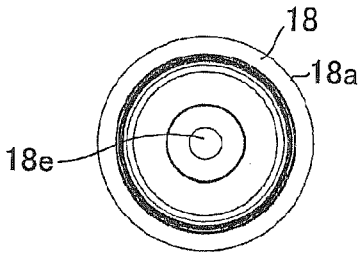
Figure 45F:
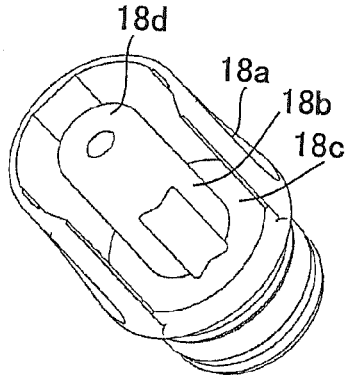
Figure 45G:
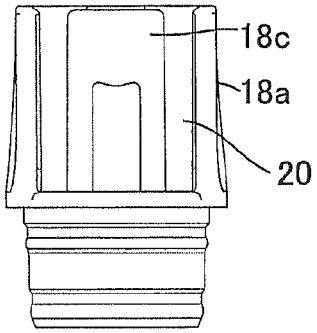
Figure 45I:
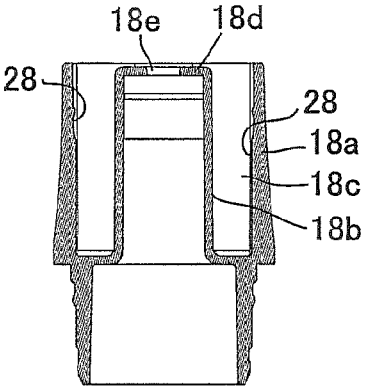
Figure 45H:
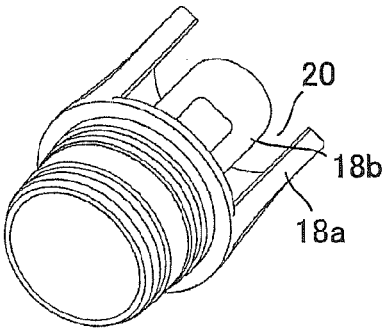

FIG. 41 shows the operation of the applicator. FIG. 41A shows a state when the applicator is not operated. As shown in FIG. 41B, at the start of lever 34 being pressed, the rear end of liquid passage portion 52 of comber 12 abuts valve part 46*a* of valve rod 46. At this point, if the pressure (the air) inside container body 16 increases due to change in temperature or the like the moment piston body 44 starts moving backwards, the air is released to the outside applying part 14 through liquid delivery hole 46*f* (see FIG. 39), return hole 42*d* and liquid passage portion 52, so that it is possible to prevent the application liquid from rushing out.

Thereafter, as shown in FIG. 41C, piston part 44*a* comes out of ribs 16*c* and into contact with the inner wall in the rear part of container body 16 (the gap between container body 16 and piston part 44*a* may be formed as small as 0.05 mm), the pressure of the application liquid inside reduced-diametric portion 16*b* increases. During this, liquid delivery hole 46*f* and return hole 42*d* communicate with each other up to a predetermined distance of shift, so that the application liquid or the air is returned.

Then, as shown in FIG. 41D and FIG. 41E, a further pressing of lever 34 shuts off the communication between liquid delivery hole 46*f* and return hole 42*d* to increase pressure so that the application liquid, passing through the path between the liquid passage 46*e* inside valve rod 46 and the liquid passage 44*d* on the side surface of main part 44*b* of piston body 44, flows from the interior of valve body 42 through liquid passage portion 52 and impregnates applying part 14 from its top. Thereafter, as the pressing force is freed, the operation returns to FIG. 41A.

The other operation is the same as that of the first to third embodiment, so that description is omitted.

Referring next to FIGS. 42 to 45, an applicator according to the fifth embodiment will be described.

The difference in structure of the applicator according to the fifth embodiment from the applicator of the fourth embodiment resides in, as shown in FIGS. 42 to 45, the following aspects: (1) hollow member 55, (2) an engagement structure 22 formed in comber 12, (3) a projection 28 formed in front barrel 18. The other configurations are the same as in the fourth embodiment so that description is omitted.

(1) As shown in FIGS. 42 and 43, hollow member 55 is held and inserted between piston body 44 and valve rod 46.

The valve rod 46 in this case has a markedly simplified configuration in which, instead of having liquid delivery hole 46*f* in the applicator of the fourth embodiment, the application liquid, passing from liquid passage 44*d* of piston body 44 to pipe-shaped hollow member 55, is ejected from a horizontal hole (horizontal hole located in the front part of the valve rod) designated at 46*h*. Valve rod 46 is a rear-open hollowed member having a hollow interior that connects to horizontal hole 46*h* at the front end. Piston body 44 has a stem-like main part 44*b* that extends from piston part 44*a* forwards near to the center of container body 16. This main part 44*b* is fitted from the rear part of the valve rod 46 into the hollow interior, so that the hollow member 55 is attached inside the hollow part between the piston body 44 and valve rod 46.

(2) In order to further smoothen the motion of pumping mechanism 36, arm 32 is formed so as not to flex (rear part 26 of comber 12 is formed approximately cylindrical without forming any cut and arm 32 is projectively formed) while engaging structures 22 are separately formed (see FIG. 44). As shown in FIG. 44, the engaging structures 22 of comber 12 are formed by cutting a U-shaped cut on both sides (90 degrees to both sides from the direction of arm 32 being formed) in rear part 26 of comber 12 to form valves of a cantilever structure with a projection formed on the outer peripheral surface of each valve.

(3) Projected parts 28 on which engagement structures 22 hook are provided in front barrel 18 (see FIG. 45). As shown in FIG. 45, projected parts 28 are projectively formed on the inner surface of outer periphery 18*a* of front barrel 18.

In the fifth embodiment, the aspect that attachment and removal of the applying unit (comber 12, applying part 14 and application liquid feeder 38) is performed by operating lever 34 of the pressing part is the same as the fourth embodiment, so that the applying part can be easily replaced without soiling hands.

INDUSTRIAL APPLICABILITY

The applicator of the present invention is a hair-care applicator that is attached to a container body to apply an application liquid (hair dye, hair liquid, hair tonic etc.) stored in the container while combing hair (including hairs of humans and others such as pet animals, etc.) and can be used by a single-handed operation.

DESCRIPTION OF REFERENCE NUMERALS

10 comb-toothed part
10*a* comb-formed projection
12 comber
12*a* front part
12*b* opening
12*c* viewing window
12*d* partitioning wall (the fourth embodiment)

14 applying part
14*a* projection
14*b* rear section
16 container body
16*a* front opening
16*b* reduced-diametric portion
16*c* rib
18 front barrel
18*a* outer periphery
18*b* inner peripheral wall portion
18*c* clearance between the outer periphery and the inner peripheral wall portion
18*c*' clearance for pressing part operation
18*d* front part
18*e* insert hole
18*f* valve seat insert
20 slit portion
22 engaging structure
24 pressing part
26 rear part
28 projected piece
30 cut
32 arm
34 lever
36 pumping mechanism
38 application liquid feeder
38*a* main part
38*b* opening
38*c* arm piece
38*d* gutter structure
38*f* flange
40 indicator portion
40*a* indicator's inclined plane
40*b* indicator's groove
42 valve seat body
42*a* main part
42*b* outer fitting part
42*c* slide hole
42*d* return hole
44 piston body
44*a* piston part
44*b* main part
44*c* spring receiver
44*d* liquid passage
44*e* projection
44*f* liquid delivery hole
46 valve rod
46*a* valve part
46*b* main part
46*c* reduced-diametric portion
46*d* groove
46*e* liquid passage
46*f* liquid delivery hole
46*g* projection
46*h* horizontal hole
48 sealing member
50 spring member
52 liquid passage portion
54 rib on the front barrel peripheral side
55 hollow member

The invention claimed is:

1. An applicator for applying an application liquid to an object with an applying part by supplying the application liquid stored in a container body to the applying part, comprising:

a container body storing the application liquid;

an application liquid feeder having an application liquid leading groove, the application liquid leading groove communicating with the application liquid stored in the container body;

an applying part fitted in the application liquid feeder, the applying part communicating with the application liquid leading groove with the applying part being fitted in the application liquid feeder; and a comber formed with a hollow interior so as to cover the application liquid feeder, the comber having a separate opening joined with the hollow interior for exposing a tip of the applying part and comb-toothed parts arranged at both sides of the separate opening, wherein the applying part is formed of a material that can absorb the application liquid, the application liquid feeder has at least one wall for forming a space for receiving the applying part, the wall being opposite to the applying part and formed with a jagged configuration, and wherein the jagged configuration in the wall is made of a material selected from the group consisting of:

a transparent resin;

a translucent resin;

a transparent quality of glass; and a translucent quality of glass; and the comber has a viewing window opposite to a rear surface of the jagged configuration in the wall and the comber surrounds and houses the application liquid feeder, the applicator further comprising:

a front barrel for supporting the comber movably in a longitudinal direction of the applicator; and a pumping mechanism for appropriately supplying the application liquid freely stored in the container body to the applying part by user operation, wherein the comber has a cantilevered pressing part formed on a side surface of the comber, the front barrel has a slit portion for supporting the cantilevered pressing part movably in the longitudinal direction, the pumping mechanism comprises:

a piston part arranged inside of the container body; and a valve rod for transferring movement of the comber in the longitudinal direction to the piston part, and the valve rod has a valve rod groove communicating between the application liquid compressed by movement of the piston part and the application liquid leading groove.

2. The applicator according to claim 1, wherein the jagged configuration of the indicator portion is formed in an inclined zigzag pattern.

3. The applicator according to claim 1, wherein the jagged configuration is formed by at least one dent having a width and a depth generating a capillary force to the application liquid.

* * * * *